US010352144B2

(12) United States Patent
Entchev et al.

(10) Patent No.: US 10,352,144 B2
(45) Date of Patent: Jul. 16, 2019

(54) SAFETY SYSTEM FOR AUTONOMOUS DOWNHOLE TOOL

(71) Applicants: Pavlin B. Entchev, Spring, TX (US); Renzo M. Angeles Boza, Houston, TX (US); George R. King, Richmond, TX (US); Robert C. Stanton, Cypress, TX (US); Elton Winemiller, Katy, TX (US); Randy C Tolman, Spring, TX (US); Peter W. Sauermilch, Suger Land, TX (US); Jason Z. Gahr, Columbus, TX (US)

(72) Inventors: Pavlin B. Entchev, Spring, TX (US); Renzo M. Angeles Boza, Houston, TX (US); George R. King, Richmond, TX (US); Robert C. Stanton, Cypress, TX (US); Elton Winemiller, Katy, TX (US); Randy C Tolman, Spring, TX (US); Peter W. Sauermilch, Suger Land, TX (US); Jason Z. Gahr, Columbus, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 69 days.

(21) Appl. No.: 15/848,825

(22) Filed: Dec. 20, 2017

(65) Prior Publication Data

US 2018/0135398 A1 May 17, 2018

Related U.S. Application Data

(62) Division of application No. 14/005,166, filed as application No. PCT/US2012/028529 on Mar. 9, 2012, now Pat. No. 9,903,192.

(Continued)

(51) Int. Cl.
*E21B 43/263* (2006.01)
*E21B 33/12* (2006.01)

(Continued)

(52) U.S. Cl.
CPC ..... *E21B 43/263* (2013.01); *E21B 33/1204* (2013.01); *E21B 43/119* (2013.01); *E21B 43/26* (2013.01); *E21B 44/005* (2013.01)

(58) Field of Classification Search
CPC ..... E21B 33/1204; E21B 3/119; E21B 43/26; E21B 43/263; E21B 44/005
See application file for complete search history.

(56) References Cited

U.S. PATENT DOCUMENTS 2,543,823 A 3/1951 Barry
2,833,215 A 5/1958 Spencer (Continued)

FOREIGN PATENT DOCUMENTS

WO WO 2012/082302 A1 6/2012

*Primary Examiner* — Caroline N Butcher
(74) *Attorney, Agent, or Firm* — ExxonMobil Upstream Research Company—Law Department

(57) ABSTRACT

A tool assembly for performing a wellbore operation including an actuatable tool, a location device, and on-board controller are together dimensioned and arranged to be deployed in the wellbore as an autonomous unit. The actuatable tool, such as a perforating gun having associated charges, perforates a wellbore along a selected zone of interest. The location device, such as casing collar locator, senses the location of the actuatable tool based on a physical signature provided along the wellbore. The on-board controller or micro-processor is configured to send an activation signal to the actuatable tool when the location device has recognized a selected location of the tool based on the physical signature. The tool assembly further includes a (Continued)

multi-gate safety system. The safety system prevents premature activation of the actuatable tool.

43 Claims, 28 Drawing Sheets

Related U.S. Application Data

(60) Provisional application No. 61/489,165, filed on May 23, 2011.

(51) Int. Cl.

| | |
|---|---|
| ***E21B 43/119*** | (2006.01) |
| ***E21B 43/26*** | (2006.01) |
| ***E21B 44/00*** | (2006.01) |

(56) References Cited

U.S. PATENT DOCUMENTS

| | | | |
|---|---|---|---|
| 4,194,561 | A | 3/1980 | Stokley et al. |
| 4,572,288 | A | 2/1986 | Kinley |
| 4,893,676 | A | 1/1990 | Hill |
| 5,460,093 | A | 10/1995 | Prinz et al. |
| 5,909,774 | A | 6/1999 | Griffith et al. |
| 6,056,055 | A | 5/2000 | Falconer et al. |
| 6,151,961 | A | 11/2000 | Huber et al. |
| 6,378,627 | B1 | 4/2002 | Tubel et al. |
| 6,394,184 | B2 | 5/2002 | Tolman et al. |
| 6,513,599 | B1 | 2/2003 | Bixenman et al. |
| 6,543,538 | B2 | 4/2003 | Tolman et al. |
| 6,581,689 | B2 | 6/2003 | Hailey, Jr. |
| 6,601,646 | B2 | 8/2003 | Streich et al. |
| 6,752,206 | B2 | 6/2004 | Watson et al. |
| 6,779,605 | B2 | 8/2004 | Jackson |
| 6,789,623 | B2 | 9/2004 | Hill, Jr. et al. |
| 6,817,410 | B2 | 11/2004 | Wetzel et al. |
| 6,830,104 | B2 | 12/2004 | Nguyen et al. |
| 6,843,317 | B2 | 1/2005 | Mackenzie |
| 6,935,432 | B2 | 8/2005 | Nguyen |
| 6,983,796 | B2 | 1/2006 | Bayne et al. |
| 6,997,263 | B2 | 2/2006 | Campbell et al. |
| 7,055,598 | B2 | 6/2006 | Ross et al. |
| 7,096,945 | B2 | 8/2006 | Richards et al. |
| 7,100,691 | B2 | 9/2006 | Nguyen et al. |
| 7,252,142 | B2 | 8/2007 | Brezinski et al. |
| 7,264,061 | B2 | 9/2007 | Dybevik et al. |
| 7,325,616 | B2 | 2/2008 | Lopez de Cardenas et al. |
| 7,363,967 | B2 | 4/2008 | Burris, II et al. |
| 7,367,395 | B2 | 5/2008 | Vidrine et al. |
| 7,385,523 | B2 | 6/2008 | Thomeer et al. |
| 7,407,007 | B2 | 8/2008 | Tibbles |
| 7,431,085 | B2 | 10/2008 | Coronado et al. |
| 7,431,098 | B2 | 10/2008 | Ohmer et al. |
| 7,441,605 | B2 | 10/2008 | Coronado et al. |
| 7,562,709 | B2 | 7/2009 | Saebi et al. |
| 7,591,321 | B2 | 9/2009 | Whitsitt et al. |
| 7,703,507 | B2 | 4/2010 | Strickland |
| 7,814,970 | B2 | 10/2010 | Strickland |
| 8,037,934 | B2 | 10/2011 | Strickland |
| 8,162,051 | B2 | 4/2012 | Strickland |
| 8,272,439 | B2 | 7/2012 | Strickland |
| 2002/0032529 | A1 | 3/2002 | Duhon |
| 2002/0093431 | A1 | 7/2002 | Zierolf |
| 2004/0007829 | A1 | 1/2004 | Ross |
| 2004/0221993 | A1 | 11/2004 | Patterson et al. |
| 2005/0241824 | A1 | 11/2005 | Burris, II et al. |
| 2005/0263287 | A1 | 12/2005 | Achee, Jr. et al. |
| 2007/0056750 | A1 | 3/2007 | John et al. |
| 2008/0053658 | A1 | 3/2008 | Wesson et al. |
| 2008/0125335 | A1 | 5/2008 | Bhavsar |
| 2008/0142222 | A1 | 6/2008 | Howard et al. |
| 2008/0196896 | A1 | 8/2008 | Bustos et al. |
| 2008/0257546 | A1 | 10/2008 | Cresswell et al. |
| 2009/0084556 | A1 | 4/2009 | Richards et al. |
| 2009/0114392 | A1 | 5/2009 | Tolman et al. |
| 2009/0120637 | A1 | 5/2009 | Kirkwood et al. |
| 2009/0159279 | A1 | 6/2009 | Assal |
| 2009/0159285 | A1 | 6/2009 | Goodman |
| 2009/0168606 | A1 | 7/2009 | Lerche et al. |
| 2009/0248307 | A1 | 10/2009 | Barrow et al. |
| 2009/0283279 | A1 | 11/2009 | Patel et al. |
| 2009/0301723 | A1 | 12/2009 | Gray |
| 2010/0005992 | A1 | 1/2010 | Crawford |
| 2010/0230105 | A1 | 9/2010 | Vaynshteyn |
| 2011/0035152 | A1 | 2/2011 | Durocher et al. |
| 2013/0062055 | A1 | 3/2013 | Tolman et al. |

SAFETY SYSTEM FOR AUTONOMOUS DOWNHOLE TOOL

CROSS REFERENCE TO RELATED APPLICATIONS

This application is a Divisional Application of and claims the benefit of U.S. patent application Ser. No. 14/005,166 filed Jan. 30, 2014, which is a 371 National Stage Application of International Application No. PCT/US2012/28529, filed Mar. 9, 2012, both of which claim benefit of U.S. Provisional Application 61/489,165, filed May 23, 2011, each of which are incorporated herein by reference in their entirety. This Divisional Application is also related to International Patent Application No. PCT/US2011/038202 which published on Dec. 1, 2011 as Pub. No. WO 2011/150251, U.S. patent application Ser. No. 13/697,769, filed Nov. 13, 2012, which published as U.S. Patent Publication No. US 2013/0062055 on Mar. 14, 2013, the entire contents of each of which are also incorporated herein by reference in their entirety.

BACKGROUND

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

This invention relates generally to the field of perforating and treating subterranean formations to enable the production of oil and gas therefrom. More specifically, the invention relates to a safety system for preventing premature activation of an autonomous downhole tool, such as a perforating gun or a bridge plug.

General Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations.

A cementing operation is typically conducted in order to fill or "squeeze" the annular area with cement. This serves to form a cement sheath. The combination of cement and casing strengthens the wellbore and facilitates the isolation of the formations behind the casing.

It is common to place several strings of casing having progressively smaller outer diameters into the wellbore. Thus, the process of drilling and then cementing progressively smaller strings of casing is repeated several or even multiple times until the well has reached total depth. The final string of casing, referred to as a production casing, is cemented into place. In some instances, the final string of casing is a liner, that is, a string of casing that is not tied back to the surface, but is hung from the lower end of the preceding string of casing.

As part of the completion process, the production casing is perforated at a desired level. This means that lateral holes are shot through the casing and the cement sheath surrounding the casing. The perforations allow hydrocarbon fluids to flow into the wellbore. Thereafter, the formation is typically fractured.

Hydraulic fracturing consists of injecting viscous fluids (usually shear thinning, non-Newtonian gels or emulsions) into a formation at such high pressures and rates that the reservoir rock fails and forms a network of fractures. The fracturing fluid is typically mixed with a granular proppant material such as sand, ceramic beads, or other granular materials. The proppant serves to hold the fracture(s) open after the hydraulic pressures are released. The combination of fractures and injected proppant increases the flow capacity of the treated reservoir.

In order to further stimulate the formation and to clean the near-wellbore regions downhole, an operator may choose to "acidize" the formations. This is done by injecting an acid solution down the wellbore and through the perforations. The use of an acidizing solution is particularly beneficial when the formation comprises carbonate rock. In operation, the drilling company injects a concentrated formic acid or other acidic composition into the wellbore, and directs the fluid into selected zones of interest. The acid helps to dissolve carbonate material, thereby opening up porous channels through which hydrocarbon fluids may flow into the wellbore. In addition, the acid helps to dissolve drilling mud that may have invaded the formation.

Application of hydraulic fracturing and acid stimulation as described above is a routine part of petroleum industry operations as applied to individual target zones. Such target zones may represent up to about 60 meters (100 feet) of gross, vertical thickness of subterranean formation. When there are multiple or layered reservoirs to be hydraulically fractured, or a very thick hydrocarbon-bearing formation (over about 40 meters, or 131 feet), then more complex treatment techniques are required to obtain treatment of the entire target formation. In this respect, the operating company must isolate various zones or sections to ensure that each separate zone is not only perforated, but adequately fractured and treated. In this way the operator is sure that fracturing fluid and/or stimulant is being injected through each set of perforations and into each zone of interest to effectively increase the flow capacity at each desired depth.

The isolation of various zones for pre-production treatment requires that the intervals be treated in stages. This, in turn, involves the use of so-called diversion methods. In petroleum industry terminology, "diversion" means that injected fluid is diverted from entering one set of perforations so that the fluid primarily enters only one selected zone of interest. Where multiple zones of interest are to be perforated, this requires that multiple stages of diversion be carried out.

In order to isolate selected zones of interest, various diversion techniques may be employed within the wellbore. Known diversion techniques include the use of:

- Mechanical devices such as bridge plugs, packers, downhole valves, sliding sleeves, and baffle/plug combinations;
- Ball sealers;
- Particulates such as sand, ceramic material, proppant, salt, waxes, resins, or other compounds;
- Chemical systems such as viscosified fluids, gelled fluids, foams, or other chemically formulated fluids; and
- Limited entry methods.

These and other methods for temporarily blocking the flow of fluids into or out of a given set of perforations are described more fully in U.S. Pat. No. 6,394,184, entitled "Method and Apparatus for Stimulation of Multiple Formation Intervals", which issued in 2002 and is referred to and incorporated herein by reference in its entirety.

The '184 patent also discloses various techniques for running a bottom hole assembly ("BHA") into a wellbore, and then creating fluid communication between the wellbore and various zones of interest. In most embodiments, the BHA includes various perforating guns having associated charges. In most embodiments, the BHA is deployed in the wellbore by means of a wireline extending from the surface. The wireline provides electrical signals to the perforating guns for detonation. The electrical signals allow the operator to cause the charges to detonate, thereby forming perforations.

The BHA also includes a set of mechanically actuated, axial position locking devices, or slips. The slips are actuated through a "continuous J" mechanism by cycling the axial load between compression and tension. In this way, the slips are re-settable.

The BHA further includes an inflatable packer or other sealing mechanism. The packer is actuated by application of a slight compressive load after the slips are set within the casing. Along with the slips, the packer is resettable so that the BHA may be moved to different depths or locations along the wellbore so as to isolate perforations along selected zones of interest.

The BHA also includes a casing collar locator. The casing collar locator initially allows the operator to monitor the depth or location of the assembly for appropriately detonating charges. After the charges are detonated (or the casing is otherwise penetrated for fluid communication with a surrounding zone of interest), the BHA is moved so that the packer may be set at a desired depth. The casing collar locator allows the operator to move the BHA to an appropriate depth relative to the newly formed perforations, and then isolate those perforations for hydraulic fracturing and chemical treatment.

Each of the various embodiments for a BHA disclosed in the '184 patent includes a means for deploying the assembly into the wellbore, and then translating the assembly up and down the wellbore. Such translation means include a string of coiled tubing, conventional jointed tubing, a wireline, an electric line, or a downhole tractor. In any instance, the purpose of the bottom hole assembly is to allow the operator to perforate the casing along various zones of interest, and then sequentially isolate the respective zones of interest so that fracturing fluid may be injected into the zones of interest in the same trip.

The bottom hole assembly and the formation treating processes disclosed in the '184 patent help to expedite the well completion process. In this respect, the operator is able to selectively set the slips and the packer for perforation and subsequent formation treatment. The operator is able to set the BHA at a first location, fracture or otherwise stimulate a formation, release the BHA, and move it to a new level along the wellbore, all without removing the BHA from the wellbore between stages.

The bottom hole assembly and the formation treating processes disclosed in the '184 patent is named "Annular Coiled Tubing FRACturing (ACT-Frac). The ACT-Frac process allows the operator to more effectively stimulate multi-layer hydrocarbon formations at substantially reduced cost compared to previous completion methods.

However, as with previously-known well completion processes, the ACT-Frac process requires the use of expensive surface equipment. Such equipment includes a lubricator, which may extend as much as 75 feet above the wellhead. In this respect, the lubricator must be of a length greater than the length of the perforating gun assembly (or other tool string) to allow the perforating gun assembly to be safely deployed in the wellbore under pressure.

The lubricator is suspended over the wellbore by means of a crane arm. The crane arm, in turn, is supported over the earth surface by a crane base. The crane base may be a working vehicle that is capable of transporting part or all of the crane arm over a roadway. The crane arm includes wires or cables used to hold and manipulate the lubricator into and out of position over the wellbore. The crane arm and crane base are designed to support the load of the lubricator and any load requirements anticipated for the completion operations.

A wireline or electric line runs over a pulley and then down through the lubricator. To protect the wireline from abrasive fracturing fluid, the wellhead may also include a wireline isolation tool. The wireline isolation tool provides a means to protect the wireline from the direct flow of proppant-laden fluid injected into side outlet injection valves.

The use of a crane and suspended lubricator add expense and complexity to a well completion operation, thereby lowering the overall economics of a well-drilling project. Further, cranes and wireline equipment present on location occupy needed space. Accordingly, Applicant has conceived of downhole tools that may be deployed within a wellbore without a lubricator and a crane arm. Such downhole tools include a perforating gun and a bridge plug. Such downhole tools are autonomous, meaning that they are not necessarily mechanically controlled from the surface, and do not receive an electrical signal from the surface. Beneficially, such tools may be used for perforating and treating multiple intervals along a wellbore without being limited by pump rate or the need for an elongated lubricator.

International patent application titled "Assembly And Method For Multi-Zone Fracture Stimulation of A Reservoir Using Autonomous Tubular Units" describes the design and operation of autonomous tools and was published on Dec. 1, 2011 as WO 2011/150251. In this application a tool assembly is first provided. The tool assembly is intended for use in performing a tubular operation. In one embodiment, the tool assembly comprises an actuatable tool. The actuatable tool may be, for example, a fracturing plug, a bridge plug, a cutting tool, a casing patch, a cement retainer, or a perforating gun.

The tool assembly preferably self-destructs in response to a designated event. Thus, where the tool is a fracturing plug, the tool assembly may self-destruct within the wellbore at a designated time after being set. Where the tool is a perforating gun, the tool assembly may self-destruct as the gun is being fired upon reaching a selected level or zone of interest.

The tool assembly also includes a location device. The location device is designed to sense the location of the actuatable tool within a tubular body. The tubular body may be, for example, a wellbore constructed to produce hydrocarbon fluids, or a pipeline for the transportation of fluids.

The location device senses location within the tubular body based on a physical signature provided along the tubular body. In one arrangement, the location device is a casing collar locator, and the physical signature is formed by the spacing of collars along the tubular body. The collars are sensed by the collar locator. In another arrangement, the location device is a radio frequency antenna, and the physical signature is formed by the spacing of identification tags along the tubular body. The identification tags are sensed by the radio frequency antenna.

The tool assembly also comprises an on-board controller. The controller is designed to send an actuation signal to the actuatable tool when the location device has recognized a selected location of the tool. The location is again based on the physical signature along the wellbore. The actuatable tool, the location device, and the on-board controller are together dimensioned and arranged to be deployed in the tubular body as an autonomous unit.

WO 2011/150251 discusses the need for a safety system for an autonomous tool, particularly where the tool assembly includes a perforating gun. In this respect, the risk of premature detonation of charges along a perforating gun must be completely removed to provide a safe well site. The present application provides an improved safety system for an autonomous tool assembly.

SUMMARY

The assemblies described herein have various benefits in the conducting of oil and gas exploration and production activities.

A tool assembly for performing a wellbore operation is first disclosed. The tool assembly fundamentally includes an actuatable tool. The actuatable tool is preferably a perforating gun. In this instance, the perforating gun has associated charges that are fired along a selected zone of interest within a wellbore. Preferably, the perforating gun is fabricated from a friable material such that the tool assembly self-destructs in response to detonation of the associated charges.

The actuatable tool may include other downhole devices. These include a fracturing plug, a bridge plug, a casing patch, or a cement retainer. In these instances, the actuatable tool may be substantially fabricated from a friable material or a millable material. Where the actuatable tool is a fracturing plug or a bridge plug, the tool is configured to form a substantial fluid seal when actuated within the wellbore. The plug comprises an elastomeric sealing element and a set of slips for holding the tool assembly at the selected location.

The tool assembly also has a location device. The location device senses the location of the actuatable tool within a wellbore. Sensing is based on a physical signature provided along the wellbore. For example, the location device may be a casing collar locator that identifies collars by detecting magnetic anomalies along a casing wall. In this instance, the physical signature is formed by the spacing of collars along a string of casing, with the collars being sensed by the collar locator.

Alternatively, the location device may be a radio frequency antenna that detects the presence of RFID tags spaced along or within the casing wall. In this instance, the physical signature is formed by the spacing of identification tags along a string of casing, with the identification tags being sensed by the radio frequency antenna.

The tool assembly further includes an on-board controller. The on-board controller is configured to send an actuation signal to the actuatable tool when the location device has recognized a selected location of the tool based on the physical signature. Preferably, the on-board controller is part of an electronic module comprising onboard memory and built-in logic. Where the actuatable tool is a perforating gun, the electronic module is configured to send a signal that initiates detonation of the perforating gun after the tool assembly has traveled to the pre-programmed location in the wellbore.

In one embodiment, the location device comprises a pair of sensing devices spaced apart along the tool assembly. The sensing devices represent lower and upper sensing devices. The controller then comprises a clock that determines time that elapses between sensing by the lower sensing device and sensing by the upper sensing device as the tool assembly traverses across a physical signature marker. The tool assembly is programmed to determine tool assembly velocity at a given time based on the distance between the lower and upper sensing devices, divided by the elapsed time between sensing. In this way, location of the tool can be calculated relative to the physical signature provided by downhole markers.

The actuatable tool, the location device, and the on-board controller are together dimensioned and arranged to be deployed in the wellbore as an autonomous unit. This means that the tool assembly does not rely upon a signal from the surface to know when to activate the tool. Preferably, the tool assembly is released into the wellbore without a working line. The tool assembly either falls gravitationally into the wellbore, or is pumped downhole. However, a non-electric working line such as slickline may optionally be employed.

As part of the tool assembly herein, a multi-gate safety system is provided. The multi-gate safety system prevents premature activation of the actuatable tool. This is of particular importance when the tool assembly includes shaped charges in a perforating gun.

The multi-gate system comprises one or more electrical switches, referred to herein as "gates." The gates are independently closed in response to separate conditions before permitting the actuation signal to reach the actuatable tool. The multi-gate safety system may comprise at least one of the following:

(i) a selectively removable battery pack that provides power to the control circuitry when installed into the assembly;

(ii) a mechanical pull-tab that is configured to operate an electrical switch upon removal from the tool assembly;

(iii) a pressure-sensitive electrical switch that operates only when a designated hydraulic pressure is exceeded;

(iv) an electrical timer that is configured to selectively operate one or more switches at one or more designated times after deployment of the tool assembly in the wellbore;

(v) a velocity sensor configured to operate an electrical switch only upon sensing that the tool assembly is traveling a designated velocity;

(vi) a sensor configured to operate an electrical switch when the tool assembly is substantially vertical; and (vii) a sensor configured to operate an electrical switch when the tool assembly is substantially horizontal.

In any of these gates, operating an electrical switch means either opening or closing such a switch. For example, closing the switch permits current to flow through the switch and toward the actuatable tool. Thus, for example, when the actuatable tool is a perforating gun, the activation signal is sent through control circuitry, through the closed switches, and to the detonators to fire the shaped charges. On the other hand, an electrical switch may also be used as a shunting device. For example, detonators are usually shunted during shipping and handling before they are installed into a perforating gun assembly. Thus, an electrical switch in its closed position can be used to shunt a detonator, while opening the switch un-shunts the detonator, making its operation possible.

In one aspect, the multi-gate safety system comprises both the mechanical pull-tab and the timer switch. In this instance, deployment of the tool assembly means that the tool assembly is configured for removal of the mechanical pull-tab. Stated another way, the timer begins counting when the tab is removed from the tool assembly.

In another aspect, the multi-gate safety system comprises both the mechanical pull-tab and the pressure sensitive switch. In this instance, the mechanical pull-tab is configured to provide a mechanical barrier to the activation of the pressure-sensitive switch. Thus, the pressure-sensitive switch cannot close until the tab has been removed from the tool assembly.

In yet another aspect, the multi-gate safety system comprises the electrical timer switch and a mechanical relay having a timer. The timer for the mechanical relay is configured to activate after the electrical timer switch is closed. The mechanical relay will re-open the electrical timer switch after a pre-set period of time has passed, such as one hour. This allows the tool assembly to be safely removed from the wellbore if needed.

An integrated tool for downhole fracture operations is also provided herein. The integrated tool combines two actuatable tools. These will include both a plug and a perforating gun.

The plug has a plug body having an elastomeric sealing element. The plug also has a setting tool for setting the plug body within a string of casing in a wellbore. When actuated, the plug provides a substantial fluid seal within the casing.

The perforating gun has shaped charges for perforating the string of casing above the plug. When actuated, the perforating gun perforates the string of casing at a selected zone of interest.

As with the tool assembly above, the integrated tool has a position locator. The position locator senses the presence of objects along the wellbore and generates depth signals in response. Preferably, the location device is a casing collar locator that "counts" collars by detecting magnetic anomalies along a casing wall.

The integrated tool also has an on-board controller. The on-board controller processes the depth signals and activates the plug and the perforating gun at the selected zone of interest. Preferably, the on-board controller is part of an electronic module comprising onboard memory and built-in logic. Where the actuatable tool is a perforating gun, the electronic module is configured to send a signal that initiates detonation of the perforating gun after the tool assembly has traveled to a pre-programmed location in the wellbore.

The integrated tool further includes a multi-gate safety system. The safety system is designed to prevent premature activation of the actuatable tools. This is of particular importance in preventing detonation of the shaped charges in the perforating gun before the tool is deployed in the wellbore.

The safety system is designed in accordance with the multi-gate safety system described above. In this respect, the safety system comprises one or more electrical switches, referred to herein as "gates." The gates are independently closed in response to separate conditions before permitting the activation signal to reach the perforating gun.

The integrated tool is dimensioned and arranged to be deployed within the wellbore as an autonomous unit. This means that the integrated tool does not rely upon a signal from the surface to know when to activate the tool. Preferably, the tool assembly is released into the wellbore without a working line. The tool assembly either falls gravitationally into the wellbore, or is pumped downhole.

In one aspect, the integrated tool comprises a fishing neck. This allows the tool to be retrieved if the charges fail to detonate.

A method of performing a wellbore operation is also provided herein. The method includes providing a tool assembly at a well site. The tool assembly is an autonomous downhole tool as described above. Preferably, the autonomous tool is a perforating gun assembly, although it may alternatively be a fracturing plug, a casing patch, or other tool that an operator may choose to run into a wellbore and then actuate.

The method also includes deploying the actuatable tool into the wellbore. This is done without electrical control external to the wellbore.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

In FIG. 3A, an autonomous tool representing a combined plug and perforating gun is falling down the wellbore.

In FIG. 3B, the plug body of the plug assembly has been actuated, causing the autonomous tool to be seated in the wellbore at a selected depth. The perforating gun is ready to fire.

In FIG. 5A, the fracturing plug assembly is in its run-in or pre-actuated position.

In FIG. 5B, the fracturing plug assembly is in its actuated state.

DETAILED DESCRIPTION

Definitions

Figure 1:
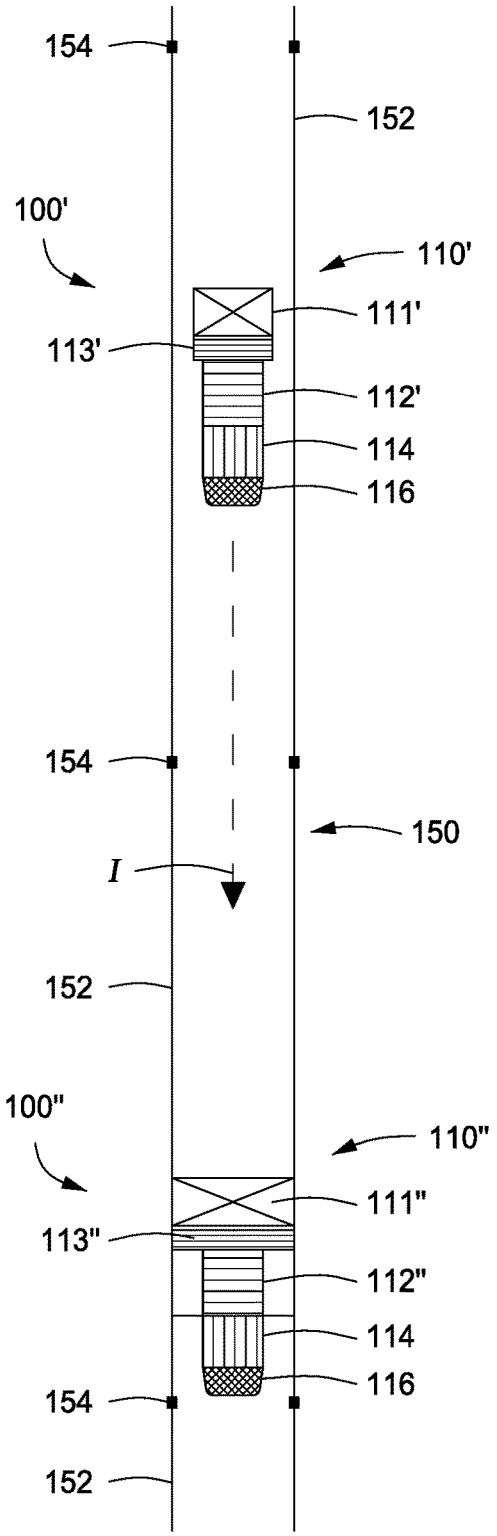
FIG. 1 is a side view of an autonomous tool as may be used for wellbore operations. In this view, the tool is a fracturing plug assembly deployed in a string of production casing. The fracturing plug assembly is shown in both a pre-actuated position and an actuated position.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase at 1 atm and 15° C.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refers to a portion of a formation containing hydrocarbons. Alternatively, the formation may be a water-bearing interval.

For purposes of the present disclosure, the terms "ceramic" or "ceramic material" may include oxides such as alumina and zirconia. Specific examples include bismuth strontium calcium copper oxide, silicon aluminium oxynitrides, uranium oxide, yttrium barium copper oxide, zinc oxide, and zirconium dioxide. "Ceramic" may also include non-oxides such as carbides, borides, nitrides and silicides. Specific examples include titanium carbide, silicon carbide, boron nitride, magnesium diboride, and silicon nitride. The term "ceramic" also includes composites, meaning particulate reinforced, combinations of oxides and non-oxides. Additional specific examples of ceramics include barium titanate, strontium titanate, ferrite, and lead zierconate titanate.

For purposes of the present patent, the term "production casing" includes a liner string or any other tubular body fixed in a wellbore along a zone of interest.

The term "friable" means any material that is easily crumbled, powderized, or broken into very small pieces. The term "friable" includes frangible materials such as ceramic.

The term "millable" means any material that may be drilled or ground into pieces within a wellbore. Such materials may include aluminum, brass, cast iron, steel, ceramic, phenolic, composite, and combinations thereof.

The term "switch" may mean a physical switch that is actuated by means of a magnet, a spring, or other physical device. Alternatively, the term "switch" may mean an electrical component operated through firmware. Alternatively still, the term "switch" may mean a semi-conductor actuated through an electrical signal or logic control.

As used herein, the term "wellbore" refers to a hole in the subsurface made by drilling or insertion of a conduit into the subsurface. A wellbore may have a substantially circular cross section, or other cross-sectional shapes. As used herein, the term "well", when referring to an opening in the formation, may be used interchangeably with the term "wellbore."

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

It is proposed herein to use tool assemblies for well-completion or other wellbore operations that are autonomous. In this respect, the tool assemblies do not require a wireline and are not otherwise mechanically tethered or electronically connected to equipment external to the wellbore. The delivery method of a tool assembly may include gravity, pumping, and tractor delivery.

Various tool assemblies are therefore proposed herein that generally include:

an actuatable tool;

a location device for sensing the location of the actuatable tool within a tubular body based on a physical signature provided along the tubular body; and an on-board controller configured to send an activation signal to the actuatable tool when the location device has recognized a selected location of the tool based on the physical signature.

The actuatable tool is designed to be actuated to perform a tubular operation in response to the activation signal.

The actuatable tool, the location device, and the on-board controller are together dimensioned and arranged to be deployed in a wellbore as an autonomous unit.

FIG. 1 presents a side view of an illustrative autonomous tool 100' as may be used for wellbore operations. In this view, the tool 100' is a fracturing plug assembly, and the wellbore operation is a wellbore completion.

The fracturing plug assembly 100' is deployed within a string of production casing 150. The production casing 150 is formed from a plurality of "joints" 152 that are threadedly connected at collars 154. The wellbore completion will include the injection of fluids into the production casing 150 under high pressure.

In FIG. 1, the fracturing plug assembly is shown in both a pre-actuated position and an actuated position. The fracturing plug assembly is shown in a pre-actuated position at 100', and in an actuated position at 100". Arrow "I" indicates the movement of the fracturing plug assembly 100' in its pre-actuated position, down to a location in the production casing 150 where the fracturing plug assembly 100" is in its actuated position. The fracturing plug assembly will be described primarily with reference to its pre-actuated position, at 100'.

The fracturing plug assembly 100' first includes a plug body 110'. The plug body 110' will preferably define an elastomeric sealing element 111' and a set of slips 113'. The elastomeric sealing element 111' is mechanically expanded in response to a shift in a sleeve or other means as is known in the art. The slips 113' also ride outwardly from the assembly 100' along wedges (not shown) spaced radially around the assembly 100'. Preferably, the slips 113' are also urged outwardly along the wedges in response to a shift in the same sleeve or other means as is known in the art. The slips 113' extend radially to "bite" into the casing when actuated, securing the plug assembly 100' in position. Examples of existing plugs with suitable designs are the Smith Copperhead Drillable Bridge Plug and the Halliburton Fas Drill® Frac Plug.

The fracturing plug assembly 100' also includes a setting tool 112'. The setting tool 112' will actuate the slips 113' and the elastomeric sealing element 111' and translate them along the wedges to contact the surrounding casing 150.

In the actuated position for the plug assembly 100", the plug body 110" is shown in an expanded state. In this respect, the elastomeric sealing element 111" is expanded into sealed engagement with the surrounding production casing 150, and the slips 113" are expanded into mechanical engagement with the surrounding production casing 150. The sealing element 111" comprises a sealing ring, while the slips 113" offer grooves or teeth that "bite" into the inner diameter of the casing 150. Thus, in the tool assembly 100", the plug body 110" consisting of the sealing element 111" and the slips 113" defines the actuatable tool.

The fracturing plug assembly 100' also includes a position locator 114. The position locator 114 serves as a location device for sensing the location of the tool assembly 100' within the production casing 150. More specifically, the position locator 114 senses the presence of objects or "tags" along the wellbore 150, and generates depth signals in response.

In the view of FIG. 1, the objects 154 are the casing collars. This means that the position locator 114 is a casing collar locator, known in the industry as a "CCL." The CCL senses the location of the casing collars 154 as it moves down the production casing 150. While FIG. 1 presents the position locator 114 as a CCL and the objects 154 as casing collars, it is understood that other sensing arrangements may be employed in the fracturing plug assembly 100'. For example, the position locator 114 may be a radio frequency detector, and the objects 154 may be radio frequency identification tags, or "RFID" devices. In this arrangement, the tags may be placed along the inner diameters of selected casing joints 152, and the position locator 114 will define an RFID antenna/reader that detects the RFID tags. Alternatively, the position locator 114 may be both a casing collar locator and a radio frequency antenna. The radio frequency tags may be placed, for example, every 500 feet or every 1,000 feet to assist a casing collar locator algorithm.

A special tool-locating algorithm may be employed for accurately tracking casing collars. U.S. Provisional Pat. Appl. No. 61/424,285 filed on Dec. 17, 2010 discloses a method of actuating a downhole tool in a wellbore. This patent application is entitled "Method for Automatic Control and Positioning of Autonomous Downhole Tools."

The method first includes acquiring a CCL data set from the wellbore. This is preferably done using a traditional casing collar locator. The CCL data set correlates continuously recorded magnetic signals with measured depth. In this way, a first CCL log for the wellbore is formed.

The method also includes selecting a location within the wellbore for actuation of an actuatable tool. Again, the actuatable tool may be, for example a bridge plug, a cement plug, a fracturing plug, or a perforating gun.

The method further comprises downloading the first CCL log into a processor.

The processor and the actuatable tool together are part of a downhole tool. The method then includes deploying the downhole tool into the wellbore. The downhole tool traverses casing collars, and senses the casing collars using its own casing collar locator.

The processor in the downhole tool is programmed to continuously record magnetic signals as the downhole tool traverses the casing collars. In this way, a second CCL log is formed. The processor, or on-board controller, transforms the recorded magnetic signals of the second CCL log by applying a moving windowed statistical analysis. Further, the processor incrementally compares the transformed second CCL log with the first CCL log during deployment of the downhole tool to correlate values indicative of casing collar locations. This is preferably done through a pattern matching algorithm. The algorithm correlates individual peaks or even groups of peaks representing casing collar locations. In addition, the processor is programmed to recognize the selected location in the wellbore, and then send an activation signal to the actuatable wellbore device or tool when the processor has recognized the selected location.

The method further then includes sending an activation signal. Sending the activation signal actuates the actuatable tool. In this way, the downhole tool is autonomous, meaning that it is not electrically controlled from the surface for receiving the activation signal.

In one embodiment, the method further comprises transforming the CCL data set for the first CCL log. This also is done by applying a moving windowed statistical analysis. The first CCL log is downloaded into the processor as a first transformed CCL log. In this embodiment, the processor incrementally compares the second transformed CCL log with the first transformed CCL log to correlate values indicative of casing collar locations.

In the above embodiments, applying a moving windowed statistical analysis preferably comprises defining a pattern window size for sets of magnetic signal values, and then computing a moving mean m(t+1) for the magnetic signal values over time. The moving mean m(t+1) is preferably in vector form, and represents an exponentially weighted moving average for the magnetic signal values for the pattern windows. Applying a moving windowed statistical analysis then further comprises defining a memory parameter $\mu$ for the windowed statistical analysis, and calculating a moving covariance matrix $\Sigma(t+1)$ for the magnetic signal values over time.

Additional details for the tool-locating algorithm are disclosed in U.S. Provisional Pat. Appl. No. 61/424,285, referenced above. That related, co-pending application is incorporated by reference herein in its entirety.

Returning now to FIG. 1, the fracturing plug assembly 100' further includes an on-board controller 116. The on-board controller 116 processes the depth signals generated by the position locator 114. The processing may be in accordance with any of the methods disclosed in U.S. Ser. No. 61/424,285. In one aspect, the on-board controller 116 compares the generated signals with a pre-determined physical signature obtained for wellbore objects. For example, a CCL log may be run before deploying the autonomous tool (such as the fracturing plug assembly 100') in order to determine the spacing of the casing collars 154. The corresponding depths of the casing collars 154 may be determined based on the length and speed of the wireline pulling a CCL logging device as is well-known in the art.

In another aspect, the operator may have access to a wellbore diagram providing exact information concerning the spacing of downhole markers such as the casing collars 154. The on-board controller 116 may then be programmed to count the casing collars 154, thereby determining the location of the fracturing plug assembly 100' as it moves downwardly in the wellbore. In some instances, the production casing 150 may be pre-designed to have so-called short joints, that is, selected joints that are only, for example, 15 feet, or 20 feet, in length, as opposed to the "standard" length selected by the operator for completing a well, such as 30 feet. In this event, the on-board controller 116 may use the non-uniform spacing provided by the short joints as a means of checking or confirming a location in the wellbore as the fracturing plug assembly 100' moves through the production casing 150.

In yet another arrangement, the position locator 114 comprises an accelerometer. An accelerometer is a device that measures acceleration experienced during a freefall. An accelerometer may include multi-axis capability to detect magnitude and direction of the acceleration as a vector quantity. When in communication with analytical software, the accelerometer allows the position of an object to be determined. Preferably, the position locator would also include a gyroscope. The gyroscope would help maintain the orientation of the fracturing plug assembly 100' as it traverses the wellbore.

In any event, the on-board controller 116 further activates the actuatable tool when it determines that the autonomous tool has arrived at a particular depth adjacent a selected zone of interest. In the example of FIG. 1, the on-board controller 116 activates the fracturing plug 110" and the setting tool 112" to cause the fracturing plug assembly 100" to stop moving, and to set in the production casing 150 at a desired depth or location.

Figure 2:
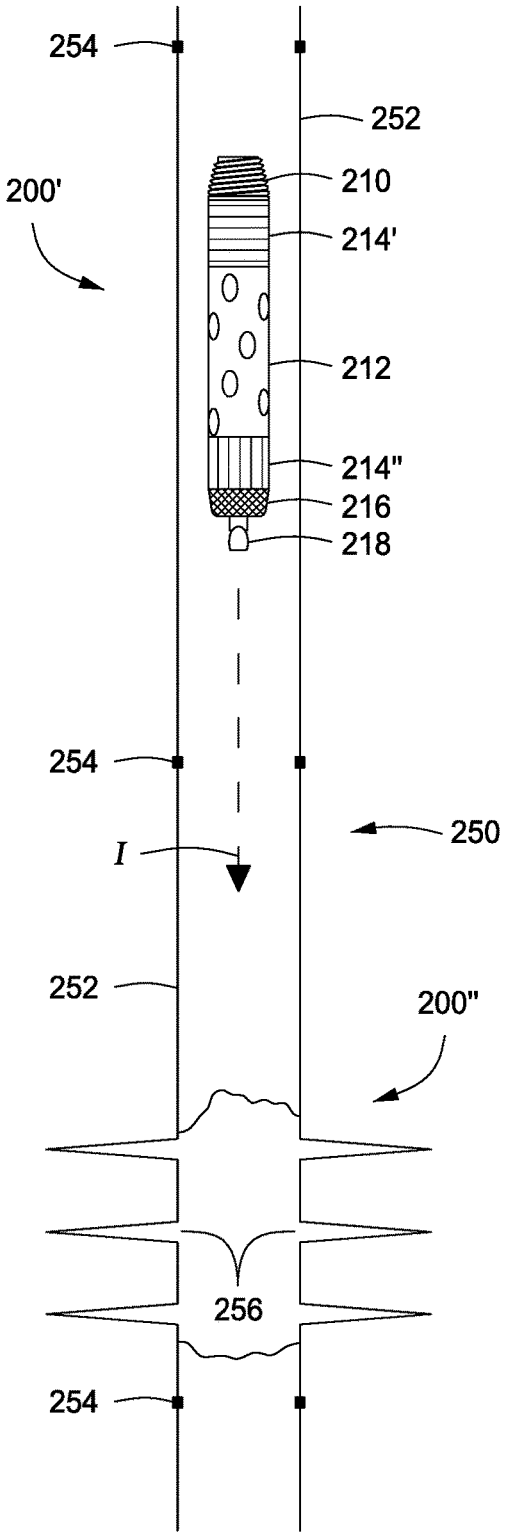
FIG. 2 is a side view of an autonomous tool as may be used for wellbore operations, in an alternate view. In this view, the tool is a perforating gun assembly. The perforating gun assembly is once again deployed in a string of production casing, and is shown in both a pre-actuated position and an actuated position.

Other arrangements for an autonomous tool besides the fracturing plug assembly 100'/100" may be used. FIG. 2 presents a side view of an alternative arrangement for an autonomous tool 200' as may be used for wellbore operations. In this view, the tool 200' is a perforating gun assembly.

In FIG. 2, the perforating gun assembly is shown in both a pre-actuated position and an actuated position. The perforating gun assembly is shown in a pre-actuated position at 200', and is shown in an actuated position at 200". Arrow "I" indicates the movement of the perforating gun assembly 200' in its pre-actuated (or run-in) position, down to a location in the wellbore where the perforating gun assembly 200" is in its actuated position 200". The perforating gun assembly will be described primarily with reference to its pre-actuated position, at 200', as the actuated position 200" means complete destruction of the assembly 200'.

The perforating gun assembly 200' is deployed within a string of production casing 250. The production casing 250 is formed from a plurality of "joints" 252 that are threadedly connected at collars 254. The wellbore completion includes the perforation of the production casing 250 at various selected intervals using the perforating gun assembly 200'. Utilization of the perforating gun assembly 200' is described more fully in connection with FIGS. 4A-4M and 5A-5I, below.

The perforating gun assembly 200' first optionally includes a fishing neck 210. The fishing neck 210 is dimensioned and configured to serve as the male portion to a mating downhole fishing tool (not shown). The fishing neck 210 allows the operator to retrieve the perforating gun assembly 200' in the unlikely event that it becomes stuck in the casing 252 or the charges fail to detonate.

The perforating gun assembly 200' also includes a perforating gun 212. The perforating gun 212 may be a select fire gun that fires, for example, 16 shots. The gun 212 has associated charges that detonate in order to cause shots to be fired from the gun 212 into the surrounding production casing 250. Typically, the perforating gun 212 contains a string of shaped charges (seen at 712 in FIG. 7) distributed along the length of the gun 212 and oriented according to desired specifications. The charges are preferably connected to a single detonating cord to ensure simultaneous detonation of all charges. Examples of suitable perforating guns include the Frac Gun™ from Schlumberger, and the G-Force® from Halliburton.

The perforating gun assembly 200' also includes a position locator 214'. The position locator 214' operates in the same manner as the position locator 114 for the fracturing plug assembly 100'. In this respect, the position locator 214' serves as a location device for sensing the location of the perforating gun assembly 200' within the production casing 250. More specifically, the position locator 214' senses the presence of objects or "downhole markers" along the wellbore 250, and generates depth signals in response.

In the view of FIG. 2, the downhole markers are again the casing collars 254. This means that the position locator 214' is a casing collar locator, or "CCL." The CCL senses the location of the casing collars 254 as it moves down the wellbore. Of course, it is again understood that other sensing arrangements may be employed in the perforating gun assembly 200', such as the use of "RFID" devices.

The perforating gun assembly 200' further includes an on-board controller 216. The on-board controller 216 preferably operates in the same manner as the on-board controller 116 for the fracturing plug assembly 100'. In this respect, the on-board controller 216 processes the depth signals generated by the position locator 214' using appropriate logic and power units. In one aspect, the on-board controller 216 compares the generated signals with a predetermined physical signature obtained for the wellbore objects (such as collars 254). For example, a CCL log may be run before deploying the autonomous tool (such as the perforating gun assembly 200') in order to determine the spacing of the casing collars 254. The corresponding depths of the casing collars 254 may be determined based on the speed of the wireline that pulled the CCL logging device.

It is preferred that the position locator 214' and the on-board controller 216 operate with software in accordance with the locating algorithm discussed above. Specifically, the algorithm preferably employs a windowed statistical analysis for interpreting and converting magnetic signals generated by the casing collar locator.

The on-board controller 216 activates the actuatable tool when it determines that the autonomous tool 200' has arrived at a particular depth adjacent a selected zone of interest. This is done using appropriate onboard processing. In the example of FIG. 2, the on-board controller 216 activates a detonating cord that ignites the charge associated with the perforating gun 210 to initiate the perforation of the production casing 150 at a desired depth or location. Illustrative perforations are shown in FIG. 2 at 256.

In addition, the on-board controller 216 generates a separate signal to ignite the detonating cord to cause complete destruction of the perforating gun assembly. This is shown at 200". To accomplish this, the components of the gun assembly 200' are fabricated from a friable material. The perforating gun 212 may be fabricated, for example, from ceramic materials. Upon detonation, the material making up the perforating gun assembly 200' may become part of the proppant mixture injected into fractures in a later completion stage.

In one aspect, the perforating gun assembly 200' also includes a ball sealer carrier 218. The ball sealer carrier 218 is preferably placed at the bottom of the assembly 200'. Destruction of the assembly 200' causes ball sealers (shown at 632 in FIG. 6F) to be released from the ball sealer carrier 218. Alternatively, the on-board controller 216 may have a timer that releases the ball sealers from the ball sealer carrier 218 shortly before the perforating gun 212 is fired, or simultaneously therewith. As will be described more fully below, the ball sealers are used to seal perforations that have been formed at a lower depth or location in the wellbore.

It is desirable with the perforating gun assembly 200' to provide various safety features that prevent the premature firing of the perforating gun 212. These are in addition to the locator device 214' described above. Preferably, the assembly 200' utilizes at least two, and preferably at least three, safety gates or "barriers" that must be satisfied before the perforating gun 212 may be "armed."

One safety check may be a vertical position indicator. This means that the on-board controller 216 will not provide a signal to the select gun 212 to fire until the vertical position indicator confirms that the perforating gun assembly 200' is oriented in a substantially vertical orientation, e.g., within five degrees of vertical. For example, the vertical position indicator may be a mercury tube that is in electrical communication with the on-board controller 216. Of course, this safety feature only works where the wellbore is being perforated along a substantially vertical zone of interest.

Where the wellbore is being perforated along a substantially horizontal zone of interest, the safety check may be a horizontal position indicator.

Another safety check may be a pressure sensor or a rupture disc in electrical communication with the on-board controller 216. Those of ordinary skill in the art will understand that as the assembly 200' moves down the wellbore, it will experience an increased hydrostatic head. Pressure from the hydrostatic head may be enhanced by using pumps at the surface (not shown) for pumping the perforating gun assembly 200' downhole. Thus, for example, the pressure sensor may not send (or permit) a signal from the on-board controller 216 to the perforating gun 212 until pressure exceeds, for example, 4,000 psi.

A third safety check that may be utilized involves a velocity calculation. In this instance, the perforating gun assembly 200' may include a second locator device 214" spaced some distance below the original locator device 214'. As the assembly 200' travels across casing collars 254, signals generated by the second and the original locator devices are timed. The velocity of the assembly 200' is determined by the following equation:

$$D/(T_2-T_0)$$

Where: $T_0$=Time stamp of the detected signal from the original locator device;

$T_2$=Time stamp of the detected signal from a second locator device; and

D=Distance between the original and second locator devices.

Use of such a velocity calculation ensures both a depth and the present movement of the perforating gun assembly 200 before the firing sequence can be initiated.

Still a fourth safety check that may be utilized involves a timer. In this arrangement, the perforating gun assembly 200' may include a button or other user interface that allows an operator to manually "arm" the perforating gun 212. The user interface is in electrical communication with a timer within the on-board controller 216. For example, the timer might be 2 minutes. This means that the perforating gun 212 cannot fire for 2 minutes from the time of arming.

Yet a fifth safety check that may be employed involves the use of low-life batteries. For example, the perforating gun assembly 200' may be powered with batteries, but the batteries are not installed until shortly before the assembly 200 is dropped into a wellbore. This helps to ensure safety during transportation of the tool. In addition, the batteries may have an effective life of, for example, only 60 minutes. This ensures that the assembly's energy potential is lost at a predictable time in the event that the assembly 200' needs to be pulled.

Figure 7:
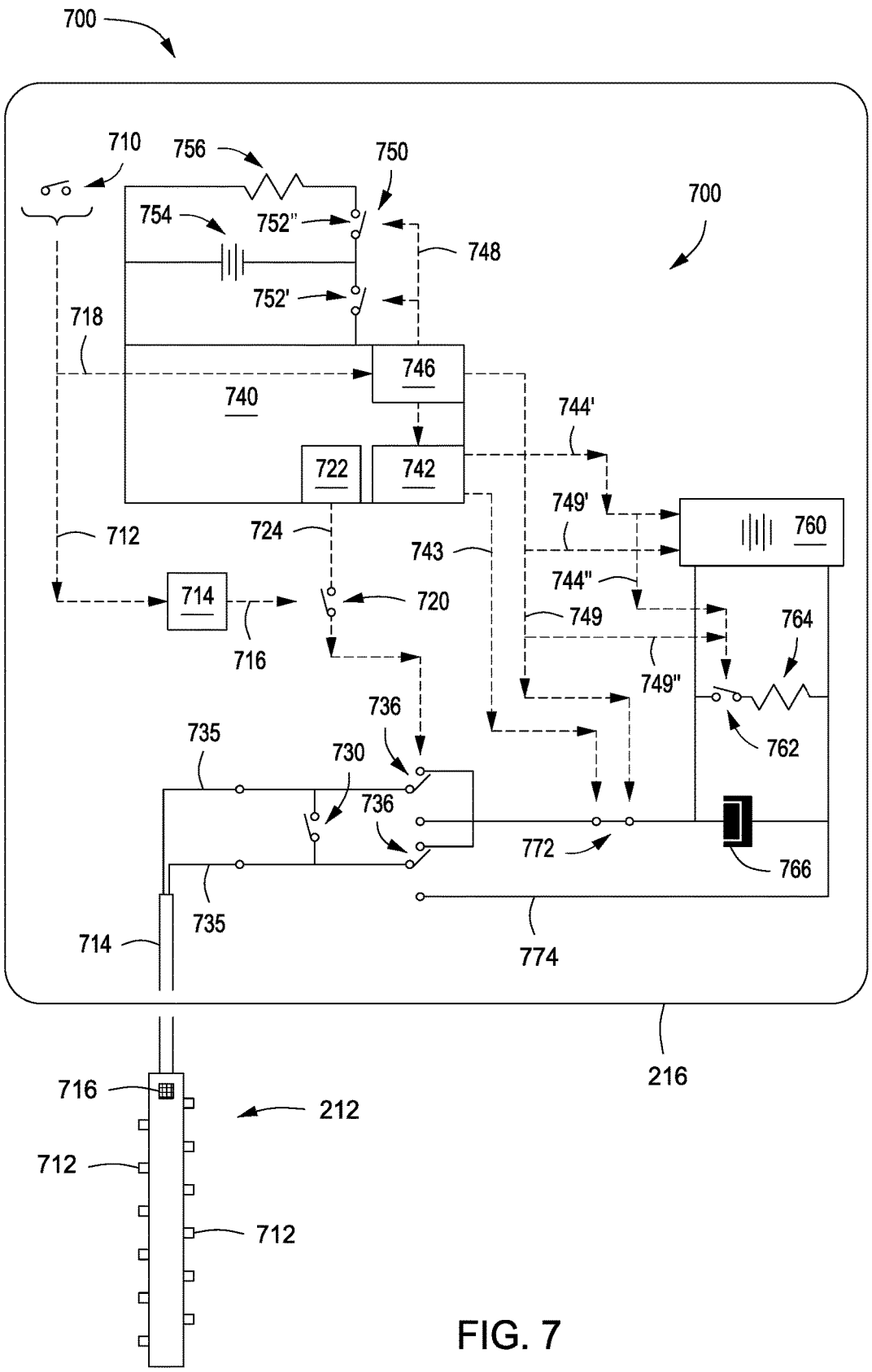
FIG. 7 schematically illustrates a multi-gated safety system for an autonomous wellbore tool, in one embodiment.

The on-board controller 216 and the safety checks for the perforating gun are part of a safety system. Additional details concerning a safety system are shown in FIG. 7, and are discussed further below.

FIGS. 1 and 2 present separate downhole tools representing a fracturing plug assembly 100' and a perforating gun assembly 200'. However, a combination of a fracturing plug and a perforating gun may be deployed together as an autonomous unit. Such a combination adds further optimization of equipment utilization. In this combination, the plug is set, then the perforating gun fires directly above the plug.

Figure 3A:
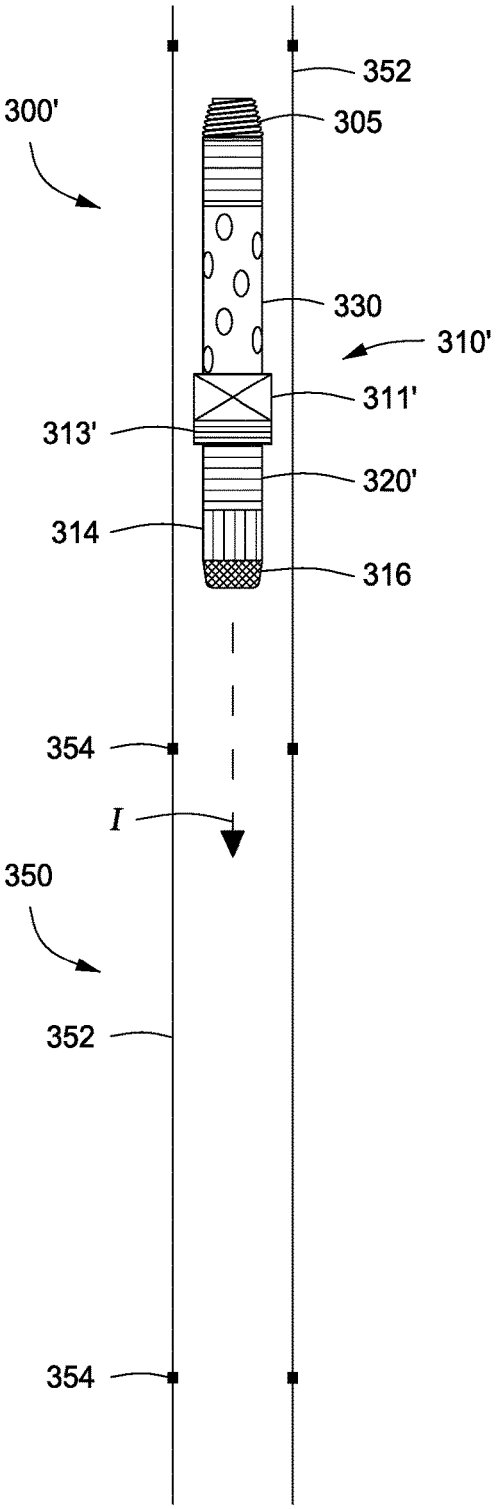
FIGS. 3A and 3B present side views of a lower portion of a wellbore receiving an integrated tool assembly for performing a wellbore operation. The integrated tool has both a fracturing plug and a perforating gun.
Figure 3B:
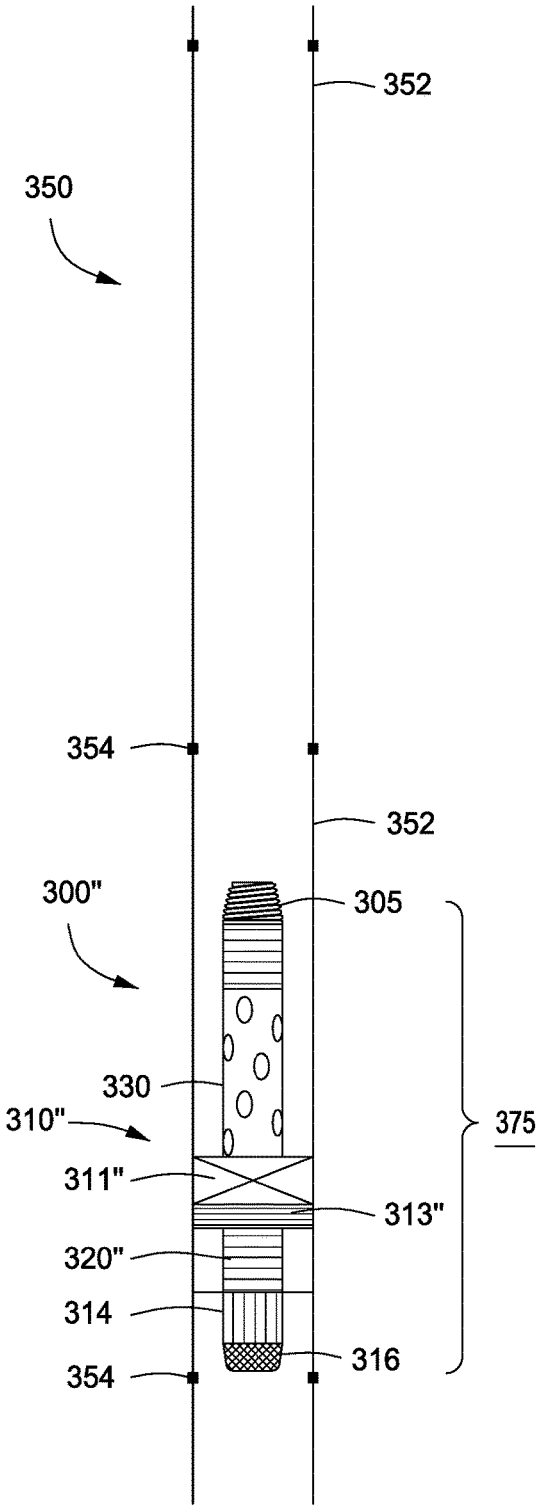

FIGS. 3A and 3B demonstrate such an arrangement. First, FIG. 3A provides a side view of a lower portion of a wellbore 350. The illustrative wellbore 350 is being completed in a single zone. A string of production casing is shown schematically at 352. An autonomous tool 300' has been dropped down the wellbore 350 through the production casing 352. Arrow "I" indicates the movement of the tool 300' traveling downward through the wellbore 350.

The autonomous tool 300' represents a combined plug and perforating gun. This means that the single tool 300' comprises components from both the plug assembly 100' and the perforating gun assembly 200' of FIGS. 1 and 2, respectively.

First, the autonomous tool 300' includes a plug body 310'. The plug body 310' will preferably define an elastomeric sealing element 311' and a set of slips 313'. The autonomous tool 300' also includes a setting tool 320'. The setting tool 320' will actuate the sealing element 311' and the slips 313', and translate them radially to contact the casing 352.

In the view of FIG. 3A, the plug body 310' has not been actuated. Thus, the tool 300' is in a run-in position. In operation, the sealing element 311' of the plug body 310' may be mechanically expanded in response to a shift in a sleeve or other means as is known in the art. This allows the sealing element 311' to provide a fluid seal against the casing 352. At the same time, the slips 313' of the plug body 310' ride outwardly from the assembly 300' along wedges (not shown) spaced radially around the assembly 300'. This allows the slips 313' to extend radially and "bite" into the casing 352, securing the tool assembly 300' in position against downward hydraulic force.

The autonomous tool 300' also includes a position locator 314. The position locator 314 serves as a location device for sensing the location of the tool 300' within the production casing 350. More specifically, the position locator 314 senses the presence of objects or "tags" along the wellbore 350, and generates depth signals in response. In the view of FIG. 3A, the objects are casing collars 354. This means that the position locator 314 is a casing collar locator, or "CCL." The CCL senses the location of the casing collars 354 as it moves down the wellbore 350.

As with the plug assembly 100' described above in FIG. 1, the position locator 314 may sense other objects besides casing collars. Alternatively, the position locator 314 may be programmed to locate a selected depth using an accelerometer.

The tool 300' also includes a perforating gun 330. The perforating gun 330 may be a select fire gun that fires, for example, 16 shots. As with perforating gun 212 of FIG. 2, the gun 330 has associated charges that detonate in order to cause shots to be fired into the surrounding production casing 350. Typically, the perforating gun 330 contains a string of shaped charges distributed along the length of the gun and oriented according to desired specifications.

The autonomous tool 300' optionally also includes a fishing neck 305. The fishing neck 305 is dimensioned and configured to serve as the male portion to a mating downhole fishing tool (not shown). The fishing neck 305 allows the operator to retrieve the autonomous tool 300 in the unlikely event that it becomes stuck in the wellbore 300' or the perforating gun 330 fails to detonate. It is understood that other retrieval arrangements may be provided, such as a retrieval hook (not shown).

The autonomous tool 300' further includes an on-board controller 316. The on-board controller 316 processes the depth signals generated by the position locator 314. In one aspect, the on-board controller 316 compares the generated signals with a pre-run CCL log. The depths of the casing collars 354 may be determined based on the length and speed of the wireline pulling a CCL logging device.

Upon determining that the autonomous tool 300' has arrived at the selected depth, the on-board controller 316 activates the setting tool 320. This causes the plug body 310 to be set in the wellbore 350 at a desired depth or location.

FIG. 3B is a side view of the wellbore of FIG. 3A. Here, the autonomous tool 300" has reached a selected depth. The selected depth is indicated at bracket 375. The on-board controller 316 has sent a signal to the setting tool 320" to actuate the elastomeric ring 311" and slips 313" of the plug body 310'.

In FIG. 3B, the plug body 310" is shown in an expanded state. In this respect, the elastomeric sealing element 311" is expanded into sealed engagement with the surrounding production casing 352, and the slips 313" are expanded into mechanical engagement with the surrounding production casing 352. The sealing element 311" offers a sealing ring, while the slips 313" offer grooves or teeth that "bite" into the inner diameter of the casing 350.

After the autonomous tool 300" has been set, the on-board controller 316 sends a separate signal to ignite charges in the perforating gun 330. The perforating gun 330 creates perforations through the production casing 352 at the selected depth 375. Thus, in the arrangement of FIGS. 3A and 3B, the setting tool 320 and the perforating gun 330 together define an integrated actuatable tool.

Figure 4A:
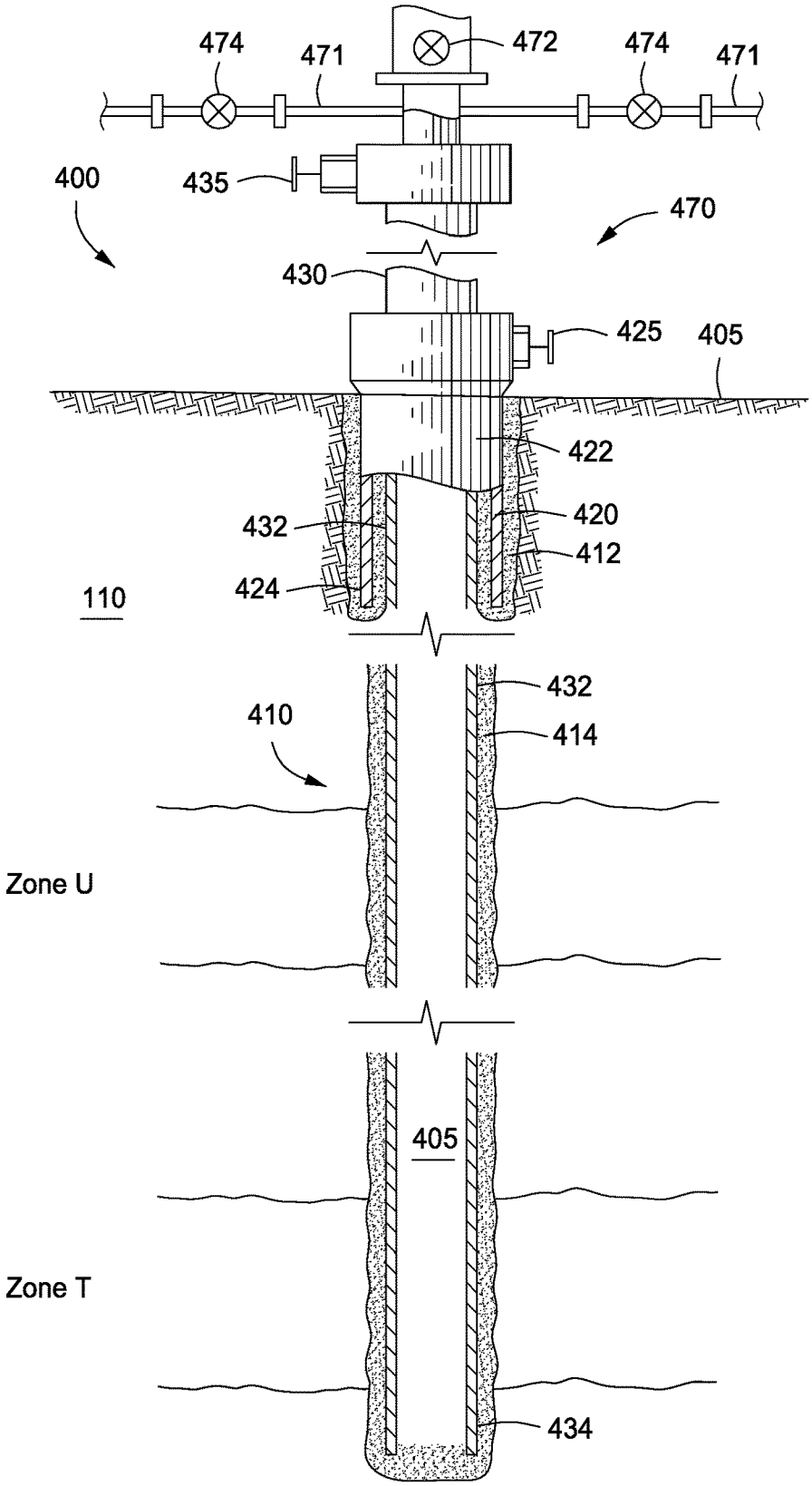
FIG. 4A is a side view of a well site having a wellbore for receiving an autonomous tool. The wellbore is being completed in at least zones of interest "T" and "U."

FIGS. 4A through 4M demonstrate the use of the fracturing plug assembly 100' and the perforating gun assembly 200' in an illustrative wellbore. First, FIG. 4A presents a side view of a well site 400. The well site 400 includes a wellhead 470 and a wellbore 410. The wellbore 410 includes a bore 405 for receiving the assemblies 100', 200'. The bore 405 extends from the surface 105 of the earth, and into the earth's subsurface 110. The wellbore 410 is being completed in at least zones of interest "T" and "U" within the subsurface 110.

The wellbore 410 is first formed with a string of surface casing 420. The surface casing 420 has an upper end 422 in sealed connection with a lower master fracture valve 425. The surface casing 420 also has a lower end 424. The surface casing 420 is secured in the wellbore 410 with a surrounding cement sheath 412.

The wellbore 410 also includes a string of production casing 430. The production casing 430 is also secured in the wellbore 410 with a surrounding cement sheath 414. The production casing 430 has an upper end 432 in sealed connection with an upper master fracture valve 435. The production casing 430 also has a lower end 434 proximate a bottom of the wellbore 410. It is understood that the depth of the wellbore 410 extends many thousands of feet below the earth surface 105.

The production casing 430 extends through the lowest zone of interest "T," and also through at least one zone of interest "U" above the zone "T." A wellbore operation will be conducted that includes perforating each of zones "T" and "U" sequentially.

During the completion phase, the wellhead 470 will also include one or more blow-out preventers. The blow-out preventers are typically remotely actuated in the event of operational upsets. In more shallow wells, or in wells having lower formation pressures, the master fracture valves 425, 435 may be the blow-out preventers. In either event, the master fracture valves 425, 435 are used to selectively seal the wellbore 410. The wellhead 470 and its components are used for flow control and hydraulic isolation during rig-up operations, stimulation operations, and rig-down operations.

The wellhead 470 may include a crown valve 472. The crown valve 472 is used to isolate the wellbore 400 in the event a lubricator (not shown) or other components are placed above the wellhead 470. The wellhead 470 further includes side outlet injection valves 474. The side outlet injection valves 474 are located within fluid injection lines 471. The fluid injection lines provide a location for injection of fracturing fluids, weighting fluids, and/or stimulation fluids into the bore 405, with the injection of the fluids being controlled by the valves 474. The piping from surface pumps (not shown) and tanks (not shown) used for injection of the stimulation (or other) fluids are attached to the valves 474 using appropriate hoses, fittings and/or couplings. The stimulation fluids are then pumped into the production casing 430.

It is understood that the various wellhead components shown in FIG. 4A are merely illustrative. A typical completion operation will include numerous valves, pipes, tanks, fittings, couplings, gauges, and other devices. These may include pressure-equalization line and a pressure-equalization valve (not shown) for positioning a tool string above the lower valve 425 before the tool string is dropped into the wellbore 405. Downhole equipment may be run into and out of the wellbore 410 using an electric line, slick line or coiled tubing. Further, a drilling rig or other platform may be employed, with jointed working tubes being used.

Figure 4B:
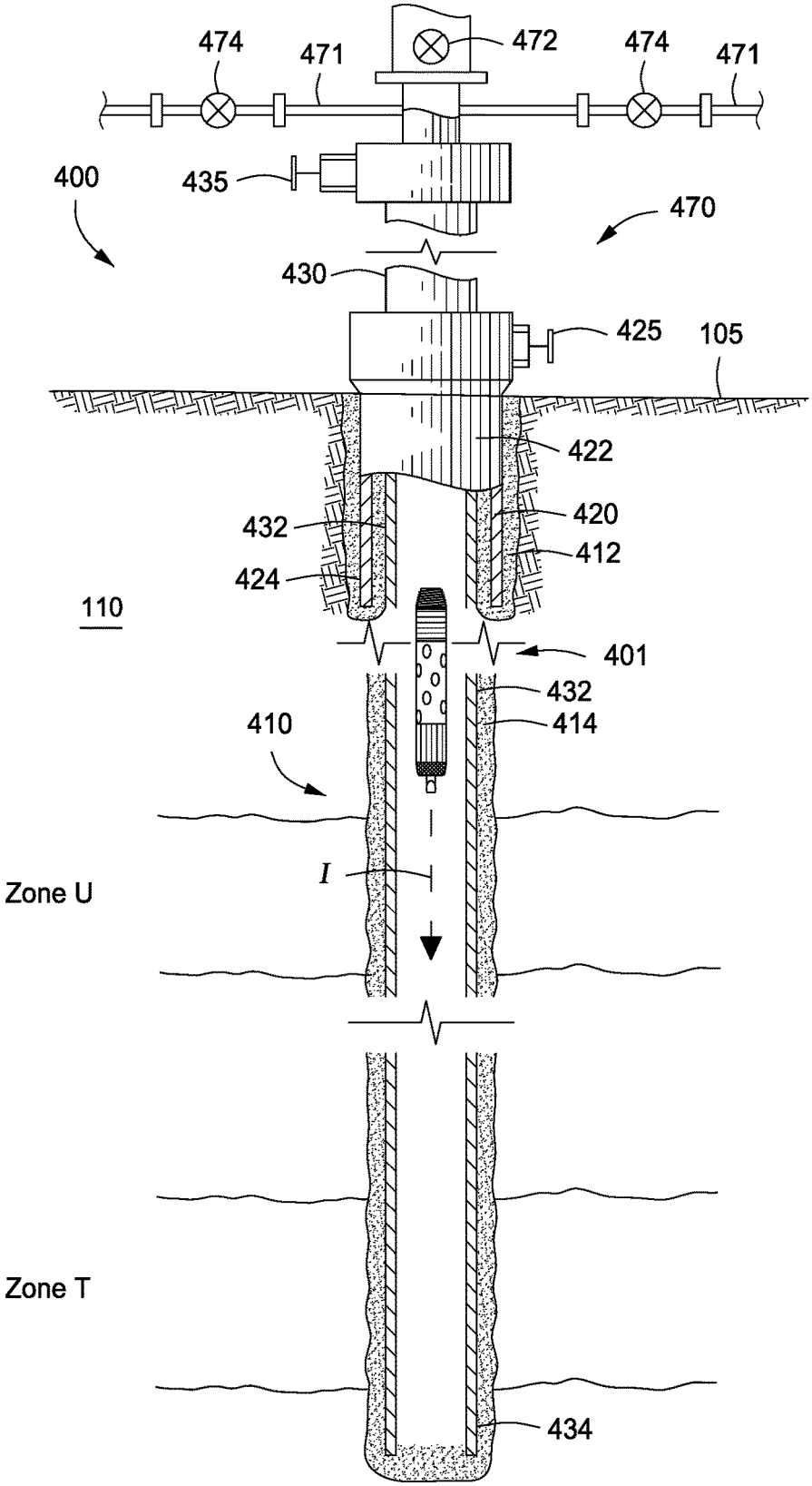
FIG. 4B is a side view of the well site of FIG. 4A. Here, the wellbore has received a first perforating gun assembly, in one embodiment.

FIG. 4B is a side view of the well site 400 of FIG. 4A. Here, the wellbore 410 has received a first perforating gun assembly 401. The first perforating gun assembly 401 is generally in accordance with the perforating gun assembly 200' of FIG. 2 in its various embodiments, as described above. It can be seen that the perforating gun assembly 401 is moving downwardly in the wellbore 410, as indicated by arrow "I." The perforating gun assembly 401 may be simply falling through the wellbore 410 in response to gravitational pull. In addition, the operator may be assisting the downward movement of the perforating gun assembly 401 by applying hydraulic pressure through the use of surface pumps (not shown). Alternatively, the perforating gun assembly 401 may be aided in its downward movement through the use of a tractor (not shown). In this instance, the tractor will be fabricated entirely of a friable material.

Figure 4C:
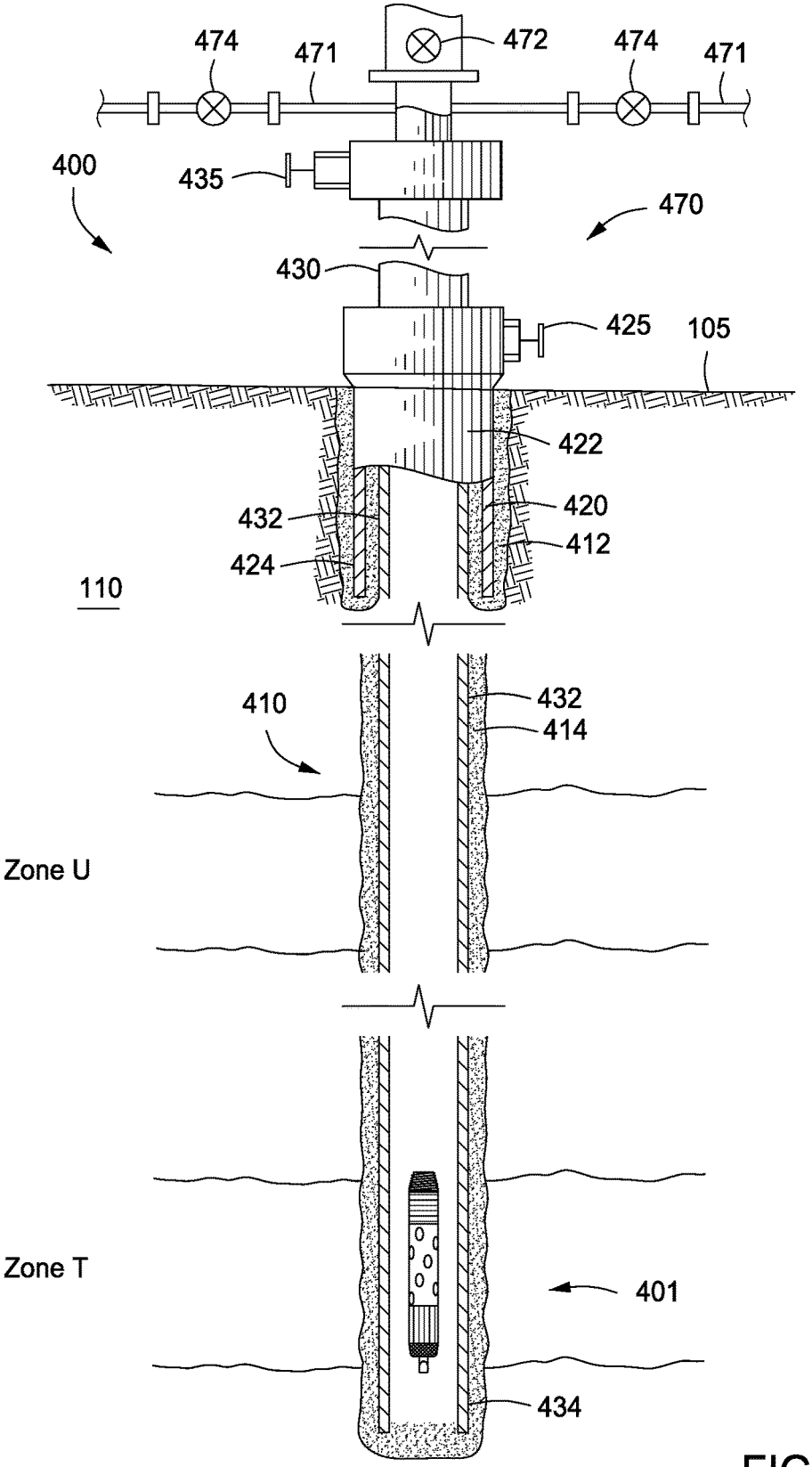
FIG. 4C is another side view of the well site of FIG. 4A. Here, the first perforating gun assembly has fallen in the wellbore to a position adjacent zone of interest "T."

FIG. 4C is another side view of the well site 400 of FIG. 4A. Here, the first perforating gun assembly 401 has fallen in the wellbore 410 to a position adjacent zone of interest "T." In accordance with the present inventions, the locator device (shown at 114 in FIG. 1) has generated signals in response to tags placed along the production casing 430. In this way, the on-board controller (shown at 116 of FIG. 1) is aware of the location of the first perforating gun assembly 401.

Figure 4D:
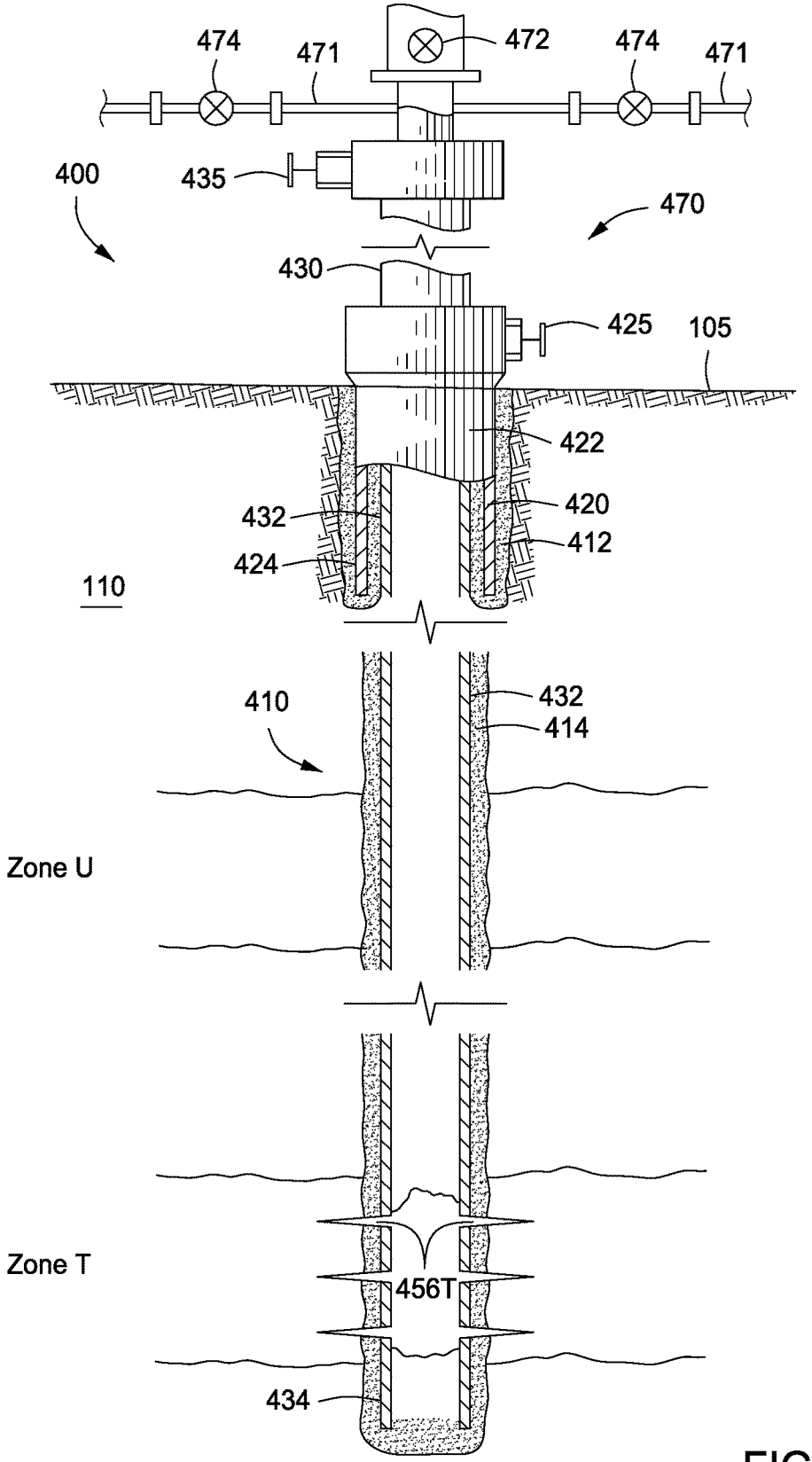
FIG. 4D is another side view of the well site of FIG. 4A. Here, charges of the first perforating gun assembly have been detonated, causing the perforating gun of the perforating gun assembly to fire. The casing along the zone of interest "T" has been perforated.

FIG. 4D is another side view of the well site 400 of FIG. 4A. Here, charges of the perforating gun assembly 401 have been detonated, causing the perforating gun (shown at 212 of FIG. 2) to fire. The casing along zone of interest "T" has been perforated. A set of perforations 456T is shown extending from the wellbore 410 and into the subsurface 110. While only six perforations 456T are shown in the side view, it us understood that additional perforations may be formed, and that such perforations will extend radially around the production casing 430.

In addition to the creation of perforations 456T, the perforating gun assembly 401 is self-destructed. Any pieces left from the assembly 401 will likely fall to the bottom 434 of the production casing 430.

Figure 4E:
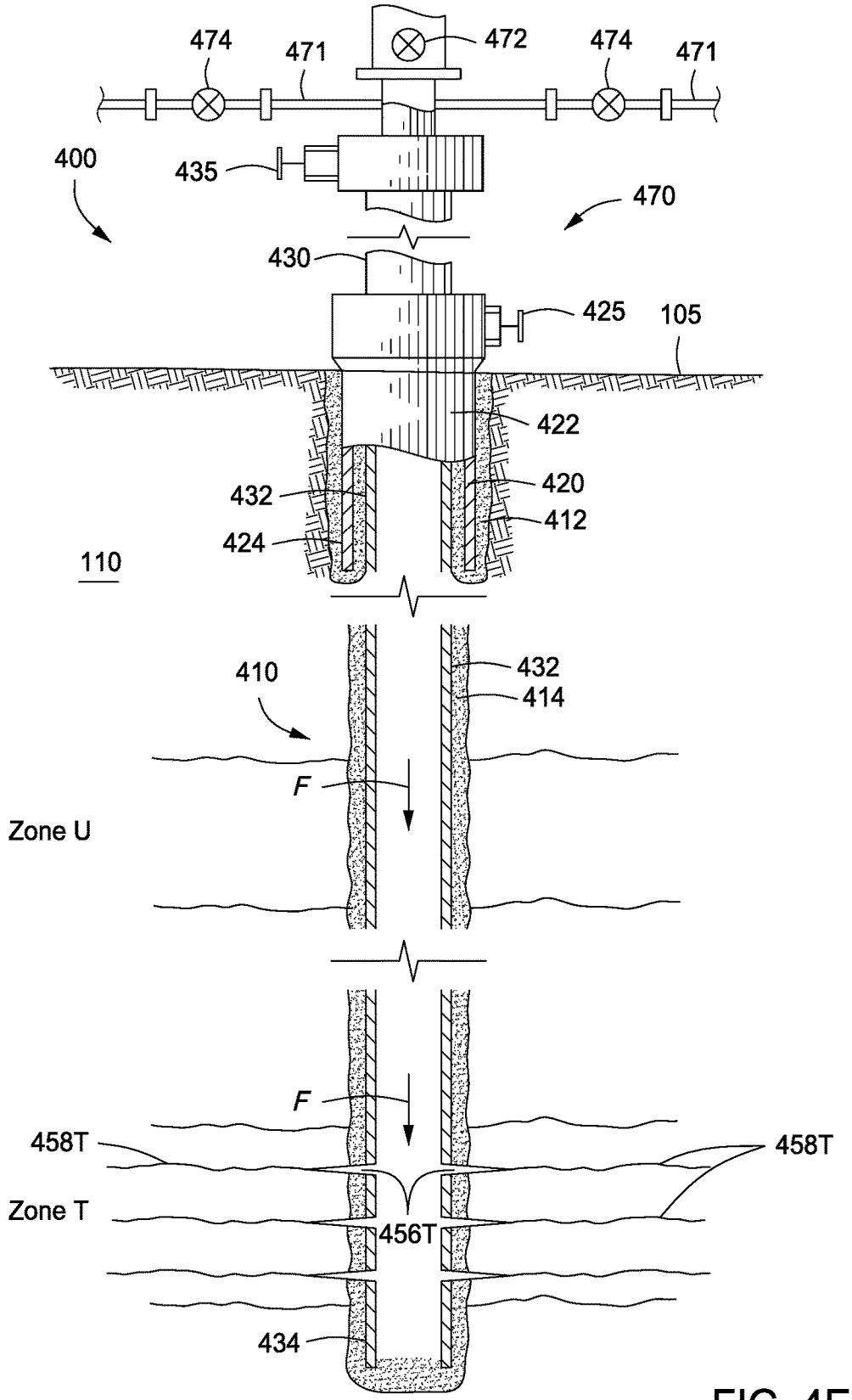
FIG. 4E is yet another side view of the well site of FIG. 4A. Here, fluid is being injected into the wellbore under high pressure, causing the formation within the zone of interest "T" to be fractured.

FIG. 4E is yet another side view of the well site 400 of FIG. 4A. Here, fluid is being injected into the bore 405 of the wellbore 410 under high pressure. Downward movement of the fluid is indicated by arrows "F." The fluid moves through the perforations 456T and into the surrounding subsurface 110. This causes fractures 458T to be formed within the zone of interest "T." An acid solution may also optionally be circulated into the bore 405 to remove carbonate build-up and remaining drilling mud and further stimulate the subsurface 110 for hydrocarbon production.

Figure 4F:
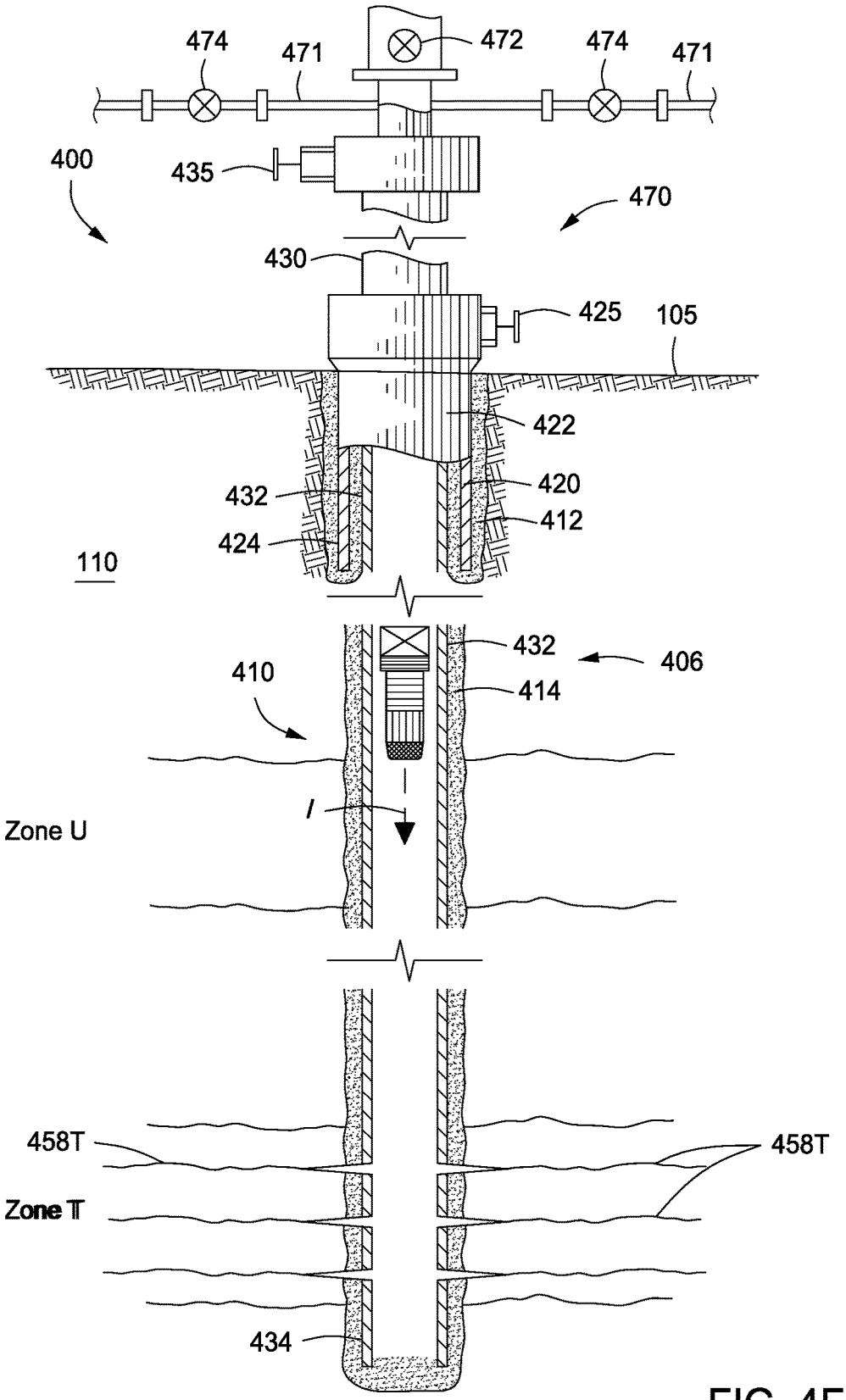
FIG. 4F is another side view of the well site of FIG. 4A. Here, the wellbore has received a fracturing plug assembly, in one embodiment.

FIG. 4F is yet another side view of the well site 400 of FIG. 4A. Here, the wellbore 410 has received a fracturing plug assembly 406. The fracturing plug assembly 406 is generally in accordance with the fracturing plug assembly 100' of FIG. 1 in its various embodiments, as described above.

In FIG. 4F, the fracturing plug assembly 406 is in its run-in (pre-actuated) position. The fracturing plug assembly 406 is moving downwardly in the wellbore 410, as indicated by arrow "I." The fracturing plug assembly 406 may simply be falling through the wellbore 410 in response to gravitational pull. In addition, the operator may be assisting the downward movement of the fracturing plug assembly 406 by applying pressure through the use of surface pumps (not shown).

Figure 4G:
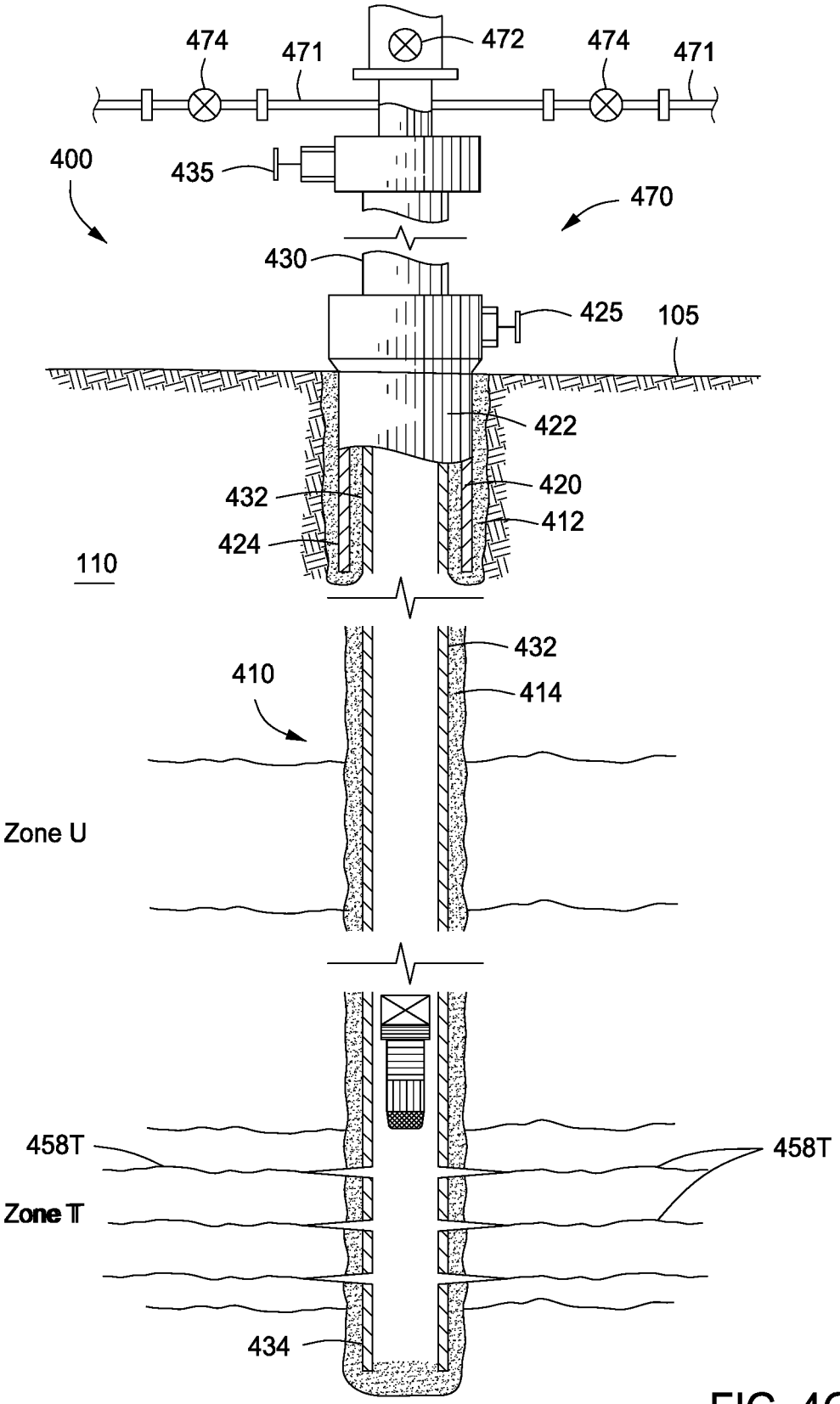
FIG. 4G is still another side view of the well site of FIG. 4A. Here, the fracturing plug assembly has fallen in the wellbore to a position above the zone of interest "T."

FIG. 4G is still another side view of the well site 400 of FIG. 4A. Here, the fracturing plug assembly 406 has fallen in the wellbore 410 to a position above the zone of interest "T." In accordance with the present inventions, the locator device (shown at 114 in FIG. 1) has generated signals in response to downhole markers placed along the production casing 430. In this way, the on-board controller (shown at 116 of FIG. 1) is aware of the location of the fracturing plug assembly 406.

Figure 4H:
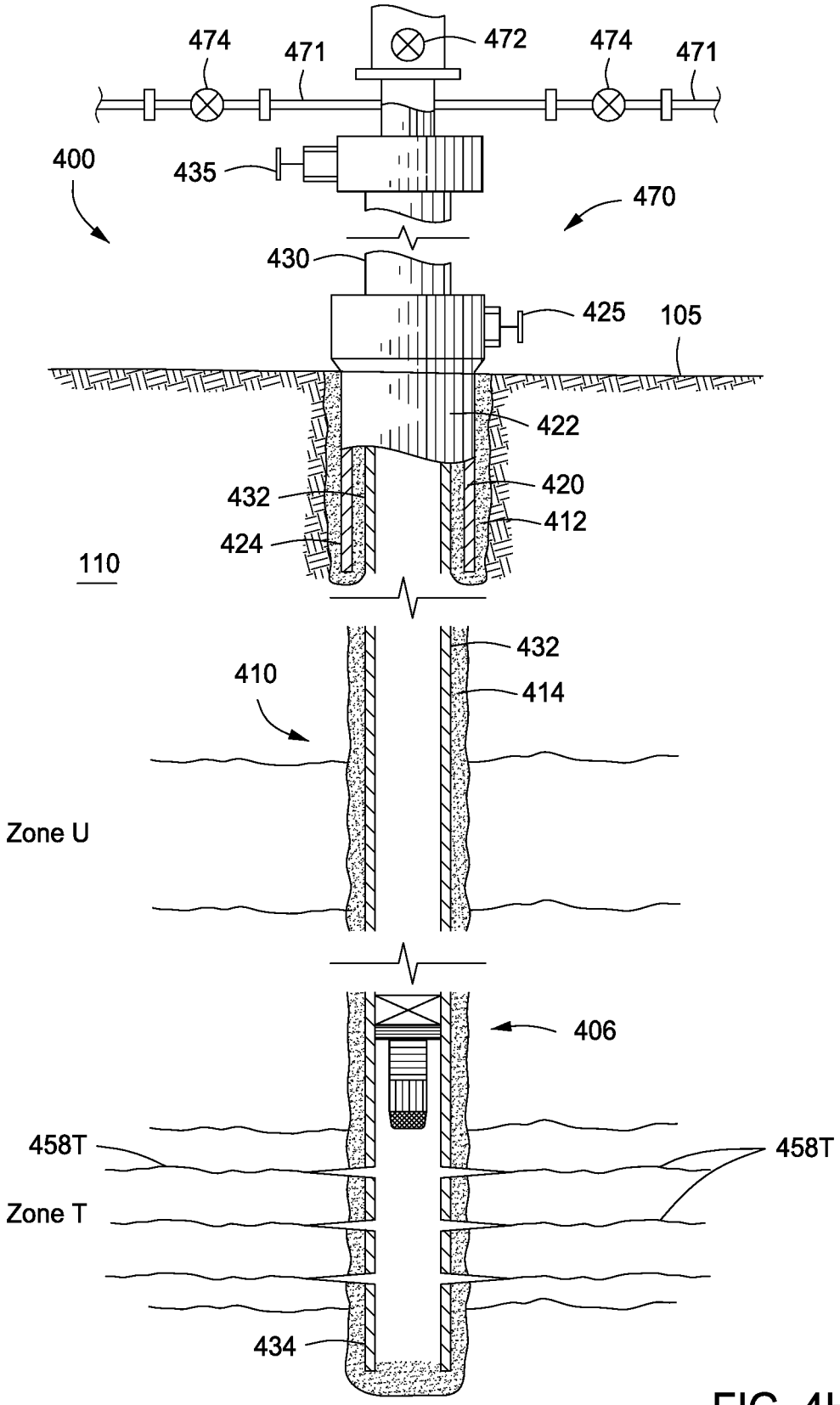
FIG. 4H is another side view of the well site of FIG. 4A. Here, the fracturing plug assembly has been actuated and set. Of interest, no wireline is needed for setting the plug assembly.

FIG. 4H is another side view of the well site 400 of FIG. 4A. Here, the fracturing plug assembly 406 has been set. This means that the on-board controller 116 has generated signals to activate the setting tool (shown at 112 of FIG. 1) and the plug (shown at 110' of FIG. 2) and the slips (shown at 113') to set and to seal the plug assembly 406 in the bore 405 of the wellbore 410. In FIG. 4H, the fracturing plug assembly 406 has been set above the zone of interest "T." This allows isolation of the zone of interest "U" for a next perforating stage.

Figure 4I:
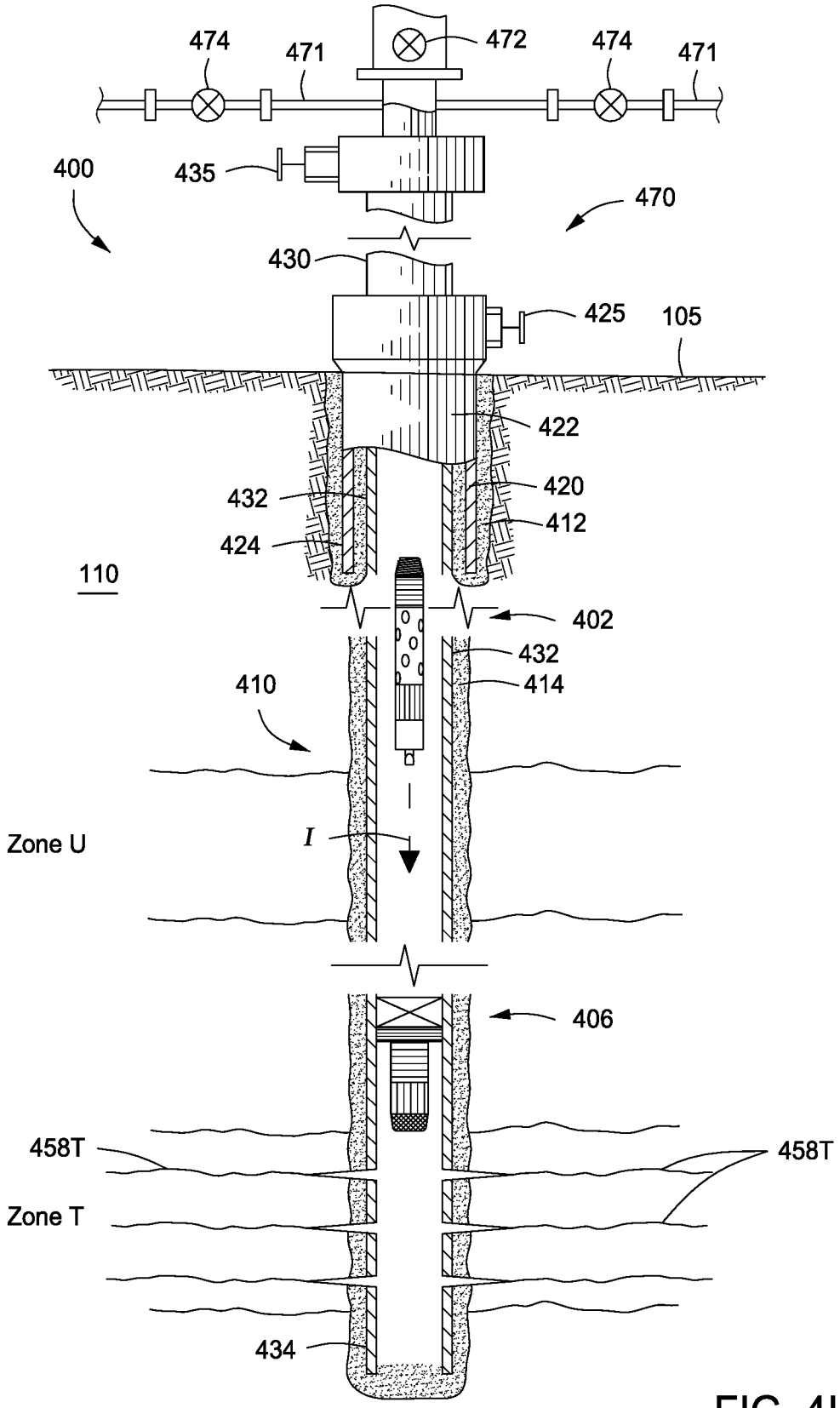
FIG. 4I is yet another side view of the well site of FIG. 4A. Here, the wellbore has received a second perforating gun assembly.

FIG. 4I is another side view of the well site 400 of FIG. 4A. Here, the wellbore 410 has received a second perforating gun assembly 402. The second perforating gun assembly 402 may be constructed and arranged as the first perforating gun assembly 401. This means that the second perforating gun assembly 402 is also autonomous.

It can be seen in FIG. 4I that the second perforating gun assembly 402 is moving downwardly in the wellbore 410, as indicated by arrow "I." The second perforating gun assembly 402 may be simply falling through the wellbore 410 in response to gravitational pull. In addition, the operator may be assisting the downward movement of the perforating gun assembly 402 by applying pressure through the use of surface pumps (not shown). Alternatively, the perforating gun assembly 402 may be aided in its downward movement through the use of a tractor (not shown).

It can also be seen in FIG. 4I that the fracturing plug assembly 406 remains set in the wellbore 410. The fracturing plug assembly 406 is positioned above the perforations 456T and the fractures 458T in the zone of interest "T." Thus, the perforations 456T are isolated.

Figure 4J:
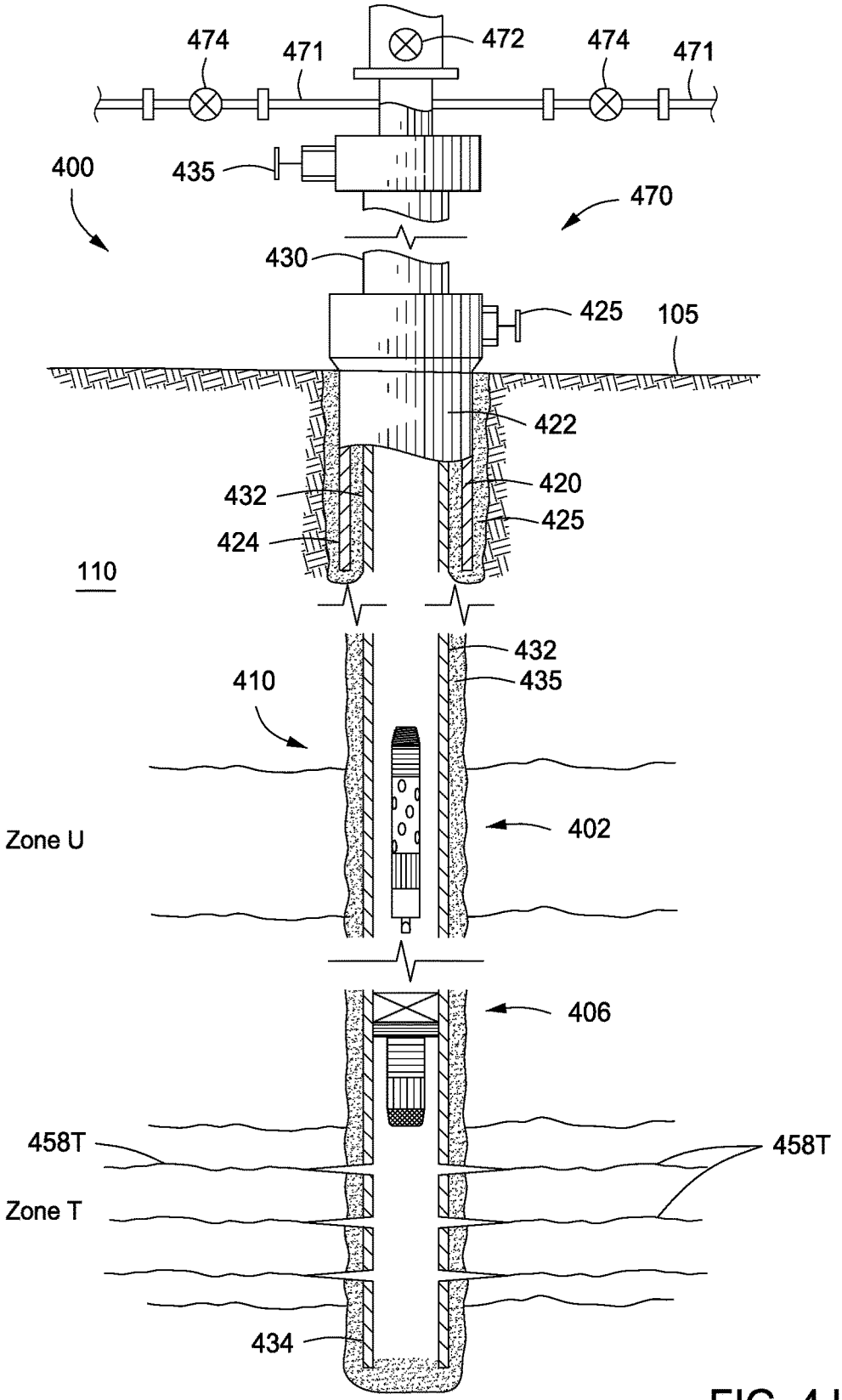
FIG. 4J is another side view of the well site of FIG. 4A. Here, the second perforating gun assembly has fallen in the wellbore to a position adjacent zone of interest "U." Zone of interest "U" is above zone of interest "T."

FIG. 4J is another side view of the well site 400 of FIG. 4A. Here, the second perforating gun assembly 402 has fallen in the wellbore to a position adjacent zone of interest "U." Zone of interest "U" is above zone of interest "T." In accordance with the present inventions, the locator device (shown at 114 in FIG. 1) has generated signals in response to downhole markers placed along the production casing 430. In this way, the on-board controller (shown at 116 of FIG. 1) is aware of the location of the first perforating gun assembly 401.

Figure 4K:
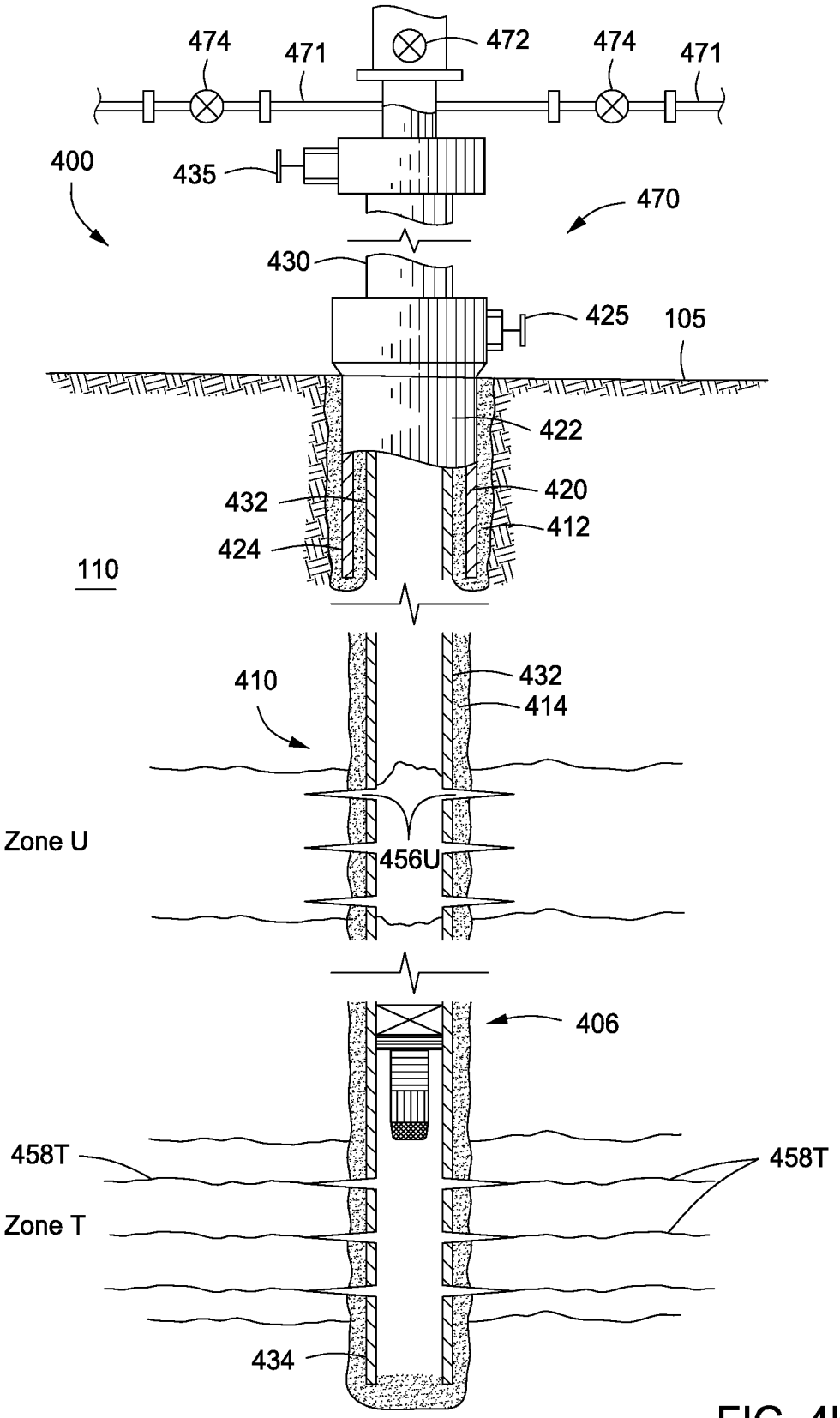
FIG. 4K is another side view of the well site of FIG. 4A. Here, charges of the second perforating gun assembly have been detonated, causing the perforating gun of the perforating gun assembly to fire. The casing along the zone of interest "U" has been perforated.

FIG. 4K is another side view of the well site 400 of FIG. 4A. Here, charges of the second perforating gun assembly 402 have been detonated, causing the perforating gun of the perforating gun assembly to fire. The zone of interest "U" has been perforated. A set of perforations 456U is shown extending from the wellbore 410 and into the subsurface 110. While only six perforations 456U are shown in side view, it us understood that additional perforations are formed, and that such perforations will extend radially around the production casing 430.

In addition to the creation of perforations 456U, the second perforating gun assembly 402 is self-destructed. Any pieces left from the assembly 402 will likely fall to the plug assembly 406 still set in the production casing 430.

Figure 4L:
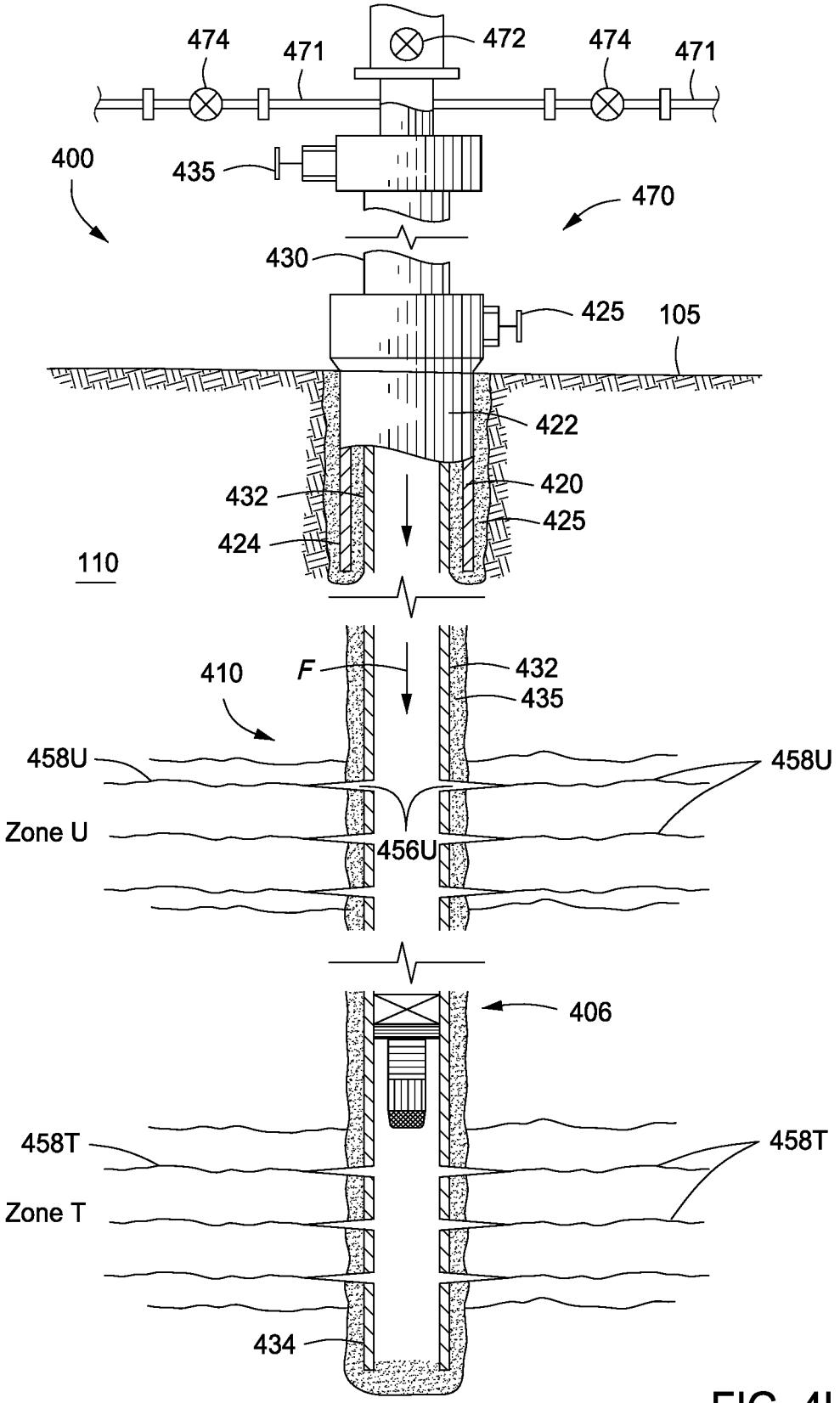
FIG. 4L is still another side view of the well site of FIG. 4A. Here, fluid is being injected into the wellbore under high pressure, causing the formation within the zone of interest "U" to be fractured.

FIG. 4L is yet another side view of the well site 400 of FIG. 4A. Here, fluid is being injected into the bore 405 of the wellbore 410 under high pressure. The fluid injection causes the subsurface 110 within the zone of interest "U" to be fractured. Downward movement of the fluid is indicated by arrows "F." The fluid moves through the perforations 456U and into the surrounding subsurface 110. This causes fractures 458U to be formed within the zone of interest "U." An acid solution may also optionally be circulated into the bore 405 to remove carbonate build-up and remaining drilling mud and further stimulate the subsurface 110 for hydrocarbon production.

Figure 4M:
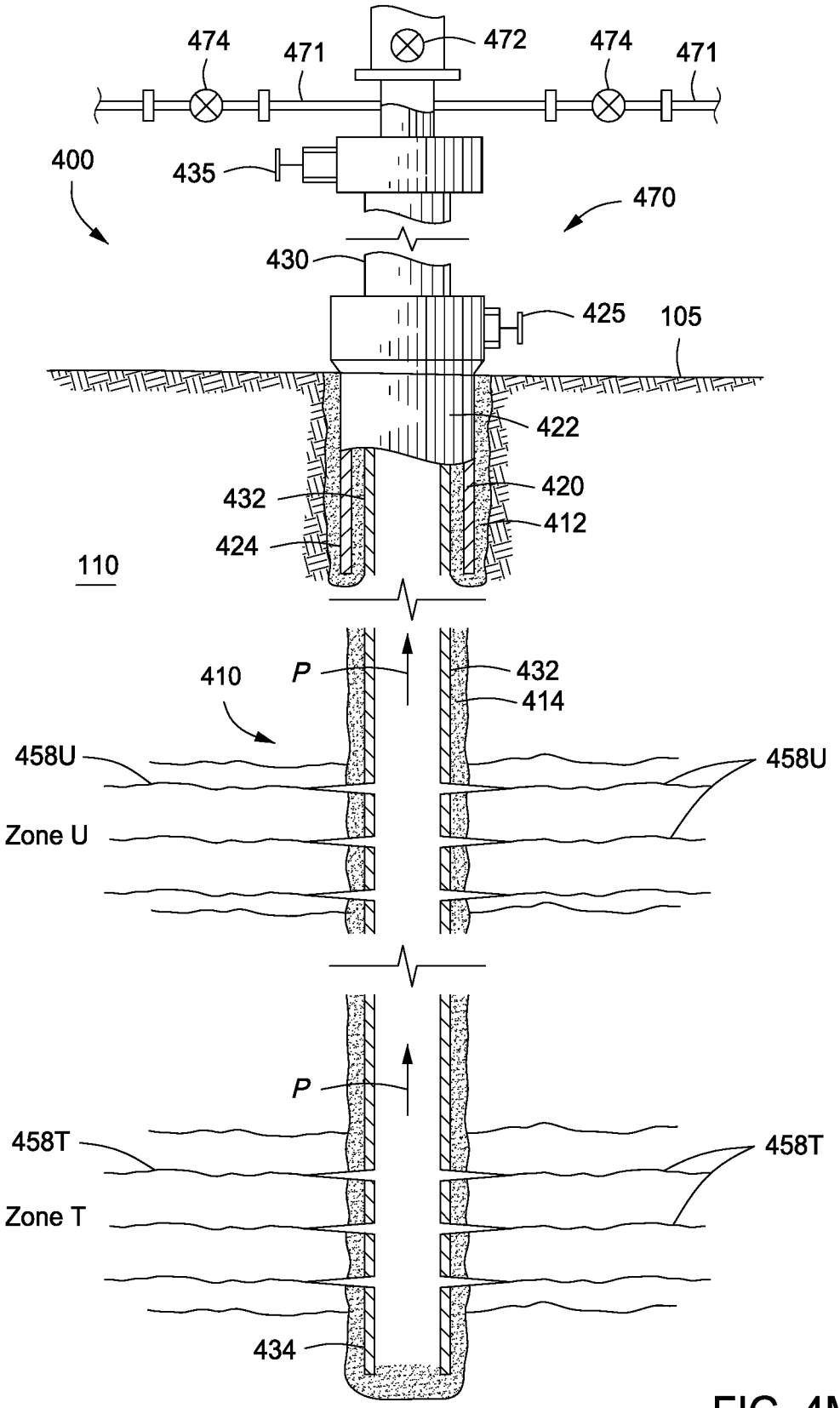
FIG. 4M provides a final side view of the well site of FIG. 4A. Here, the fracturing plug assembly has been removed from the wellbore. In addition, the wellbore is now receiving production fluids.

Finally, FIG. 4M provides a final side view of the well site 400 of FIG. 4A. Here, the fracturing plug assembly 406 has been removed from the wellbore 410. In addition, the wellbore 410 is now receiving production fluids. Arrows "P" indicate the flow of production fluids from the subsurface 110 into the wellbore 410 and towards the surface 105.

In order to remove the plug assembly 406, the on-board controller (shown at 116 of FIG. 1) may release the plug body 100" (with the slips 113") after a designated period of time. The fracturing plug assembly 406 may then be flowed back to the surface 105 and retrieved via a pig catcher (not shown) or other such device. Alternatively, the on-board controller 116 may be programmed so that after a designated period of time, a detonating cord is ignited, which then causes the fracturing plug assembly 406 to detonate and self-destruct. In this arrangement, the entire fracturing plug assembly 406 (except for the sealing element 111') is fabricated from a friable material.

FIGS. 4A through 4M demonstrate the use of perforating gun assemblies with a fracturing plug to perforate and stimulate two separate zones of interest (zones "T" and "U") within an illustrative wellbore 410. In this example, both the first 401 and the second 402 perforating gun assemblies were autonomous, and the fracturing plug assembly 406 was also autonomous. However, it is possible to perforate the lowest or terminal zone "T" using a traditional wireline with a select-fire gun assembly, but then use autonomous perforating gun assemblies to perforate multiple zones above the terminal zone "T."

The tools 401, 402, 406 shown in FIGS. 4A through 4M are dropped or, alternatively, pumped or carried into the wellbore 410 without a wireline. However, it is possible to deploy these tools as autonomous tools, that is, tools that are not electrically controlled from the surface, using a working line. The working line may be a slickline, a wireline, or an electric line.

Figure 5A:
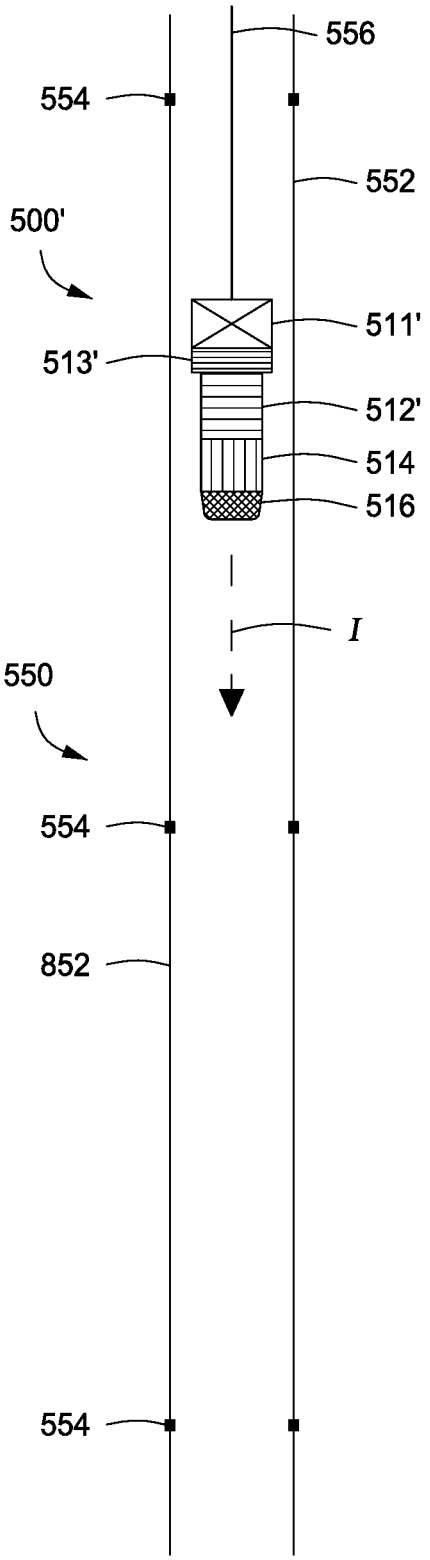
FIGS. 5A and 5B present side views of an illustrative tool assembly for performing a wellbore operation. The tool assembly is a perforating plug assembly being run into a wellbore on a working line.
Figure 5B:
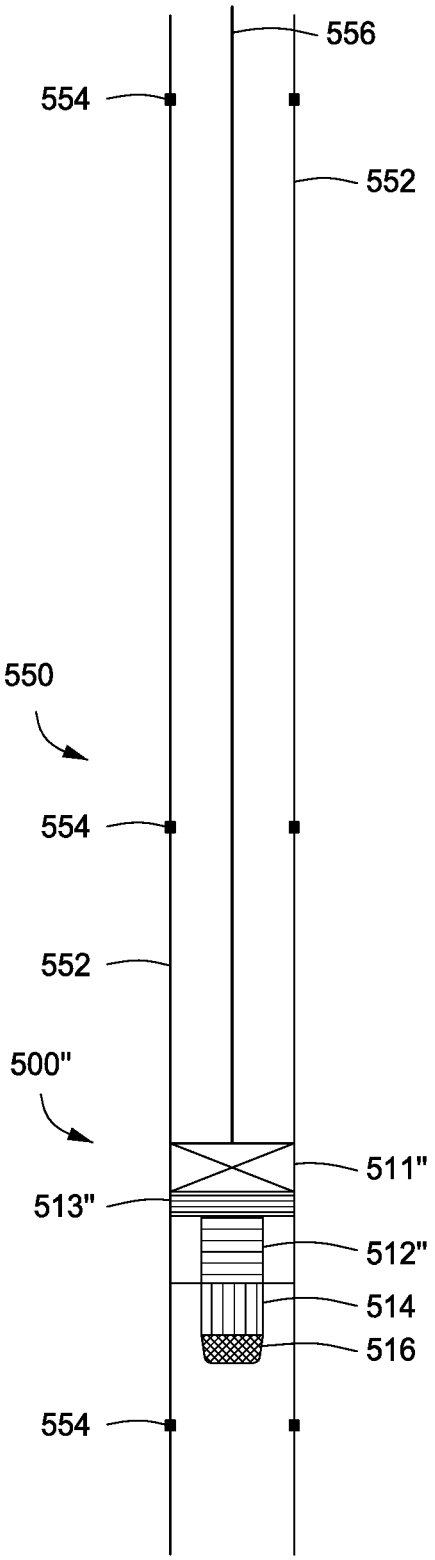

FIGS. 5A and 5B present side views of an illustrative tool assembly 500'/500" for performing a wellbore operation.

Here, the tool assembly 500'/500" is a fracturing plug assembly. In FIG. 5A, the fracturing plug assembly 500' is seen in its run-in or pre-actuated position; in FIG. 5B, the fracturing plug assembly 500" is seen in its actuated state.

Referring first to FIG. 5A, the fracturing plug assembly 500' is deployed within a string of production casing 550. The production casing 550 is formed from a plurality of "joints" 552 that are threadedly connected at collars 554. A wellbore completion operation is being undertaken that includes the injection of fluids into the production casing 550 under high pressure. Arrow "I" indicates the movement of the fracturing plug assembly 500' in its pre-actuated position, down to a location in the production casing 550 where the fracturing plug assembly 500" will be actuated and set.

The illustrative fracturing plug assembly 500' includes a plug body 510'. The plug body 510' will preferably define an elastomeric sealing element 511' and a set of slips 513'. The elastomeric sealing element 511' and the slips 513' are generally in accordance with the plug body 110' described in connection with FIG. 1, above.

The fracturing plug assembly 500' also includes a setting tool 512'. The setting tool 512' will actuate the slips 513' and the elastomeric sealing element 511' and translate them along wedges (not shown) to contact the surrounding casing 550. In the actuated position for the plug assembly 500", seen in FIG. 5B, the plug body 510" is shown in an expanded state. In this respect, the elastomeric sealing element 511" is expanded into sealed engagement with the surrounding production casing 550, and the slips 513" are expanded into mechanical engagement with the surrounding production casing 550. The sealing element 511" comprises a sealing ring, while the slips 513" offer grooves or teeth that "bite" into the inner diameter of the casing 550. Thus, in the tool assembly 500", the plug body 510" consisting of the sealing element 511" and the slips 513" define the actuatable tool.

The fracturing plug assembly 500' also includes a position locator 514. The position locator 514 serves as a location device for sensing the location of the tool assembly 500' within the production casing 550. More specifically, the position locator 514 senses the presence of objects or "downhole markers" along the wellbore 550, and generates depth signals in response.

In the view of FIGS. 5A and 5B, the objects are the casing collars 554. This means that the position locator 514 is a casing collar locator, or "CCL." The CCL senses the location of the casing collars 554 as it moves down the production casing 550. The fracturing plug assembly 500' further includes an on-board controller or processor 516. The on-board controller 516 processes the depth signals generated by the position locator 514. In one aspect, the on-board controller 516 compares the generated signals with a predetermined physical signature obtained for the casing collars. For example, a CCL log may be run before deploying the autonomous tool 500' in order to determine the spacing of the casing collars 554.

The on-board controller 516 activates the actuatable tool when it determines that the plug assembly 500" has arrived at a particular depth adjacent a selected zone of interest. In the example of FIG. 5B, the on-board controller 516 activates the fracturing plug 510" and the setting tool 512" to cause the fracturing plug assembly 500" to stop moving, and to set in the production casing 550 at a desired depth or location.

The tool assembly 500'/500" of FIGS. 5A and 5B differs from the autonomous tools 100' and 200' of FIGS. 1 and 2 in that the tool assembly 500'/500" is run into the wellbore 550 on a working line 556. In the illustrative arrangement of FIGS. 5A and 5B, the working line 556 is a slickline or other non electric-line.

As an alternative to using a slickline 556, a tool assembly may be run into the wellbore with a tractor. This is particularly advantageous in deviated wellbores.

Other combinations of wired and wireless tools may be used within the spirit of the present inventions. For example, the operator may run fracturing plugs into the wellbore on a wireline, but drop or pump in one or more autonomous perforating gun assemblies. Reciprocally, the operator may run the respective perforating gun assemblies into the wellbore on a wireline, but use one or more autonomous fracturing plug assemblies without a working line.

Figure 6A:
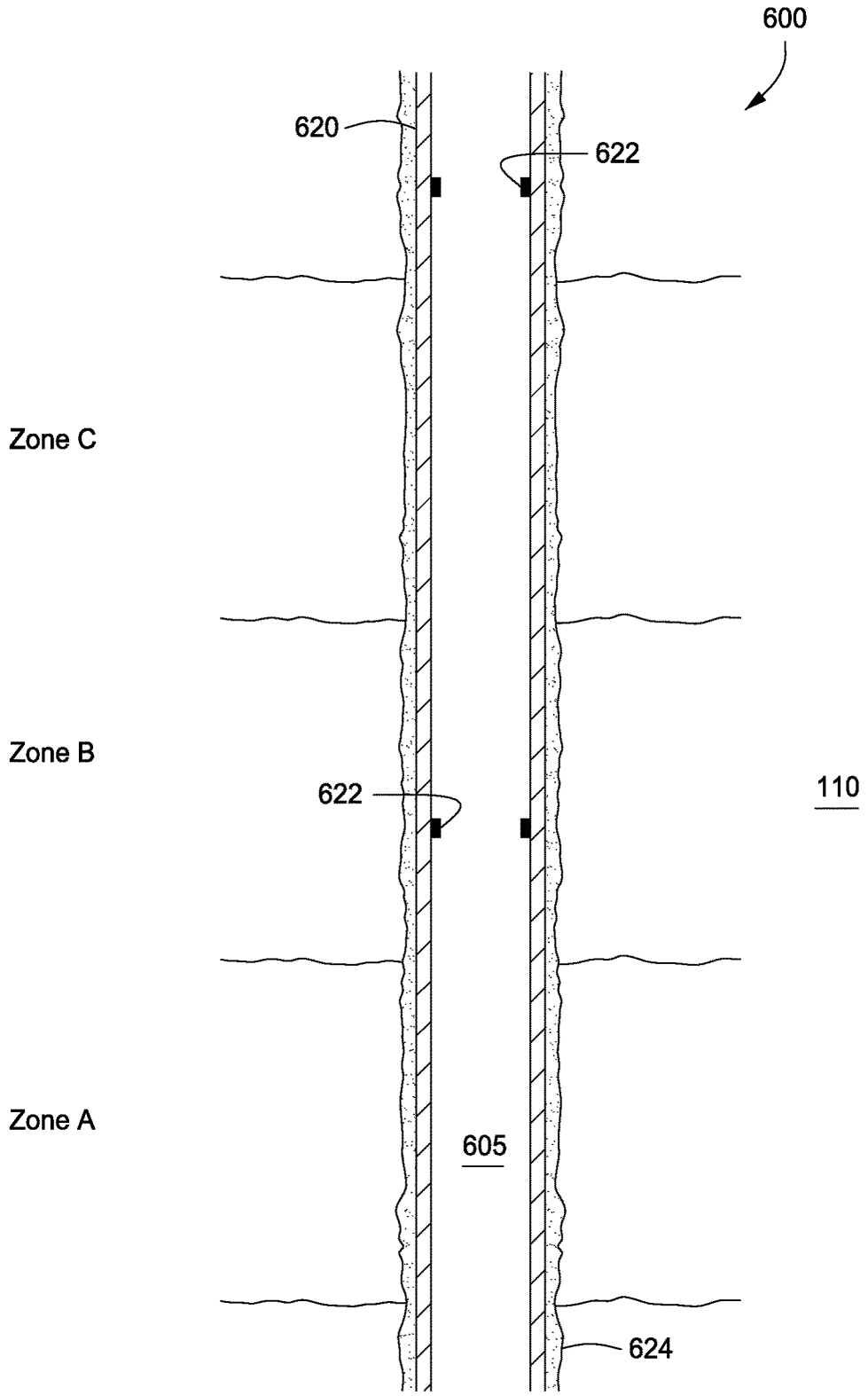
FIG. 6A is a side view of a portion of a wellbore. The wellbore is being completed in multiple zones of interest, including zones "A," "B," and "C."

It is noted that the process of perforating a wellbore at various intervals may be done without a fracturing plug assembly. FIGS. 6A through 6I demonstrate how multiple zones of interest may be sequentially perforated and treated in a wellbore using destructible, autonomous perforating gun assemblies and ball sealers. First, FIG. 6A is a side view of a portion of a wellbore 600. The wellbore 600 is being completed in multiple zones of interest, including zones "A," "B," and "C." The zones of interest "A," "B," and "C" reside within a subsurface 110 containing hydrocarbon fluids.

The wellbore 600 includes a string of production casing (or, alternatively, a liner string) 620. The production casing 620 has been cemented into the subsurface 610 to isolate the zones of interest "A," "B," and "C" as well as other strata along the subsurface 110. A cement sheath is seen at 624.

The production casing 620 has a series of locator tags 622 placed there along. The locator tags 622 are ideally embedded into the wall of the production casing 620 to preserve their integrity. However, for illustrative purposes the locator tags 622 are shown in FIG. 6A as attachments along the inner diameter of the production casing 620. In the arrangement of FIG. 6A, the locator tags 612 represent radio frequency identification tags that are sensed by an RFID reader/antennae. The locator tags 622 create a physical signature along the wellbore 600.

The wellbore 600 is part of a well that is being formed for the production of hydrocarbons. As part of the well completion process, it is desirable to perforate and then fracture each of the zones of interest "A," "B," and "C."

Figure 6B:
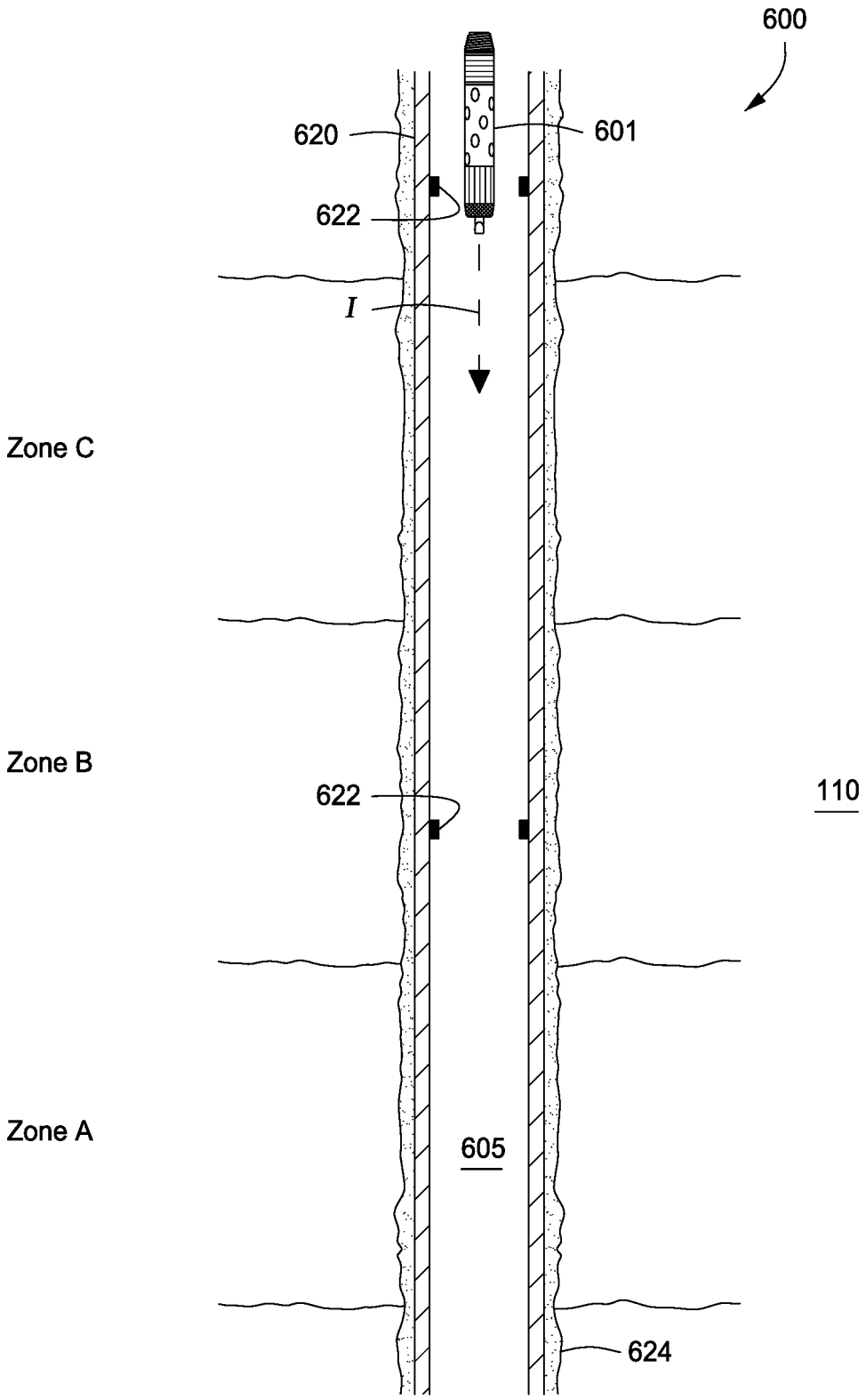
FIG. 6B is another side view of the wellbore of FIG. 6A. Here, the wellbore has received a first perforating gun assembly. The perforating gun assembly is being pumped down the wellbore.

FIG. 6B is another side view of the wellbore 600 of FIG. 6A. Here, the wellbore 600 has received a first perforating gun assembly 601. The first perforating gun assembly 601 is generally in accordance with perforating gun assembly 200' (in its various embodiments) of FIG. 2. In FIG. 6B, the perforating gun assembly 601 is being pumped down the wellbore 600. The perforating gun assembly 601 has been dropped into a bore 605 of the wellbore 600, and is moving down the wellbore 600 through a combination of gravitational pull and hydraulic pressure. Arrow "I" indicates movement of the gun assembly 601.

Figure 6C:
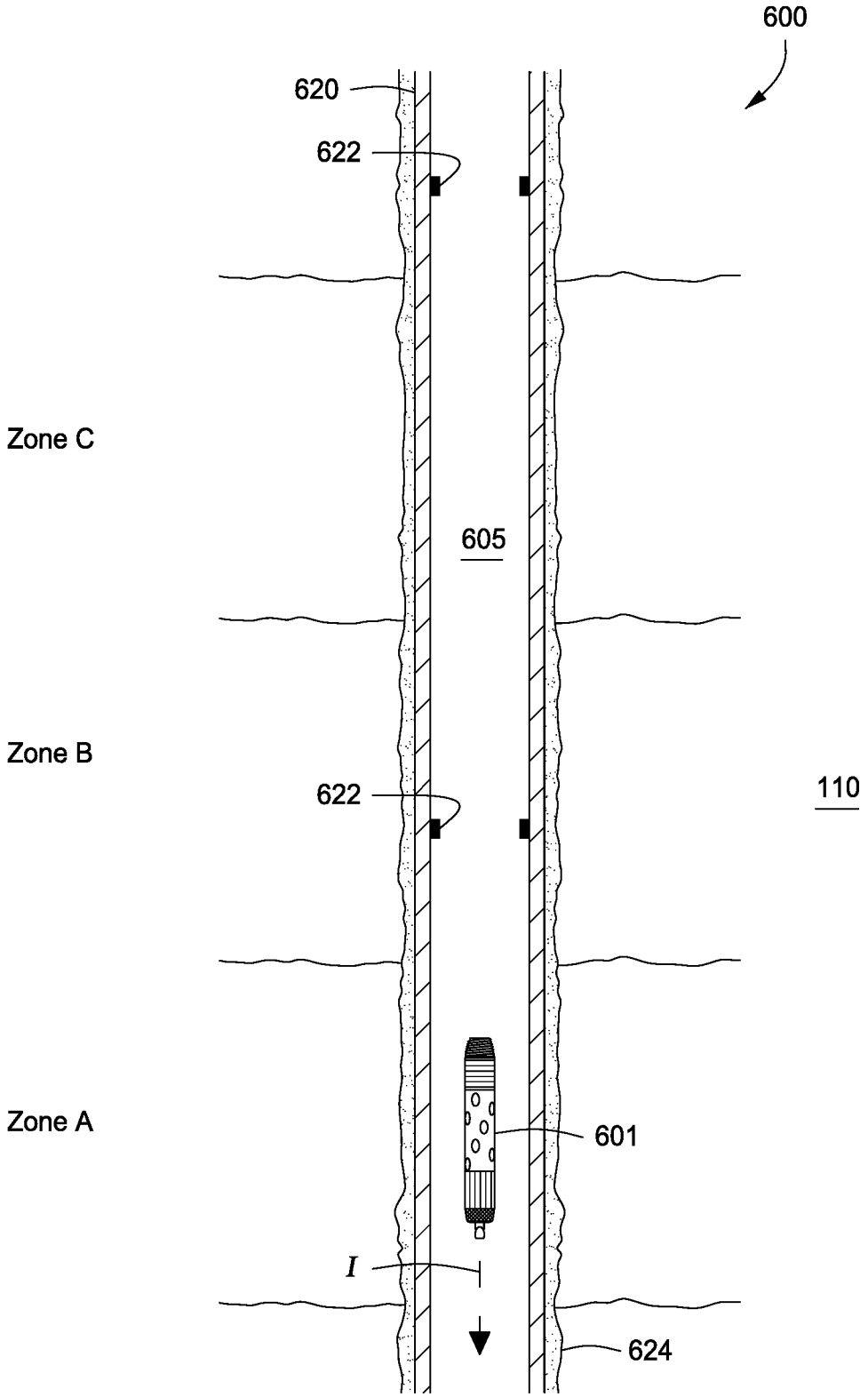
FIG. 6C is another side view of the wellbore of FIG. 6A. Here, the first perforating gun assembly has fallen into the wellbore to a position adjacent zone of interest "A."

FIG. 6C is a next side view of the wellbore 600 of FIG. 6A. Here, the first perforating gun assembly 601 has fallen into the bore 605 to a position adjacent zone of interest "A." In accordance with the present inventions, the locator device (shown at 214' in FIG. 3) has generated signals in response to the tags 622 placed along the production casing 620. In this way, the on-board controller (shown at 216 of FIG. 3) is aware of the location of the first perforating gun assembly 601.

Figure 6D:
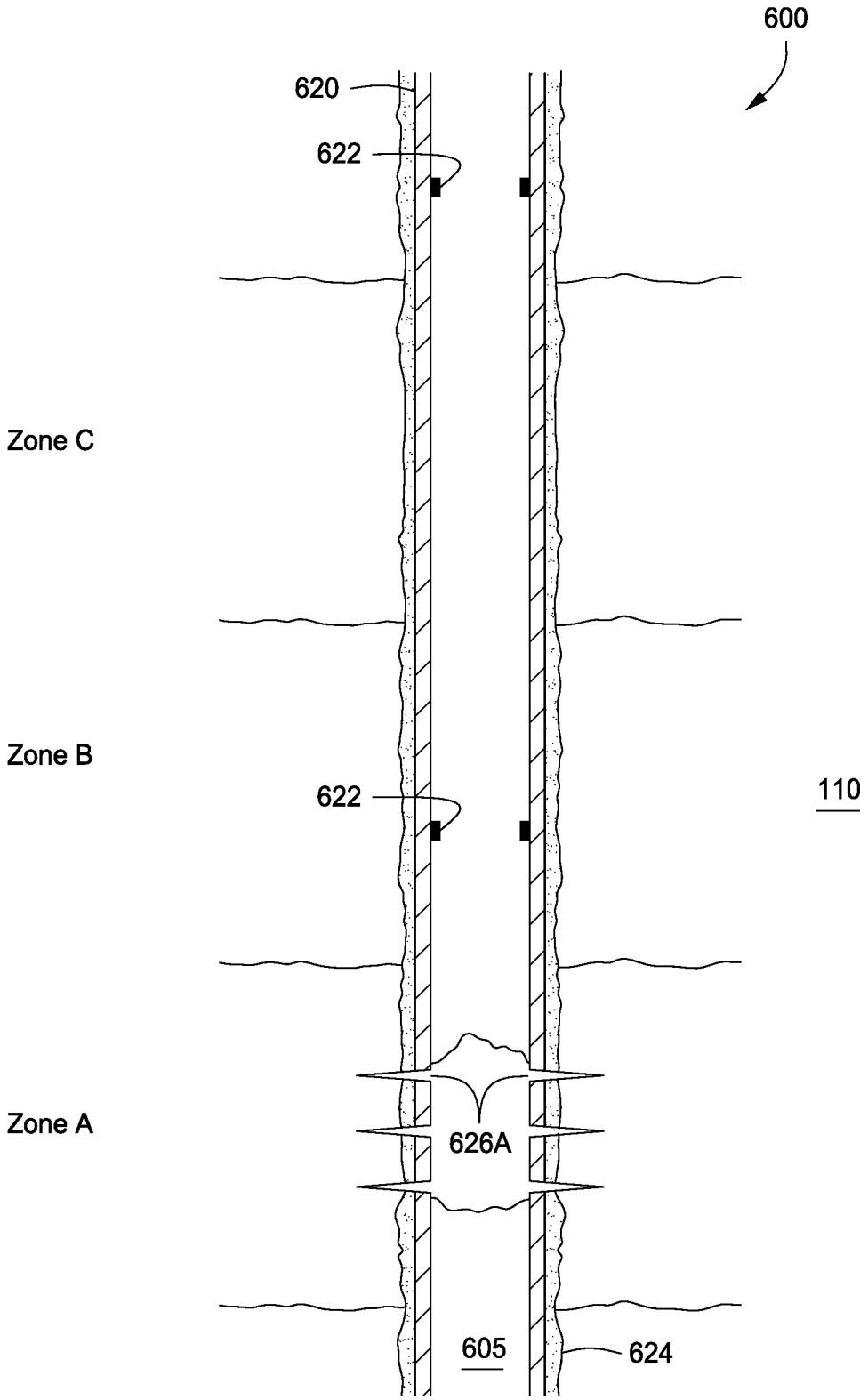
FIG. 6D is another side view of the wellbore of FIG. 6A. Here, charges of the first perforating gun assembly have been detonated, causing the perforating gun of the perforating gun assembly to fire. The casing along the zone of interest "A" has been perforated.

FIG. 6D is another side view of the wellbore 600 of FIG. 6A. Here, charges of the first perforating gun assembly have been detonated, causing the perforating gun of the perforating gun assembly to fire. The zone of interest "A" has been perforated. A set of perforations 626A is shown extending from the wellbore 600 and into the subsurface 610. While only six perforations 626A are shown in side view, it us understood that additional perforations are formed, and that such perforations will extend radially around the production casing 620.

In addition to the creation of perforations 626A, the first perforating gun assembly 601 is self-destructed. Any pieces left from the assembly 601 will likely fall to the bottom of the production casing 620.

Figure 6E:
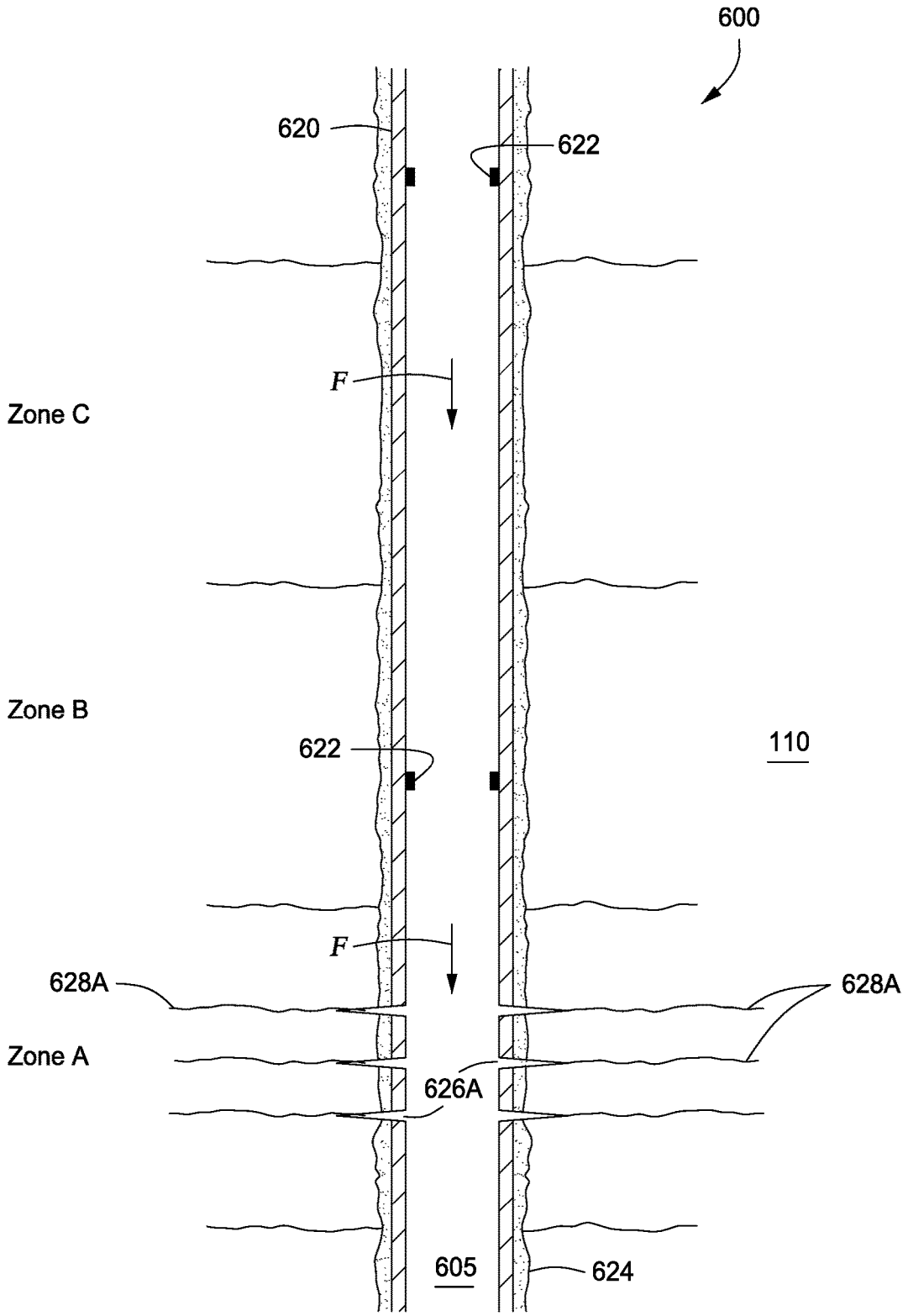
FIG. 6E is yet another side view of the wellbore of FIG. 6A. Here, fluid is being injected into the wellbore under high pressure, causing the rock matrix within the zone of interest "A" to be fractured.

FIG. 6E is yet another side view of the wellbore 600 of FIG. 6A. Here, fluid is being injected into the bore 605 of the wellbore under high pressure, causing the formation within the zone of interest "A" to be fractured. Downward movement of the fluid is indicated by arrows "F." The fluid moves through the perforations 626A and into the surrounding subsurface 110. This causes fractures 628A to be formed within the zone of interest "A." An acid solution may also optionally be circulated into the bore 605 to dissolve drilling mud and to remove carbonate build-up and further stimulate the subsurface 110 for hydrocarbon production.

Figure 6F:
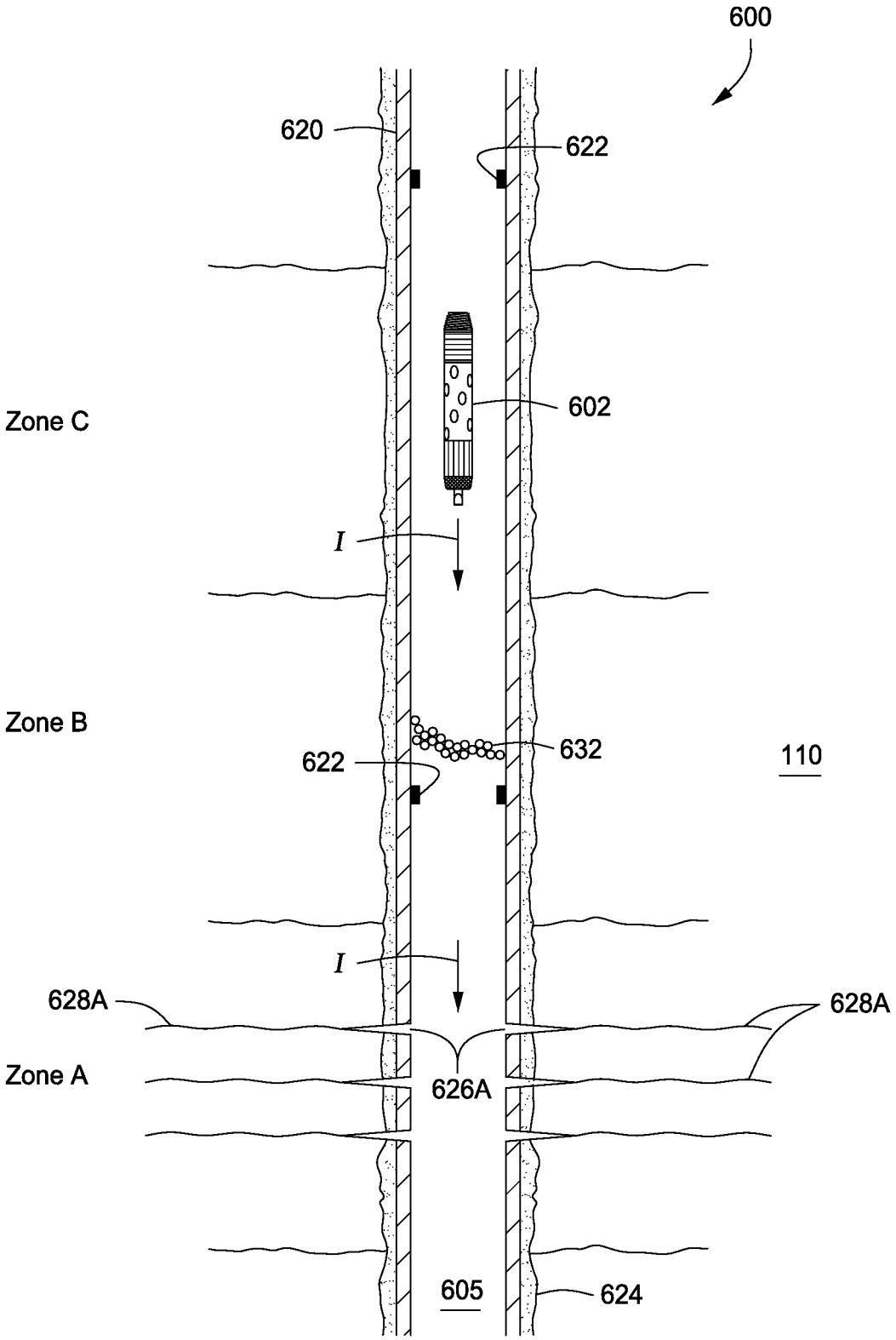
FIG. 6F is yet another side view of the wellbore of FIG. 6A. Here, the wellbore has received a second perforating gun assembly. In addition, ball sealers have been dropped into the wellbore ahead of the second perforating gun assembly.

FIG. 6F is yet another side view of the wellbore 600 of FIG. 6A. Here, the wellbore 600 has received a second perforating gun assembly 602. The second perforating gun assembly 602 may be constructed and arranged as the first perforating gun assembly 601. This means that the second perforating gun assembly 602 is also autonomous, and is also constructed of a friable material.

It can be seen in FIG. 6F that the second perforating gun assembly 602 is moving downwardly in the wellbore 600, as indicated by arrow "I." The second perforating gun assembly 602 may be simply falling through the wellbore 600 in response to gravitational pull. In addition, the operator may be assisting the downward movement of the perforating gun assembly 602 by applying hydraulic pressure through the use of surface pumps (not shown).

In addition to the gun assembly 602, ball sealers 632 have been dropped into the wellbore 600. The ball sealers 632 are preferably dropped ahead of the second perforating gun assembly 602. Optionally, the ball sealers 632 are released from a ball container (shown at 218 in FIG. 2). The ball sealers 632 are fabricated from composite material and are rubber coated. The ball sealers 632 are dimensioned to plug the perforations 626A.

The ball sealers 632 are intended to be used as a diversion agent. The concept of using ball sealers as a diversion agent for stimulation of multiple perforation intervals is known. The ball sealers 632 will seat on the perforations 626A, thereby plugging the perforations 626A and allowing the operator to inject fluid under pressure into a zone above the perforations 626A. The ball sealers 632 provide a low-cost diversion technique, with a low risk of mechanical issues.

Figure 6G:
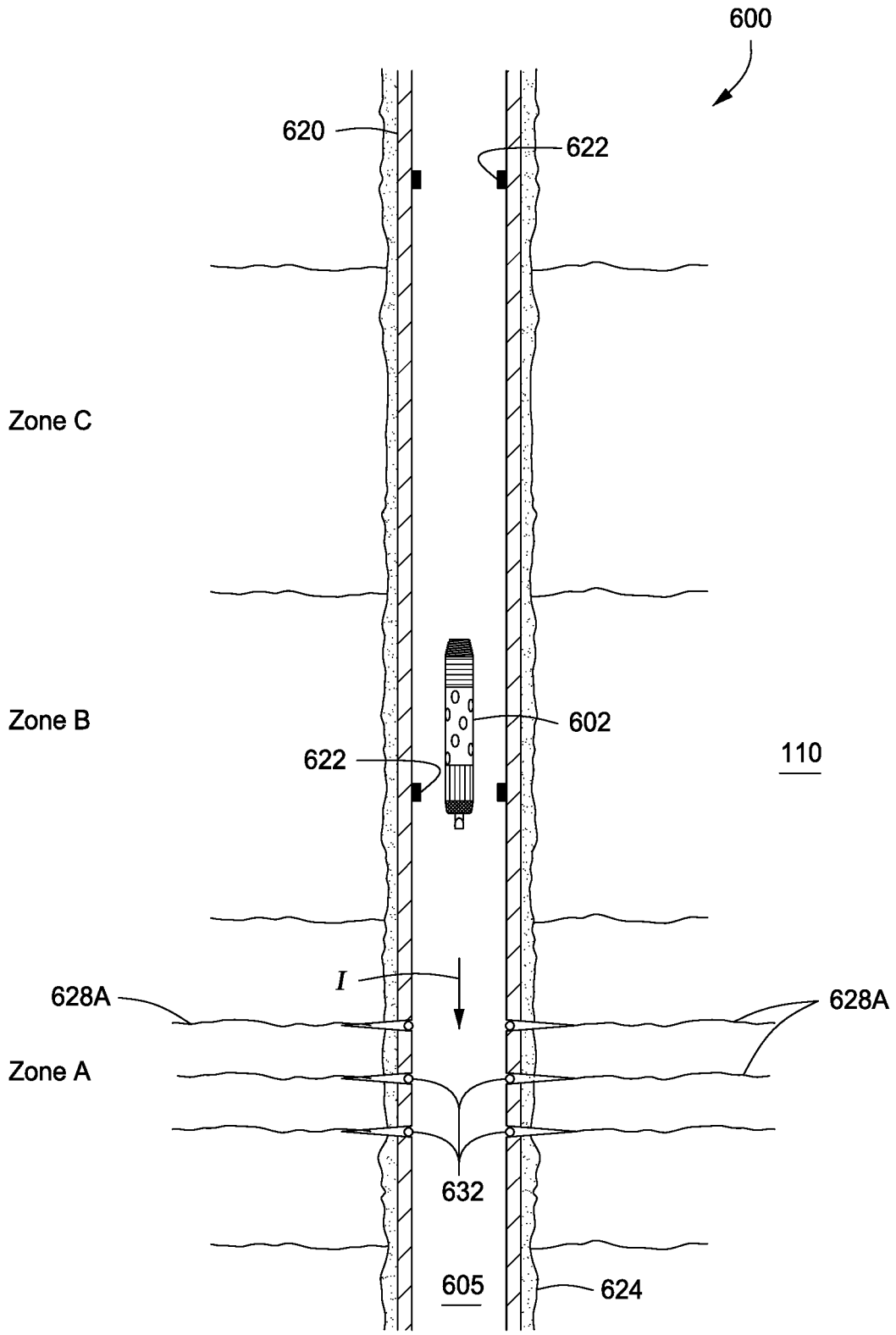
FIG. 6G is still another side view of the wellbore of FIG. 6A. Here, the second fracturing plug assembly has fallen into the wellbore to a position adjacent the zone of interest "B." In addition, the ball sealers have plugged the newly-formed perforations along the zone of interest "A."

FIG. 6G is still another side view of the wellbore 600 of FIG. 6A. Here, the second fracturing plug assembly 602 has fallen into the wellbore 600 to a position adjacent the zone of interest "B." In addition, the ball sealers 632 have temporarily plugged the newly-formed perforations along the zone of interest "A." The ball sealers 632 will later either flow out with produced hydrocarbons, or drop to the bottom of the well in an area known as the rat (or junk) hole.

Figure 6H:
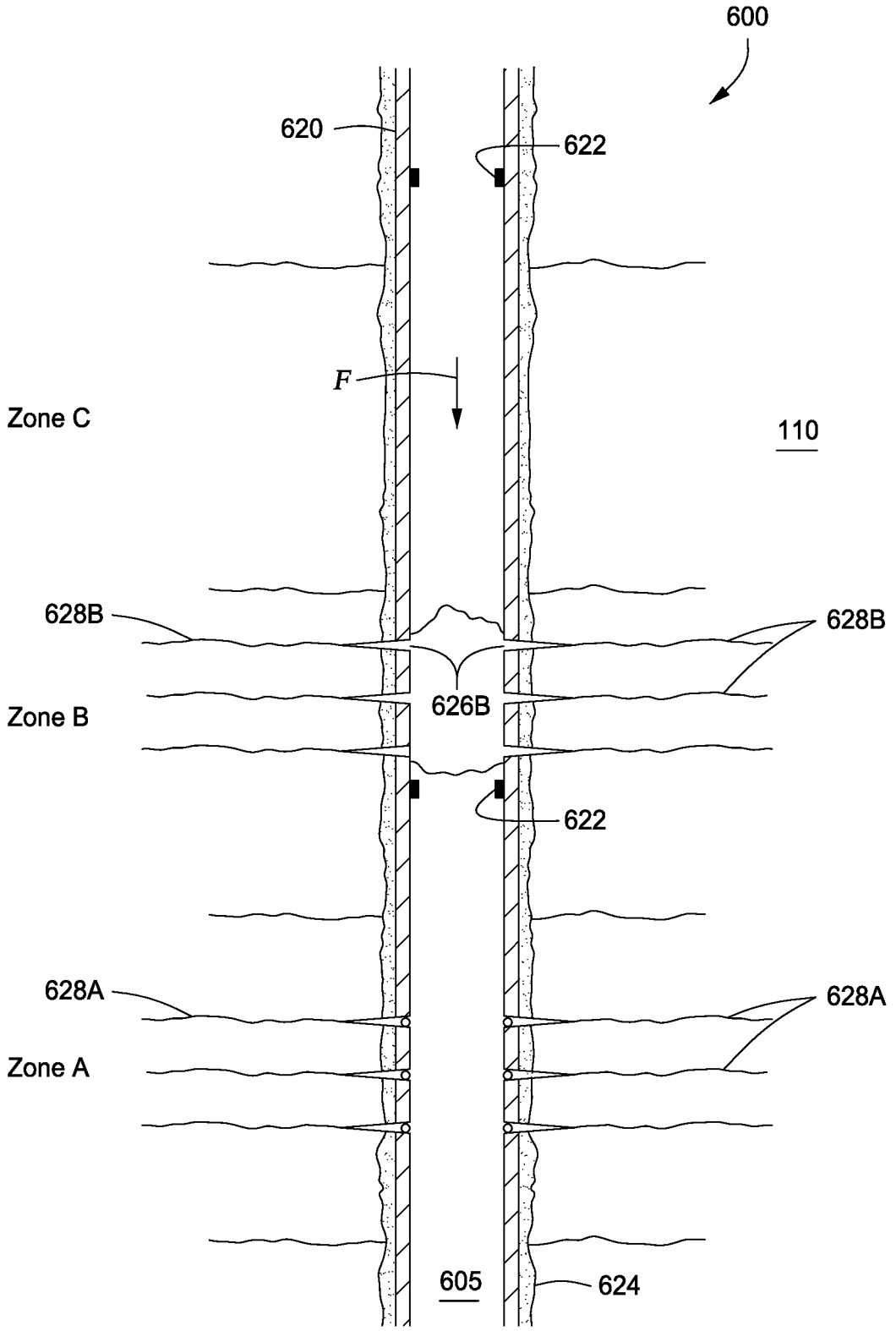
FIG. 6H is another side view of the wellbore of FIG. 6A. Here, the charges of the second perforating gun assembly have been detonated, causing the perforating gun of the perforating gun assembly to fire. The casing along the zone of interest "B" has been perforated. Zone "B" is above zone of interest "A." In addition, fluid is being injected into the wellbore under high pressure, causing the rock matrix within the zone of interest "B" to be fractured.

FIG. 6H is another side view of the wellbore 600 of FIG. 6A. Here, charges of the second perforating gun assembly 602 have been detonated, causing the perforating gun of the perforating gun assembly 602 to fire. The zone of interest "B" has been perforated. A set of perforations 626B is shown extending from the wellbore 600 and into the subsurface 110. While only 6 perforations 626B are shown in side view, it us understood that additional perforations are formed, and that such perforations will extend radially around the production casing 620.

In addition to the creation of perforations 626B, the perforating gun assembly 602 is self-destructed. Any pieces left from the assembly 601 will likely fall to the bottom of the production casing 620 or later flow back to the surface.

It is also noted in FIG. 6H that fluid continues to be injected into the bore 605 of the wellbore 600 while the perforations 626B are being formed. Fluid flow is indicated by arrow "F." Because ball sealers 632 are substantially plugging the lower perforations along zone "A," pressure is able to build up in the wellbore 600. Once the perforations 626B are shot, the fluid escapes the wellbore 600 and invades the subsurface 110 within zone "B." This immediately creates fractures 628B.

It is understood that the process used for forming perforations 626B and formation fractures 628B along zone of interest "B" may be repeated in order to form perforations and formation fractures in zone of interest "C," and other higher zones of interest. This would include the placement of ball sealers along perforations 626B at zone "B," running a third autonomous perforating gun assembly (not shown) into the wellbore 600, causing the third perforating gun assembly to detonate along zone of interest "C," and creating perforations and formation fractures along zone "C."

Figure 6I:
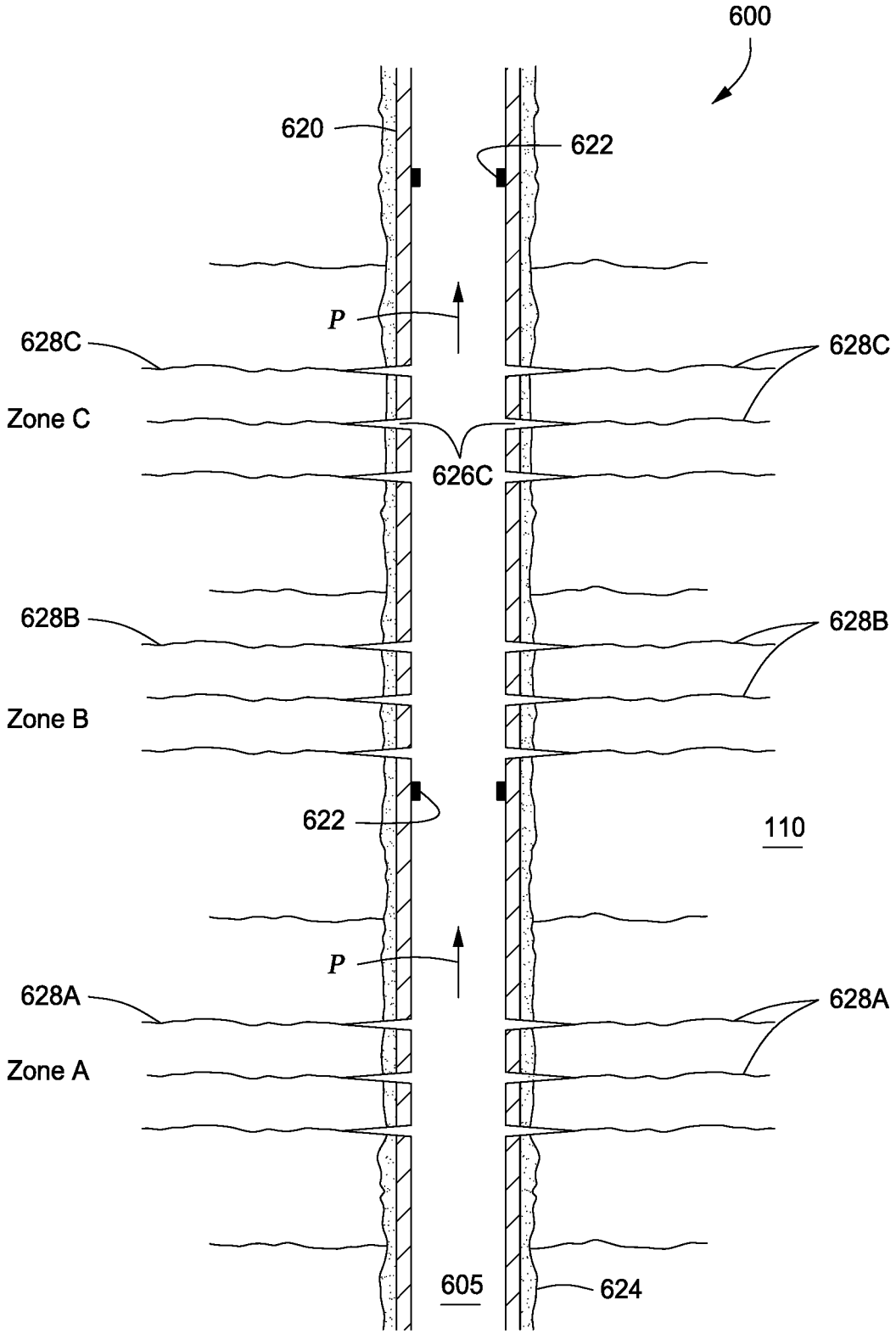
FIG. 6I provides a final side view of the wellbore of FIG. 6A. Here, the production casing has been perforated along zone of interest "C." Multiple sets of perforations are seen. In addition, formation fractures have been formed in the subsurface along zone "C." The ball sealers have been flowed back to the surface.

FIG. 6I provides a final side view of the wellbore 600 of FIG. 6A. Here, the production casing 620 has been perforated along zone of interest "C." Multiple sets of perforations 626C are seen. In addition, formation fractures 628C have been formed in the subsurface 110.

In FIG. 6I, the wellbore 600 has been placed in production. The ball sealers have been removed and have flowed to the surface. Formation fluids are flowing into the bore 605 and up the wellbore 600. Arrows "P" indicate a flow of fluids towards the surface.

FIGS. 6A through 6I demonstrate how perforating gun assemblies may be dropped into a wellbore 600 sequentially, with the on-board controller of each perforating gun assembly being programmed to ignite its respective charges at different selected depths. In the depiction of FIGS. 6A through 6I, the perforating gun assemblies are dropped in such a manner that the lowest zone (Zone "A") is perforated first, followed by sequentially shallower zones (Zone "B" and then Zone "C"). However, using autonomous perforating gun assemblies, the operator may perforate subsurface zones in any order. Beneficially, perforating gun assemblies may be dropped in such a manner that subsurface zones are perforated from the top, down. This means that the perforating gun assemblies would detonate in the shallower zones before detonating in the deeper zones.

FIGS. 5A through 5M and FIGS. 6A through 6I demonstrate the use of a fracturing plug assembly and the use of a perforating gun assembly, respectively, as autonomous tool assemblies. However, additional actuatable tools may be used as part of an autonomous tool assembly. Such tools include, for example, bridge plugs, cutting tools, cement retainers and casing patches. In these arrangements, the tools will be dropped or pumped or carried into a wellbore constructed to produce hydrocarbon fluids or to inject fluids. The tool may be fabricated from a friable material or from a millable material, such as ceramic, phenolic, composite, cast iron, brass, aluminum, or combinations thereof.

As noted above, it is desirable to incorporate a safety system into the autonomous wellbore tool to prevent premature activation. This is particularly true where the wellbore tool includes a perforating gun, such as perforating gun 212 of FIG. 2. It is preferred that the safety system employ a series of switches or "gates," each of which is satisfied by a separate condition.

FIG. 7 schematically illustrates a multi-gated safety system 700 for an autonomous wellbore tool, in one embodiment. In the safety system 700 of FIG. 7, a number of separate gates are provided. The gates are indicated separately at 710, 720, 730, 740, and 750. Each of these gates 710, 720, 730, 740, 750 represents a condition that must be satisfied in order for detonation charges to be delivered to a perforating gun. Stated another way, the gated safety system 700 keeps the detonators inactive while the perforating gun assembly is at the surface or in transit to a well site.

In FIG. 7, a perforating gun is seen at 212. This is representative of the same gun as is shown at 212 in FIG. 2. The perforating gun 212 includes a plurality of shaped charges 712. The charges are distributed along the length of the gun 212. The charges 712 are ignited in response to an electrical signal delivered from the controller 216 through electrical lines 735 and to detonators 716. The lines 725 are bundled into a sheath 714 for delivery to the perforating gun 212 and the detonators 716. Optionally, the lines 725 are pulled from inside the tool assembly 200 as a safety precaution until the tool assembly 200 is delivered to a well site.

The detonators 716 receive an electrical current from a firing capacitor 766. The detonators 716 then deliver heat to the charges 712 to create the perforations. Electrical current to the detonators 716 is initially shunted to prevent detonation from stray currents. In this respect, electrically actuated explosive devices can be susceptible to detonation by stray electrical signals. These may include radio signals, static electricity, or lightning strikes. After the assembly is launched, the gates are removed. This is done by unshunting the detonators 716 by operating an initial electrical switch (seen at gate 710), and by further closing electrical switches one by one until an activation signal may pass through the safety circuit 700 and the detonators 716 are active.

In the arrangement of FIG. 7, two physical shunt wires 735 are provided. Initially, the wires 735 are connected across the detonators 716. This connection is external to the perforating gun assembly 200. Wires 735 are visible from the outside of the assembly 200. When the assembly 200 is delivered to the well site, the shunt wires 735 are disconnected from one another and are connected to the detonators 716 and to the circuitry making up the safety system 700.

In operation, a detonation battery 760 is provided for the perforating gun 212. At the appropriate time, the detonation battery 760 delivers an electrical charge to a firing capacitor 766. The firing capacitor 766 then sends a strong electrical signal through one or more electrical lines 735. The lines 735 terminate at the detonators 716 within the perforating gun 212. The electrical signal generates resistive heat, which causes a detonation cord (not shown) to burn. The heating rapidly travels to the shaped charges 712 along the perforating gun 212.

In order to prevent premature detonation, a series of gates is provided. In FIG. 7, a first gate is shown at 710. This first gate 710 is controlled by a mechanical pull tab. The pull tab is pulled as the perforating gun 212 (and other downhole tool components of tool 200) is dropped into a wellbore. The tab may be pulled manually after the removal of safety pins (not shown). More preferably, the tab is pulled automatically as the gun 212 falls from a wellhead and into the wellbore.

Figure 8:
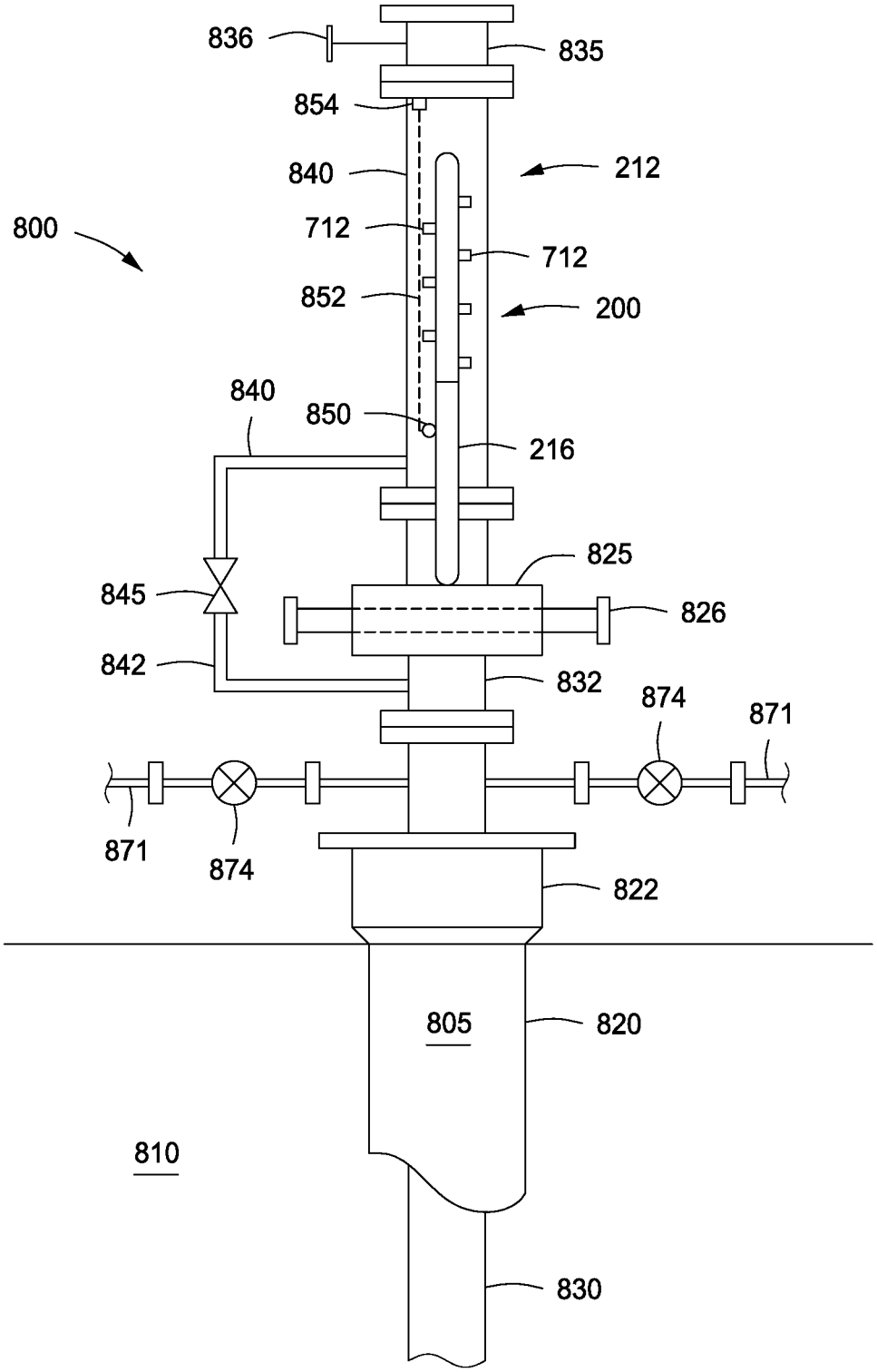
FIG. 8 is a side view of a wellhead receiving a perforating gun as an autonomous wellbore tool. The perforating gun is equipped with a safety ring as part of a multi-gated safety system.

FIG. 8 is a side view of a wellhead 800 receiving a perforating gun 212 as part of an autonomous perforating gun assembly 200. The wellhead 800 represents completion equipment that is placed over the top of a wellbore 805. In FIG. 8, a string of surface casing is shown at 820. The surface casing 820 extends several hundred feet into the subsurface 810. Only an upper portion 822 of the surface casing 820 is shown in FIG. 8.

The wellhead 800 has various components that are known in the industry. These include a lower valve 825, an upper valve 835, and an intermediate piping 840 between the lower 825 and upper 835 valves. The intermediate piping 840 is dimensioned to receive and isolate wellbore tools as they are deployed into the wellbore.

The lower valve 825 includes a ram 826 for selectively closing the lower valve 825 and closing off the wellbore. Similarly, the upper valve 835 includes a stem 836 for selectively closing the upper valve 835 and isolating the wellbore 810.

The wellhead 800 receives a string of production casing 830. An upper portion 832 of the production casing 830 is seen extending above the upper portion 822 of the surface casing 820. The production casing 830 is in fluid communication with the intermediate piping 840, but may be closed off by use of the lower ram 826.

A pressure-equalizing line 842 connects the upper portion 832 of the production casing 830 with the intermediate piping 840. A valve 845 is placed along the lower valve 825. The pressure-equalizing line 842 is used to balance the pressure between the wellbore 805 and the piping 840 before a tool string is launched into the production casing 830.

The wellhead 800 also includes formation treatment injection lines 871. The lines 871 receive fracturing fluids and other formation treatment fluids. Valves 874 are placed along the formation treatment injection lines 871.

In operation, the gun assembly 212 is placed over the wellbore 805 in the piping 840 with the pressure-equalizing line 840 connected from the chamber formed by the piping 840 to the production casing 830. The perforating gun 212 rests on the lower valve 825 or lower set of rams 826. After the perforating gun 212 is placed inside the chamber formed by the piping 840, and after the upper valve 835 is closed, the pressure in the piping 840 will be equalized with the pressure in the wellbore 805.

As seen in FIG. 8 the perforating gun 212 is equipped with a safety ring 850. The safety ring 850 is part of the safety system 700. The safety ring 850 is essentially a tab or key that is mechanically connected to the controller 216. As long as the safety ring 850 is in place, the detonator is shunted and any stray electrical current will go through the shunt.

A cable 852 is connected to the safety ring 850 at a first end. At a second opposite end, the cable 852 is connected to an attachment 854 within the wellhead 800. During transportation and surface manipulation of the gun assembly 200, the ring 850 is secured to the perforating gun 212 by pins (not shown). Before the perforating gun 212 (as part of the perforating gun assembly 200) is placed in the launching chamber 840, the pins are removed. At the moment of launch, the lower rams 826 are opened and the assembly 200 travels through the lower valve 825 and into the wellbore 200. As the perforating gun 212 drops, it falls into the production casing 830. During the drop, the safety ring 850 is pilled by the lanyard, closing the first gate 710.

When the first gate 710 is closed, a command signal is sent. The command signal is shown as dashed line 712. The signal 712 is sent to a fire enabling timer 714. The timer 714, in turn, controls a second gate in the safety system 700.

Returning to FIG. 7, the second gate in the safety system 700 is shown at 720. This second gate 720 represents a timer.

More specifically, the second gate 720 is a timed relay switch that shunts the electrical connections to the detonators 716 at all times unless a predetermined time value is exceeded. In one aspect, the timer 714 represents three or more separate clocks. Logic control compares the times kept by each of the three clocks. The logic control averages the three times. Alternatively, the logic control accepts the time of the two closest times, and then averages them. Alternatively still, the logic control "votes" to select the first two (or other) times of the clock that are the same.

In one aspect, the timer 714 of gate 720 prevents a 2-pole relay 736 from changing state, that is, from shunting the detonators 716 to connecting the detonators 716 to the firing capacitor 766 for a predetermined period of time. The predetermined period of time may be, for example, 1 to 5 minutes. This is a "fire blocked" state. Thereafter, the electrical switch 720 is closed for a predetermined period of time, such as up to 30 minutes or, optionally, up to 55 minutes. This is a "fire unblocked" state.

Preferably, the safety system 700 is also programmed or designed to de-activate the detonators 716 in the case that detonation does not occur within a specified period of time. For instance, if the detonators 716 have not caused the charges 712 to fire after 55 minutes, the electrical switch representing the second gate 720 is opened, thereby preventing the relay 736 from changing state from shunting the detonators 716 to connecting the detonators 716 to the firing capacitor 766. This feature enables the safe retrieval of the gun assembly 200 utilizing standard fishing operations. In any instance, a control signal is provided through dashed line 716 for operating the switch of the second gate 720.

The control system 700 also includes a third gate 730. This third gate 730 is based upon one or more pressure-sensitive switches. In one aspect, the pressure-sensitive switches 730 are biased by a spring (not shown) to be in the closed (shunted) position. In this manner, the third gate 730 is shunted, or closed, during transport and loading. Alternatively, the pressure-sensitive switches are diaphragms that are designed to puncture or collapse upon exceeding a certain pressure threshold.

In either design, as the gun assembly 200 falls in the wellbore 805, hydrostatic pressure increases in the wellbore 805. The gun assembly 200 may be pumped or just dropped. Once a predetermined pressure value is exceeded within the wellbore 805, the gate 730 represented by one or more pressure-sensitive electrical switches closes. This provides a time-delayed unshunting of the detonators 716.

In one aspect, the ring 850 provides a mechanical barrier for the actuation of the pressure-activated switches of the third gate 730. Thus, the third gate 730 cannot close unless the first gate 710 is closed.

The fourth gate is shown at 740. This fourth gate 740 represents the program or digital logic that determines the location of the gun assembly 200 as it traverses the wellbore 805. As discussed above and in the incorporated patent application that is U.S. Provisional Pat. Appl. No. 61/424,285 entitled "Method for Automatic Control and Positioning of Autonomous Downhole Tools," the logic processes magnetic readings to identify probable casing collar locations, and compares those locations with a previously-downloaded (and, optionally algorithmically processed) casing collar log. The casing collar locations are counted until the desired location within the wellbore 805 is reached. An electrical signal is then delivered that closes the fourth gate 740.

The fourth gate 740 is preferably an electronics module. The electronics module consists of an onboard memory and built-in logic, together forming a controller. The electronic module provides a digital safety barrier based on logic and predetermined values of various tool events. Such events may include tool depth, tool speed, tool travel time, and downhole markers. Downhole markers may be Casing Collar Locator (CCL) signals caused by collars and pup joints intentionally (or unintentionally) placed in the completion string 830.

In the arrangement of FIG. 7, a signal 718 is sent when the launch switch representing the first gate 710 is closed. The signal 718 informs the controller to begin computing tool depth in accordance with its operational algorithm. The controller includes a detonator control 742. At the appropriate depth, the detonator control 742 sends a first signal 744' to the detonator power supply 760. In one aspect, the detonator power supply 760 is turned on a predetermined number of minutes, such as three minutes, after the tool assembly 200 is launched.

It is noted that in an electrically powered perforating gun, a strong electrical charge is needed to ignite the detonators 716. The power supply (or battery) 760 itself will not deliver that charge; therefore, the power supply 760 is used to charge the firing capacitor 766. This process typically takes about two minutes. Once the firing capacitor 766 is charged, the current lines 735 may carry the strong charge to the detonators 716. Line 774 is provided as a power line.

The controller of the fourth gate 740 also includes a fire control 722. The fire control 722 is part of the logic. For example, the program or digital logic representing the fourth gate 740 locates the perforating zone by matching a reference casing collar log using real time casing collar information acquired as the tool drops down the well. When the perforating gun assembly 200 reaches the appropriate depth, a firing signal 724 is sent.

The fire control 722 is connected to a 2-pole Form C fire relay 736. The fire relay 736 is controlled through a command signal shown at 724. The fire relay 736 is in a shunting of detonators 716 (or safe) state until activated by the fire control 722, and until the command path 724 through the second gate 720 is available. In their safe state, the fire relay 736 disconnects the up-stream power supply 760 and shunt down-stream detonators 716. The relay 736 is activated upon command 724 from the fire control 722.

The control system 700 optionally also includes a battery kill timer 746. The battery kill timer 746 exists in an armed state for, say, up to 60 minutes. When armed, the battery kill timer 746 closes a relay 752 allowing battery pack 754 to power the controller of gate 740. When necessary to kill the batteries 754, 760, battery kill timer 746 opens lower relay 752' and closes upper relay 752". This allows charge from the power supply 760 to begin dissipating. This, in turn, serves as a safety feature for the system 700.

The battery kill timer 746 is also connected to a detonator disconnect relay 772. This is through a command signal 749. The disconnect relay 772 is preferably a mechanical relay that magnetically latches. Therefore, the relay 772 remains in its last-commanded state even when all electrical power is removed from the system 700.

The relay 772 resides normally in a closed state. However, if the perforating gun 212 fails to fire after a designated period of time, such as 60 minutes, then a command signal 749 is sent and the relay 772 is opened. Opening the relay 772 prevents a firing charge to be delivered from the capacitor 766 to the shunt wires 735, thereby serving as another safety feature for the system 700.

In another arrangement, the detonator disconnect relay 772 resides normally in an open state. When the tool assembly 200 is dropped, the detonator control 742 sends a command signal 743 to close the relay 772, thereby allowing electrical current to flow through the relay 772 and towards the detonators 716. If after a designated period of time, such as 60 minutes, the detonators 716 have not fired, then the battery kill timer 746 sends a separate signal 749 to re-open the relay 772.

In the arrangement of FIG. 7, a command signal 749' is also shown for "disarming" the power supply 760. Redundantly, a separate command signal 749" is optionally directed to the switch 749". In a first designated period of time, such as 1 to 5 minutes, the command signals 749', 749" are dormant. The power supply 760 is inactive and the switch 762 remains open. During a second period of time, such as 4 to 60 minutes, the power supply 760 is activated (through command signal 744' from the detonator control 742) and the switch 762 is closed (through a related command signal 744" from the detonator control 742). During a third designated period of time, such as greater than 30 minutes, or greater than 60 minutes, the power supply 760 is optionally de-activated (using command signal 749').

The controller 216 may be configured to use only one of command signals 749, 749', 749", or any two, or none.

The fifth and final illustrative gate is shown at 750. This fifth gate 750 relates to the installation of a battery pack 754. Power is supplied from the battery pack 754 to the controller of the fourth gate 740 only after the battery pack 754 is installed. Without the controller, the firing capacitor cannot deliver electrical signals through the wires 735 and the detonators 716 cannot be armed. Thus, the battery pack 754 preferably includes a connector that allows the battery pack 754 to be physically disconnected.

It is noted that relay switches 752', 752" may also be magnetically latching relays. As such, the relays 752, 752" maintain their last commanded state after electrical power is removed. Lower relay 752' controls power to the controller 740, while the upper relay 752" is used to discharge the battery 754. In the pre-configured state, both relays 752' and 752" are open. Relay 752" is closed to power up the controller 740. When the battery kill timer 746 commands a battery kill action, the relay 752" is closed by command signal 748. A short time later, relay 752' is commanded to the open state, removing electrical power from the controller 740.

As an optional feature, a discharge bank 756 may be provided to draw down the electrical power stored in the battery pack 754. The discharge bank 756 may be, for example, a bleed-down resistor. The discharge bank 756 eliminates any potential source of long-term energy.

In operation, the battery pack (Gate 5) is installed into the perforating gun 212. The gun 212 is then released into the wellbore 805. The ring removal (Gate 1) triggers a pressure-activated switch (Gate 3) rated to remove the detonator shunt at a predetermined pressure value. In addition, the ring removal (Gate 1) activates a timed relay switch (Gate 2) that removes another detonator shunt once the pre-set time expires. At this point the detonators 716 are ready to fire and await the activation signal from the control system (the Gate 4 electronics module). The electronics module monitors the depth of the gun assembly 200. After the gun 212 has traveled to a pre-programmed depth, the electronics logic (Gate 4) sends a signal that closes a mechanical relay and initiates detonation.

The safety system 700 may have a built-in safe tool retrieval system in case of misfire. A mechanical relay with a timer may also be activated after the shunt 730 is removed. The battery kill timer 746 is programmed to open the relay 722 after a pre-set period of time has passed, for example, one hour after activation. Opening relay 722 is integral to the battery kill operation that also opens relay 752'. Opening relay 752' removes electrical power from the controller 740, which in turn prevents relay 736 from changing state from shunting the detonator 716. Also, opening the relay 722 prevents energy from getting from the firing capacitor 766 to the detonators 716. This may be done, for example, by using a magnet. The assembly 200 may be fished out using conventional fishing techniques and the fishing neck 210.

In the arrangement of FIG. 7, a command signal 744" may be sent to a switch 762. In a first designated period of time, such as 1 to 5 minutes, the switch 762 remains open. During a second period of time, such as 4 to 60 minutes, the switch is closed. And during a third designated period of time, such as greater than 30 minutes, the switch is re-opened.

It is preferred that the perforating gun assembly 200 be manufactured using non-conductive materials such as ceramic. The use of non-conductive materials increases the safety of the perforating gun 212 by reducing the risk of stray currents activating the detonators 712.

Figure 9:
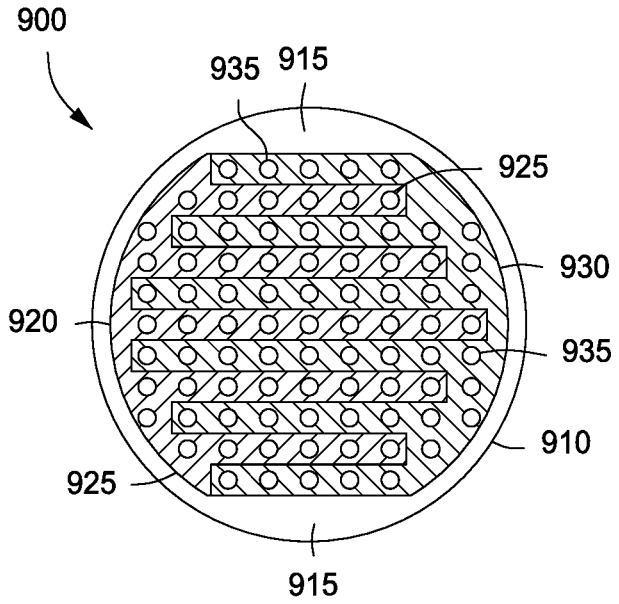
FIG. 9 is a plan view of a fluid-activated shunt switch. The shunt switch may be used to shunt or re-open the multi-gated safety system of FIG. 7 should water invade an autonomous tool.

A fluid-activated shunt switch can also be incorporated into the safety system 700. Such a switch sends an emergency shut down command to the controller 740. Under this condition, the controller 740 immediately activates a kill battery sequence that closes the upper relay 752", opens the relay 772, closes the relay 762, turns off the power to the detonator power supply 760, and opens the relay lower 752', thereby removing electrical power from the controller 740. Relays 752', 752", 762, and 772 are preferably magnetically latching relays so that they will retain the last-commanded state when electrical power is removed, such as in the event that water enters inside the electronics module. FIG. 9 is a plan view of a fluid-activated shunt switch 900. The shunt switch 900 may be used to shunt the safety system 700 of FIG. 7.

The switch 900 defines a disc 910 fabricated, for example, from a silicon material or printed circuit board. Layered over the disc 910 is a comb electrode pattern. A first comb pattern is shown at 920, while a second comb pattern is shown at 930. The first pattern 920 has fluid passage holes 925, while the second pattern 930 has fluid passage holes 935.

If water invades the autonomous tool assembly 200, the switch 900 re-opens the multi-gated safety system 700, cutting off the flow of electrical power to the detonators 712.

It is observed that the safety system 700 is applicable not only to autonomous perforating tools, but also to conventional wireline and slickline perforating guns. Further, the safety system 700 may be used for completing vertical, inclined, and horizontally wells. The type of the well will determine the delivery method of and sequence for the autonomous tools. In vertical and low-angle wells, the force of gravity may be sufficient to ensure the delivery of the assembly 200 to the desired depth or zone. In higher angle wells, including horizontally completed wells, the assembly 200 may be pumped down or delivered using a tractor. To enable pumping down of a first assembly, the casing may be perforated at the toe of the well.

In one aspect, the gate 710 may be a vertical sensor, a horizontal sensor, or a velocity sensor. Any of these may be required conditions that must be met before a relay is changed and the detonators 716 can be activated.

As an additional feature, the safety system 700 may be equipped with a pressure pulse activation system. Pressure pulse activation systems are generally known in the art of downhole tools. Pressure pulse activation systems have pressure sensors that "listen" for pressure pulses delivered through the wellbore fluid column. The pressure pulse may be a binary number that the pressure pulse activation systems record and respond to. The pressure pulse profile, or binary number, is unique to ensure that typical operations would never resemble the profile.

When a designated sequence of pressure pulses is detected, a voltage (or other) electrical signal is sent to a detonator control, such as control 742. The control 742 then instructs the detonators 716 to fire. In this way, an un-fired gun sitting in the rat hole may "self destruct." Also include a claim that describes.

The safety system 700 is ideally suited for use with the Just-In-Time-Perforating™ ("JITP") process which is used for perforating and stimulating subsurface formations at sequential intervals. The JITP process allows an operator to fracture a well at multiple intervals with limited or even no "trips" out of the wellbore. The process has particular benefit for multi-zone fracture stimulation of tight gas reservoirs having numerous lenticular sand pay zones. For example, the JITP process is currently being used to recover hydrocarbon fluids in the Piceance basin.

The JITP technology is the subject of U.S. Pat. No. 6,543,538, entitled "Method for Treating Multiple Wellbore Intervals" which issued Apr. 8, 2003, and is incorporated by reference herein in its entirety. In one embodiment, the '538 patent generally teaches:

using a perforating device, perforating at least one interval of one or more subterranean formations traversed by a wellbore;

pumping treatment fluid through the perforations and into the selected interval without removing the perforating device from the wellbore;

deploying or activating an item or substance in the wellbore to removably block further fluid flow into the treated perforations; and repeating the process for at least one more interval of the subterranean formation.

In the present case, the perforating device is detonated "on the fly," and is never removed. The item that blocks fluid flow into treated perforations is an autonomous plug. This allows for stimulation treatments to multiple subsurface formation targets within a single wellbore.

While it will be apparent that the inventions herein described are well calculated to achieve the benefits and advantages set forth above, it will be appreciated that the inventions are susceptible to modification, variation and change without departing from the spirit thereof.

What is claimed is:

1. An integrated tool for downhole fracture operations, comprising:

a plug body having an elastomeric sealing element;

an actuatable setting tool for setting the plug body within a string of casing in a wellbore, the actuatable setting tool having a detonator for setting the plug within the casing string at a selected depth in response to an electrical actuation signal conveyed to the detonator;

a perforating gun for perforating the string of casing at a selected zone of interest, the perforating gun having detonators with associated charges for perforating the string of casing at the selected zone of interest in response to an electrical signal conveyed to the perforating gun;

a position locator for sensing the location of the integrated tool based upon the detection of objects along the wellbore and generating depth signals in response;

an on-board controller for processing the depth signals and for sending electrical signals to activate the plug and the perforating gun at the selected zone of interest; and a multi-gate safety system in electrical communication with the on-board controller for preventing premature detonation of the actuatable setting tool and the perforating gun, the multi-gate safety system comprising;

(i) control circuitry having one or more electrical switches that are independently operated by the controller in response to separate conditions before permitting the actuation signal to reach the actuatable tool, and (ii) a first on-board power supply for the on-board controller, (iii) a second on-board power supply for actuating at least one of the actuatable tool and the perforating gun; and (iv) a firing capacitor in communication with the on-board controller, wherein at least one of the electrical switches of the multi-gate safety system controls charging of the firing capacitor by the second on-board power supply, wherein the firing capacitor is insufficiently charged to activate the at least one of the actuatable tool and the perforating gun prior to the multi-gate safety system permitting the controller to initiate charging of the firing capacitor;

wherein the integrated tool is dimensioned and arranged to be deployed within the wellbore as an autonomous unit.

2. The integrated tool of claim 1, wherein the multi-gate safety system comprises at least one of:

(i) a selectively removable battery pack, wherein the battery pack provides power to the control circuitry when the battery pack is installed into the assembly;

(ii) a mechanical pull-tab, wherein the control circuitry is configured to operate an electrical switch upon removal of a mechanical pull-tab from the tool assembly;

(iii) a pressure-sensitive switch that operates only when a designated hydraulic pressure is exceeded;

(iv) an electrical timer switch that is configured to selectively operate one or more switches at one or more designated times after deployment of the tool assembly in the wellbore;

(v) a velocity sensor configured to operate an electrical switch only upon sensing that the tool assembly is traveling a designated velocity;

(vi) a sensor configured to actuate an electrical switch when the tool assembly is substantially vertical; and (vii) a sensor configured to actuate an electrical switch when the tool assembly is substantially horizontal wherein operating an electrical switch means either closing such a switch to permit a flow of electrical current through the switch, or opening such a switch to restrict a flow of electrical current through the switch.

3. The integrated tool of claim 2, further comprising:

the multi-gate system comprises the electrical timer; and the one or more switches operated by the electrical timer comprises a shunt switch.

4. The integrated tool of claim 3, wherein:

during a the first designated period of time, the shunt switch is closed; and at a second designated time, the shunt switch is open.

5. The integrated tool of claim 2, wherein:
the multi-gate system comprises the electrical timer;
the one or more switches comprises a detonator switch that resides in an open state during a first designated time;
the electrical timer is configured to send a command signal to the detonator switch to close the detonator switch at a second designated time.

6. The integrated tool of claim 5, wherein:
the first designated time is about 1 to 5 minutes; and
the second designated time is about 4 to 60 minutes.

7. The integrated tool of claim 5, wherein during a third designated time, the shunt switch is again open.

8. The integrated tool of claim 2, wherein:
the multi-gate safety system comprises both the mechanical pull-tab and the timer switch; and
deployment of the tool assembly means that the tool assembly is configured for removal of the mechanical pull-tab.

9. The integrated tool of claim 2, wherein:
the mechanical pull-tab is releasably connected to a cable;
the cable is tethered to a wellhead component over the wellbore; and
the mechanical pull-tab is configured to release upon movement of the tool assembly into the wellbore.

10. The integrated tool of claim 2, wherein:
the multi-gate safety system comprises both the mechanical pull-tab and the pressure sensitive switch; and
the mechanical pull-tab is configured to provide a mechanical barrier for the activation of the pressure-sensitive switch.

11. The integrated tool of claim 2, further comprising:
a fishing neck.

12. The integrated tool of claim 2, further comprising:
a shunt comprising two leads, wherein the shunt is configured to direct electrical current through the leads in a closed position, and to permit a flow of current toward the actuatable tool in an open position.

13. The integrated tool of claim 12, wherein:
the multi-gate system comprises the electrical timer; and
the one or more switches operated by the electrical timer comprises (i) a switch for closing a connection between the removable battery pack and the control circuitry, (ii) a switch for operating a connection between a firing capacitor and the two leads, (iii) or a combination of the two.

14. The integrated tool of claim 2, wherein:
the on-board controller is part of an electronic module comprising onboard memory and built-in logic; and
the electronic module is configured to send a signal that initiates detonation of the perforating gun after the tool assembly has traveled to a pre-programmed location in the wellbore.

15. The integrated tool of claim 14, wherein the built-in logic provides a digital safety barrier based on a predetermined value for (i) tool depth, (ii) tool speed, (iii) travel time, (iv) downhole markers, or (v) combinations thereof.

16. The integrated tool of claim 2, wherein the multi-gate safety system comprises:
the electrical timer switch; and
a mechanical relay having a timer, wherein the timer for the mechanical relay is configured to activate after the electrical timer switch is closed, and to switch the mechanical relay after a pre-set period of time has passed in order to re-open the electrical timer switch.

17. The integrated tool of claim 2, wherein the multi-gate safety system comprises:
the selectively removable battery pack; and
a mechanical relay that connects the battery pack to a discharge bank to draw down electrical power from the battery pack.

18. The integrated tool of claim 2, wherein:
the position locator is a casing collar locator; and
the objects along the wellbore are collars, with the collars being sensed by the collar locator.

19. The integrated tool of claim 2, wherein the integrated tool is substantially fabricated from a friable material.

20. The integrated tool of claim 2, further comprising:
a power supply for providing electrical energy to a firing capacitor in response to a signal from the electrical timer;
the firing capacitor; and
a bleed-down resistor for dissipating electrical energy from the firing capacitor over a designated period of time.

21. The integrated tool of claim 2, wherein:
the multi-gate system comprises the electrical timer; and
the one or more switches operated by the electrical timer comprises at least one relay for selectively providing electrical communication between the selectively removable battery pack and the control circuitry; and
the electrical timer opens the at least one relay to cut off power to the control circuitry at a designated time after the integrated tool is launched into the wellbore.

22. The integrated tool of claim 2, further comprising:
a pressure pulse activation system that is configured to (i) sense pressure sequences from a fluid column within the wellbore, and, in response to recognizing a designated sequence, (ii) send a signal that prompts the detonators to fire using the associated charges.

23. The method tool of claim 2, further comprising:
a power supply for providing electrical energy to a firing capacitor in response to a signal from the electrical timer;
the firing capacitor; and
a bleed-down resistor for dissipating electrical energy from the firing capacitor over a designated period of time.

24. A method of performing a wellbore operation, comprising:
providing a tool assembly at a well site, the tool assembly comprising:
an actuatable tool;
a location device for sensing the location of the actuatable tool within a wellbore based on a physical signature provided along the wellbore;
an on-board controller configured to send an actuation signal to the actuatable tool when the location device has recognized a selected location of the tool based on the physical signature, wherein the actuatable tool, the location device, and the on-board controller are together dimensioned and arranged to be deployed in the wellbore as an autonomous unit; and
a multi-gate safety system for preventing premature activation of the actuatable tool, the safety system comprising control circuitry having one or more electrical switches that are independently operated in response to separate conditions before permitting the activation signal to reach the actuatable tool, a first on-board power supply for the on-board controller, and a second on-board power supply for actuating the actuatable tool, and a firing capacitor a firing capacitor in communication with the on-board controller, wherein at least one of the electrical switches of the multi-gate safety system controls charging of the firing capacitor by the second on-board power supply, wherein the firing capacitor is insufficiently charged to activate the actuatable tool prior to the multi-gate safety system permitting the controller to initiate charging of the firing capacitor;

deploying the tool assembly into the wellbore without electrical control external to the wellbore;

the location device sensing a selected position within the wellbore and the location device sending a signal to the controller related to the selected position within the wellbore;

powering the on-board controller with the first on-board power supply;

providing the on-board controller with instructions for determining when to operate the at least one electrical switch to in response to a signal from the location device;

operating the switch in response to instructions from the controller to permit the second on-board power supply to charge the firing capacitor; and using at least one of the on-board controller, the first power supply, and the second power supply to selectively operate another electrical switch to discharge the firing capacitor to actuate the actuatable tool.

25. The method of claim 24, wherein the multi-gate safety system comprises at least one of:

(i) a selectively removable battery pack, wherein the battery pack provides power to the control circuitry when the battery pack is installed into the assembly;

(ii) a mechanical pull-tab, wherein the control circuitry is configured to operate an electrical switch upon removal of the tab from the tool assembly;

(iii) a pressure-sensitive electrical switch that operates only when a designated hydraulic pressure on the tool assembly is exceeded;

(iv) an electrical timer that is configured to selectively operate one or more switches at one or more designated times after deployment of the tool assembly in the wellbore;

(v) a velocity sensor configured to operate an electrical switch only upon sensing that the tool assembly is traveling at a designated velocity;

(vi) a sensor configured to actuate an electrical switch when the tool assembly is substantially vertical; and (vii) a sensor configured to actuate an electrical switch when the tool assembly is substantially horizontal;

wherein operating an electrical switch means either closing such a switch to permit a flow of electrical current through the switch, or opening such a switch to restrict a flow of electrical current through the switch.

26. The method of claim 24, wherein:

the tool assembly comprises a perforating gun assembly;

the actuatable tool comprises a perforating gun having detonators that detonate in response to an electrical signal from the firing capacitor; and the method further comprises delivering the tool assembly to the selected location in the wellbore such that when the tool assembly reaches the selected location, the perforating gun fires the detonators to produce perforations.

27. The method of claim 26, wherein delivering the tool assembly to the selected location in the wellbore comprises (i) dropping the tool assembly into the wellbore and allowing it to gravitationally fall, (ii) pumping the tool assembly into the wellbore, or (iii) moving the tool assembly by use of a tractor.

28. The method of claim 26, wherein:

the multi-gate system comprises the electrical timer; and the one or more switches operated by the electrical timer comprises a shunt switch.

29. The method of claim 28, wherein:

during a first designated time, the shunt switch is closed; and the method further comprises opening the shunt switch at a second designated time.

30. The method of claim 28, wherein:

the multi-gate system comprises the electrical timer;

the one or more switches comprises a detonator switch that resides in an open state during a first designated period of time;

the electrical timer is configured to send a command signal to the detonator switch to close the detonator switch at a second designated time.

31. The method of claim 26, wherein:

the multi-gate safety system comprises both the mechanical pull-tab and the timer switch; and the method further comprises removing the mechanical pull-tab when deploying the tool assembly.

32. The method of claim 31, wherein:

the mechanical pull-tab is releasably connected to a cable;

the cable is tethered to a wellhead component over the wellbore; and removing the mechanical pull-tab comprises dropping the tool assembly into the wellbore so as to cause the mechanical pull-tab to release from the cable.

33. The method of claim 26, wherein the tool assembly further comprises a shunt comprising two leads, wherein the shunt is configured to direct electrical current through the leads in a closed position, and to permit a flow of current toward the actuatable tool in an open position.

34. The method of claim 33, wherein:

the multi-gate system comprises the electrical timer; and the one or more switches operated by the electrical timer comprises (i) a switch for closing a connection between the removable battery pack and the control circuitry, (ii) a switch for operating a connection between a firing capacitor and the two leads, (iii) or a combination of the two.

35. The method of claim 26 wherein:

the multi-gate safety system comprises both the mechanical pull-tab and the pressure sensitive switch; and the mechanical pull-tab is configured to provide a mechanical barrier for the activation of the pressure-sensitive switch.

36. The method of claim 26, wherein:

the on-board controller is part of an electronic module comprising onboard memory and built-in logic; and the electronic module is configured to send a signal that initiates detonation of the perforating gun after the tool assembly has traveled to a pre-programmed location in the wellbore.

37. The method of claim 26, wherein the multi-gate safety system comprises:

the electrical timer switch;

a mechanical relay having a timer, wherein the timer for the mechanical relay is configured to activate after the electrical timer switch is closed, and to switch the mechanical relay after a pre-set period of time has passed in order to re-open the electrical timer switch.

38. The method of claim 26, wherein the multi-gate safety system comprises:

the selectively removable battery pack; and a relay that connects the battery pack to a discharge bank to draw down electrical power from the battery pack.

39. The system of claim 26, wherein:

the location device is a casing collar locator; and the physical signature is formed by the spacing of collars along a string of casing, with the collars being sensed by the collar locator.

40. The method of claim 26, wherein:

the multi-gate system comprises the electrical timer;

the one or more switches operated by the electrical timer comprises at least one relay for selectively providing electrical communication between the selectively removable battery pack and the control circuitry; and the method further comprises opening the at least one relay to cut off power to the control circuitry at a designated time after the tool assembly is launched into the wellbore.

41. The method of claim 26, wherein the tool assembly further comprises:

a pressure pulse activation system that is configured to (i) sense pressure sequences from a fluid column within the wellbore, and, in response to recognizing a designated sequence, (ii) send a signal that prompts the perforating gun to fire.

42. The method of claim 24, wherein:

the actuatable tool is a fracturing plug or a bridge plug configured to form a substantial fluid seal when actuated within the wellbore at the selected location;

the plug comprises an elastomeric sealing element and a set of slips for holding the location of the tool assembly proximate the selected location; and the method further comprises delivering the tool assembly to the selected location in the wellbore such that when the tool assembly reaches the selected location, the elastomeric sealing element and the slips set in the wellbore.

43. The method of claim 24, wherein:

the actuatable tool comprises at least one of a casing patch, a cement retainer, a cutting tool, or a bridge plug; and the actuatable tool is at least partially fabricated from a millable material.

* * * * *